US007679475B2

(12) United States Patent
Yoshikawa

(10) Patent No.: US 7,679,475 B2
(45) Date of Patent: Mar. 16, 2010

(54) BANDPASS FILTER AND HIGH FREQUENCY MODULE USING THE SAME AND RADIO COMMUNICATION DEVICE USING THEM

(75) Inventor: Hiromichi Yoshikawa, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 12/325,081

(22) Filed: Nov. 28, 2008

(65) Prior Publication Data

US 2009/0140827 A1 Jun. 4, 2009

Related U.S. Application Data

(63) Continuation-in-part of application No. PCT/JP2007/057299, filed on Mar. 30, 2007.

(30) Foreign Application Priority Data

May 29, 2006 (JP) ..... 2006-148575
Oct. 10, 2006 (JP) ..... 2006-276133
Oct. 13, 2006 (JP) ..... 2006-279482

(51) Int. Cl.
*H01P 1/20* (2006.01)
*H01P 3/08* (2006.01)

(52) U.S. Cl. ..... 333/204; 333/20; 333/238; 333/246

(58) Field of Classification Search ..... 333/202–205, 333/238, 246
See application file for complete search history.

(56) References Cited

U.S. PATENT DOCUMENTS 5,105,173 A * 4/1992 Itou ..... 333/204

(Continued)

FOREIGN PATENT DOCUMENTS

JP 1-146603 10/1989

(Continued)

OTHER PUBLICATIONS

"An Ultra-Wideband Band Pass Filter Using Broadside-Coupled Microstrip-Coplanar Waveguide Structure", IEICE Transactions, No. C-2-114, p. 147, Mar. 2005.

*Primary Examiner*—Robert Pascal
*Assistant Examiner*—Kimberly E Glenn
(74) *Attorney, Agent, or Firm*—Birch, Stewart, Kolasch & Birch, LLP

(57) ABSTRACT

A bandpass filter having a bandpass width appropriate for UWB, a high frequency module including the bandpass filter, and radio communication device including both is provided. The bandpass filter including a laminate composed of a plurality of dielectric layers 11; first and second ground electrodes arranged on the bottom and top surfaces, respectively, of the laminate; resonance electrodes 30*a*, 30*b*, and 30*c* arranged in an inter-digital structure on a first inter-layer surface of the laminate, one end of each of the resonance electrodes being grounded; an input coupling electrode 40*a* arranged on an inter-layer surface different from the first inter-layer surface of the laminate facing the resonance electrode 30*a* of the input stage in the inter-digital type; and an output coupling electrode 40*b* arranged on an inter-layer surface different from the first inter-layer surface of the laminate to face the resonance electrode 30*b* of the output stage. Accordingly, it can be possible to achieve a bandpass filter that has a flat and low-loss pass characteristic over the entire region of the broad passband that could not be achieved by a band pass filter using the conventional ¼ wavelength resonator.

12 Claims, 34 Drawing Sheets

U.S. PATENT DOCUMENTS 5,122,768 A * 6/1992 Ito et al. ..... 333/204
5,374,909 A * 12/1994 Hirai et al. ..... 333/204
6,018,282 A * 1/2000 Tsuda ..... 333/205

FOREIGN PATENT DOCUMENTS

JP 10-117104 A 5/1998
JP 10-145105 A 5/1998
JP 10-190308 A 7/1998
JP 11-88009 A 3/1999
JP 2004-180032 A 6/2004

* cited by examiner

Top surface

Inter-layer portion C

Inter-layer portion B

Inter-layer portion A

Bottom surface

Top surface

Inter-layer portion C

Inter-layer portion B

Inter-layer portion A

Inter-layer portion D

Bottom surface

Top surface

Inter-layer portion G

Inter-layer portion F

Inter-layer portion E

Inter-layer portion C

Inter-layer portion B

Inter-layer portion A

Bottom surface

BANDPASS FILTER AND HIGH FREQUENCY MODULE USING THE SAME AND RADIO COMMUNICATION DEVICE USING THEM

CROSS-REFERENCE TO RELATED APPLICATIONS

This application is a continuation-in-part of International Patent Application No. PCT/JP2007/057299 filed Mar. 30, 2007 and which is incorporated herein in by reference.

BACKGROUND OF THE INVENTION

1. Field of the Invention

The present invention generally relates to a bandpass filter, a high frequency module using the bandpass filter, and a radio communication device using the bandpass filter and the high frequency module, and more particularly, relates to a bandpass filter that may be preferably used for UWB (Ultra Wide Band) and has a very broad pass band, a high frequency module using the bandpass filter, and a radio communication device using the bandpass filter and the high frequency module.

2. Description of the Related Art

In recent years, UWB (Ultra Wide Band) has drawn attention as a new communication means. UWB transmits huge amounts of data using a broad frequency band over a short distance such as 10 m, and for example, a frequency band of 3.1 to 10.6 GHz is subjected to use for UWB according to the rule of U.S. FCC (Federal Communication Commission). As such, a feature of UWB is to utilize a very broad frequency band. Japan and the ITU-R have a plan to introduce standards separated into a low band of about 3.1 to 4.7 GHz and a high band of about 6 GHz to 10.6 GHz to avoid a band of 5.3 GHz that is used in the IEEE802.11a standard. Accordingly, a low band filter requires the characteristic of being abruptly attenuated at 2.5 GHz and 5.3 GHz.

BRIEF SUMMARY OF THE INVENTION

An object of the present invention is to provide a bandpass filter that has a pass band width appropriate for UWB, a high frequency module using the bandpass filter, and a radio communication device using them.

BRIEF DESCRIPTION OF THE DRAWINGS

The present disclosure, in accordance with one or more embodiments, is described in detail with reference to the following figures. The drawings are provided for purposes of illustration only and merely depict typical or exemplary embodiments of the disclosure. These drawings are provided to facilitate the reader's understanding of the disclosure and shall not be considered limiting of the breadth, scope, or applicability of the disclosure. It should be noted that for clarity and ease of illustration these drawings are not necessarily made to scale.

DETAILED DESCRIPTION OF EXEMPLARY EMBODIMENTS OF THE INVENTION

In the following description of exemplary embodiments, reference is made to the accompanying drawings which form a part hereof, and in which it is shown by way of illustration specific embodiments in which the invention may be practiced. It is to be understood that other embodiments may be utilized and structural changes may be made without departing from the scope of the present invention.

Hereinafter, embodiments of the present invention will be described in detail with reference to accompanying drawings.

Hereinafter, a bandpass filter according to embodiments of the present invention, a high frequency module using the bandpass filter, and a radio communication device using the bandpass filter and the high frequency module will be described in detail with reference to accompanying drawings.

First Embodiment

Figure 1:
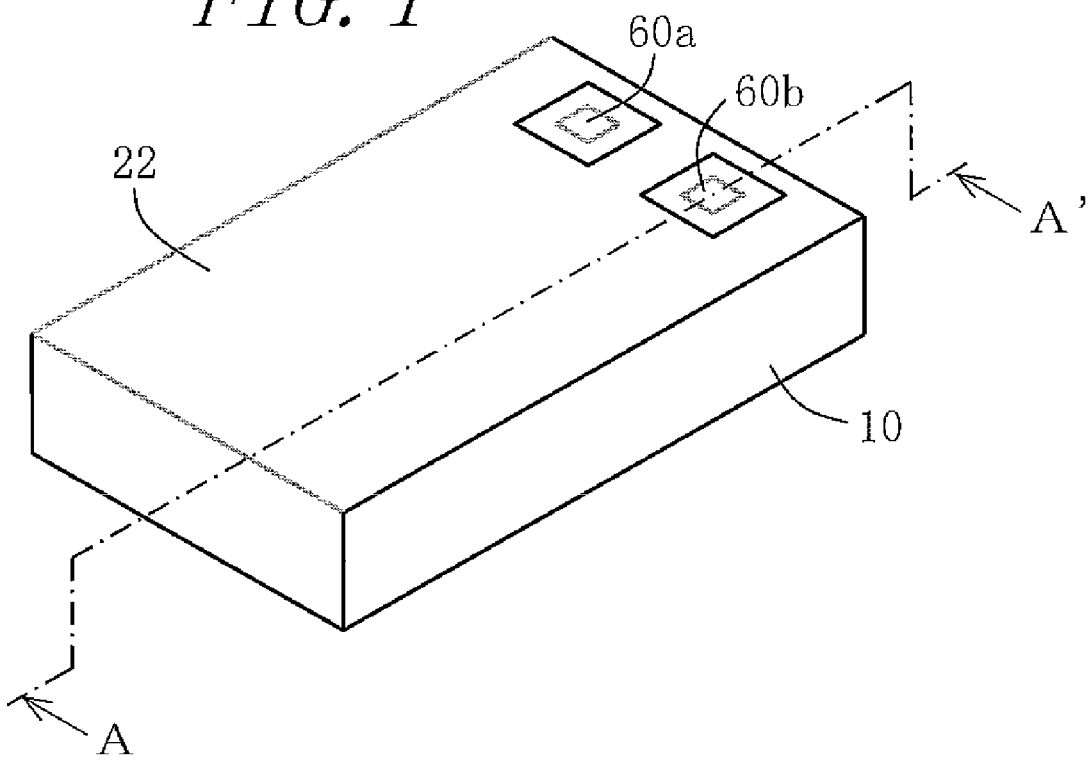
FIG. 1 is a perspective view schematically illustrating the external appearance of a bandpass filter according to a first embodiment of the present invention.
Figure 2:
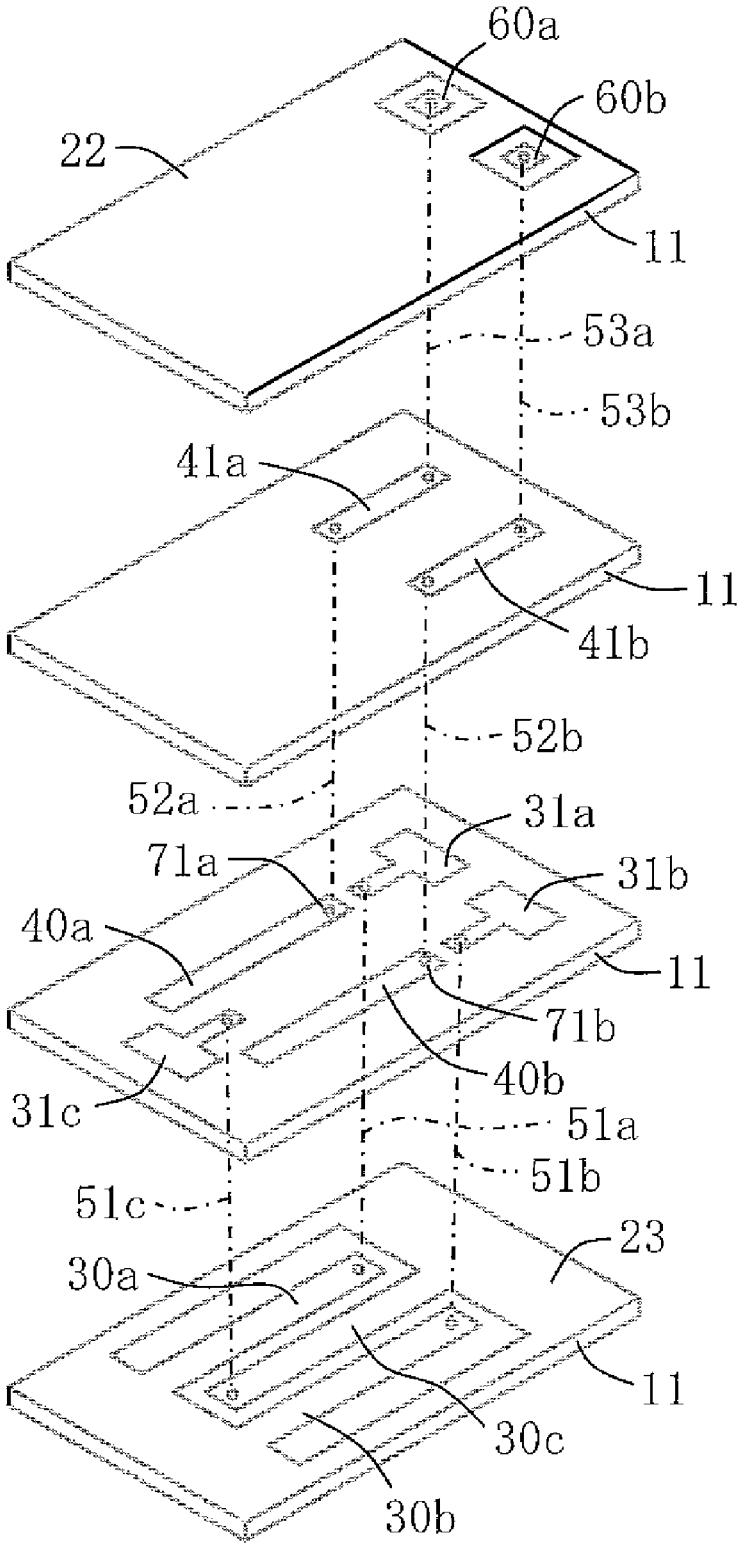
FIG. 2 is an exploded perspective view schematically illustrating the bandpass filter shown in FIG. 1.
Figure 3A:
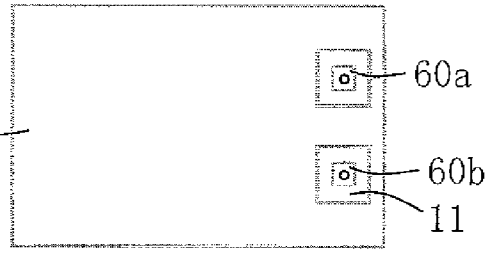
FIG. 3A to FIG. 3E are plan views schematically illustrating an upper surface, a lower surface, and inter-layer portions of the bandpass filter shown in FIG. 1.
Figure 3B:
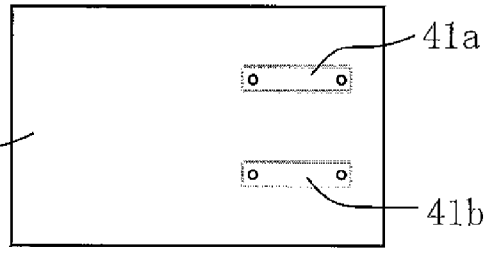
Figure 3C:
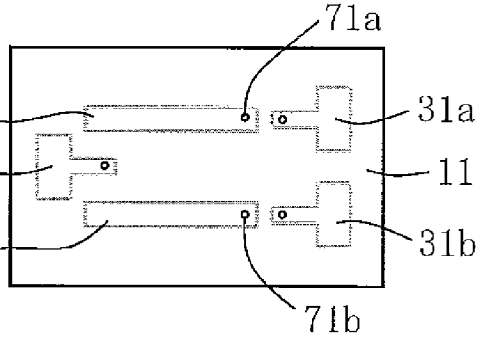
Figure 3D:
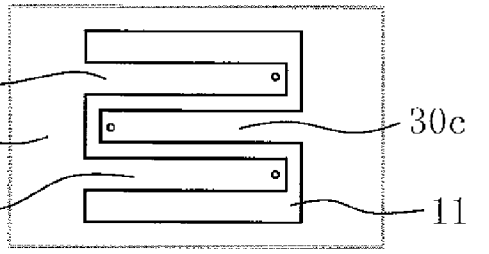
Figure 3E:
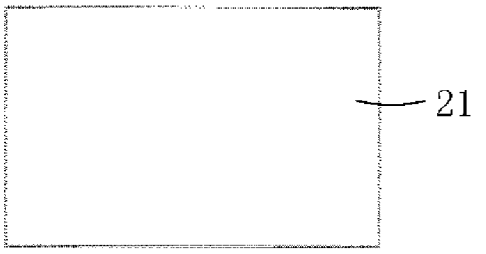
Figure 4:
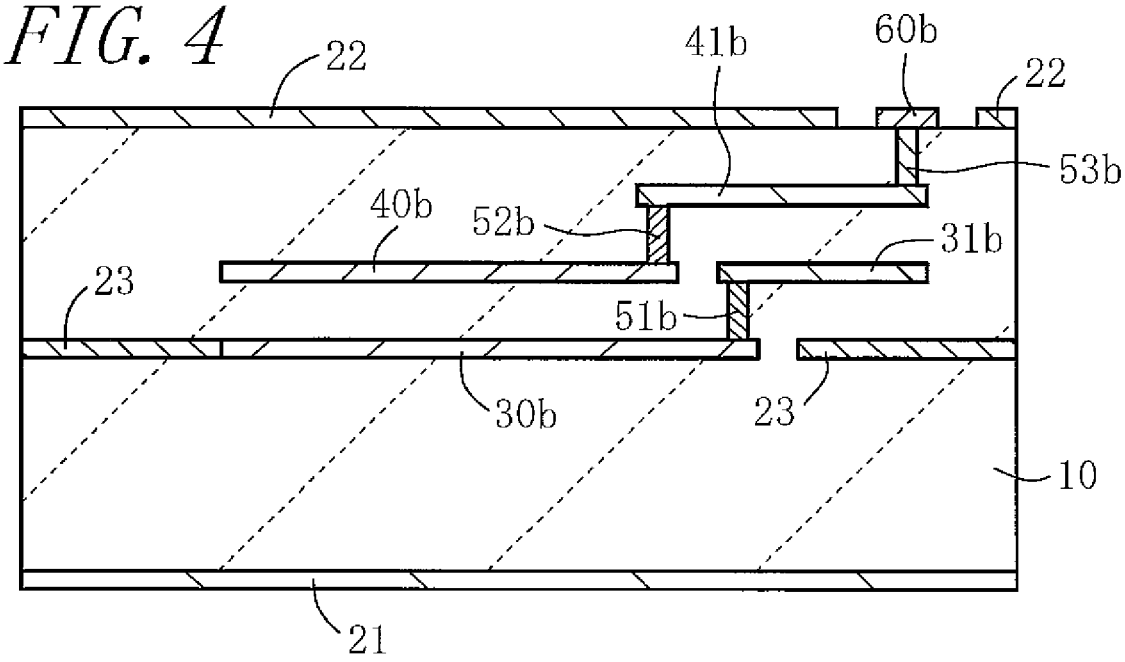
FIG. 4 is a cross sectional view taken along the line A-A' shown in FIG. 1.

FIG. 1 is a perspective view schematically illustrating the external appearance of a bandpass filter according to a first embodiment of the present invention. FIG. 2 is an exploded perspective view schematically illustrating the bandpass filter shown in FIG. 1. FIGS. 3A to 3E are plan views schematically illustrating an upper surface, a lower surface, and inter-layer portions of the bandpass filter shown in FIG. 1. FIG. 4 is a cross sectional view taken along the line A-A' shown in FIG. 1.

The bandpass filter according to the first embodiment includes a laminate 10 which is formed by stacking a plurality of dielectric layers 11; a first ground electrode 21 arranged on the bottom surface of the laminate 10; a second ground electrode 22 arranged on the top surface of the laminate 10; strip-shaped resonance electrodes 30*a*, 30*b*, and 30*c* arranged on an inter-layer portion A of the laminate 10 in parallel with each other; an annular ground electrode 23 shaped as a ring on the inter-layer portion A of the laminate 10 to surround the resonance electrodes 30*a*, 30*b*, and 30*c* and to which one end (ground end) of each of the resonance electrodes 30*a*, 30*b*, and 30*c* is connected; a strip-shaped input coupling electrode 40*a* arranged on another inter-layer portion B of the laminate 10 to face the resonance electrode 30*a* of an input stage; a strip-shaped output coupling electrode 40*b* arranged on the inter-layer portion B of the laminate 10 to face the resonance electrode 30*b* of an output stage; auxiliary resonance electrodes 31*a*, 31*b*, and 31*c* arranged on the inter-layer portion B of the laminate 10 to face the annular ground electrode 23 and connected to the resonance electrodes 30*a*, 30*b*, and 30*c*, respectively, by first penetration conductors 51*a*, 51*b*, and 51*c*, respectively, which penetrate the dielectric layer 11; an auxiliary input coupling electrode 41*a* arranged on another inter-layer portion C of the laminate 10 to face the auxiliary resonance electrode 31*a* and connected to the input coupling electrode 40*a* by a second penetration conductor 52*a* which penetrates the dielectric layer 11; an auxiliary output coupling electrode 41*b* arranged on the inter-layer portion C of the laminate 10 to face the auxiliary resonance electrode 31*b* and connected to the output coupling electrode 40*b* by a second penetration conductor 52*b* which penetrates the dielectric layer 11; an input terminal electrode 60*a* arranged on the top surface of the laminate 10 and connected to the auxiliary input coupling electrode 41*a* by a third penetration conductor 53*a* which penetrates the dielectric layer 11; and an output terminal electrode 60*b* arranged on the top surface of the laminate 10 and connected to the auxiliary output coupling electrode 41*b* by a third penetration conductor 53*b* which penetrates the dielectric layer 11.

The first ground electrode 21 is arranged on the entire surface of the bottom surface of the laminate 10, and the second ground electrode 22 is arranged on the nearly entire surface of the top surface of the laminate 10 except for the peripheries of the input terminal electrode 60*a* and the output stage electrode 60*b*, so that either one of the first ground electrode 21 and the second ground electrode 22 are connected to the ground potential, and therefore, the first ground electrode 21 and the second ground electrode 22 constitute a strip line resonator along with the resonance electrodes 30*a*, 30*b*, and 30*c*.

Since the strip-shaped resonance electrodes 30*a*, 30*b*, and 30*c* constitute a strip line resonator along with the first ground electrode 21 and the second ground electrode 22, and one end (ground end) of each of the resonance electrodes 30*a*, 30*b*, and 30*c* is connected to the annular ground electrode 23, i.e., to the ground potential, the strip line resonator may function as a ¼ wavelength resonator. The length of each of the resonance electrodes 30*a*, 30*b*, and 30*c* is adapted to be shorter than ¼ of the wavelength at the center frequency of the bandpass filter by taking into consideration an capacitance effect that takes place between the auxiliary resonance electrodes 31*a*, 31*b*, and 31*c* and the annular ground electrode 23. For instance, the length of each of the resonance electrodes 30*a*, 30*b*, and 30*c* is set on the order of 2 to 6 mm when the relative dielectric constant of the dielectric layer 11 is set on the order of 10 by setting the center frequency as 4 GHz.

In addition, the resonance electrodes 30*a*, 30*b*, and 30*c* are arranged on the inter-layer portion A in parallel with each other to be edge-coupled with each other. As the interval between the resonance electrodes 30*a*, 30*b*, and 30*c* becomes narrower, the coupling may be stronger. However, if the interval becomes too narrow, it may become difficult to manufacture the resonance electrodes 30*a*, 30*b*, and 30*c*. Accordingly, the interval between the resonance electrodes 30*a*, 30*b*, and 30*c* is set on the order of, for example, 0.05 to 0.5 mm. In addition, the resonance electrodes 30*a*, 30*b*, and 30*c* are arranged so that one end of each resonance electrode is alternate to the other end of its adjacent resonance electrode, that is, the resonance electrodes 30*a*, 30*b*, and 30*c* are coupled with each other in an inter-digital type, and this enables a coupling by magnetic fields to be added to a coupling by electric fields, thus making the coupling stronger compared to when the resonance electrodes 30*a*, 30*b*, and 30*c* are coupled with each other in a comb-line type. As such, since the resonance electrodes 30*a*, 30*b*, and 30*c* are not only edge-coupled but also coupled with each other in the inter-digital type, the frequency interval between resonance frequencies in each resonance mode is adapted to be appropriate to gain a broad pass band width on the order of 40% by the relative bandwidth which is well in excess of the region that can be realized by the conventional filter using the ¼ wavelength resonator and is very appropriate as a bandpass filter for UWB.

In addition, our review showed that it is not preferable to make a coupling between the resonance electrodes 30*a*, 30*b*, and 30*c* in an inter-digital type and make a broad-side coupling therebetween as well because the coupling becomes too strong to achieve the pass band width of about 40% by the relative bandwidth.

The annular ground electrode 23 is formed on the inter-layer portion A of the laminate 10 in the shape of a ring to surround the peripheries of the resonance electrodes 30*a*, 30*b*, and 30*c*, and connected to one end (ground end) of each of the resonance electrodes 30*a*, 30*b*, and 30*c*. The annular ground electrode 23 itself is connected to the ground potential, and therefore, the annular ground electrode 23 functions to connect one end of each of the resonance electrodes 30*a*, 30*b*, and 30*c* to the ground potential. The existence of the annular ground electrode 23 allows for easy connection of one end of each of the resonance electrodes 30*a*, 30*b*, and 30*c* arranged in the inter-digital type to the ground electrode even when the bandpass filter is formed at a portion of the module substrate. In addition, the annular ground electrode 23 surrounding the peripheries of the resonance electrodes 30*a*, 30*b*, and 30*c*, may reduce the leakage of electromagnetic waves generated from the resonance electrodes 30*a*, 30*b*, and 30*c* to the surroundings. This effect is particularly advantageous in preventing the other portions of the module substrate from being negatively affected when the bandpass filter is formed at a portion of the module substrate. Further, the length of the resonance electrodes 30*a*, 30*b*, and 30*c* may be shortened thanks to the capacitance generated between the annular ground electrode 23 and the auxiliary resonance electrodes 31*a*, 31*b*, and 31*c*, and this realizes a small size bandpass filter.

The strip-shaped input coupling electrode 40*a* is arranged on the inter-layer portion B different from the inter-layer portion A on which the resonance electrodes 30*a*, 30*b*, and 30*c* are arranged, so that its entirety is opposite to the resonance electrode 30*a* of the input stage, and therefore, the input coupling electrode 40*a* faces the resonance electrode 30*a* of the input stage over more than half of the length of the resonance electrode 30*a* of the input stage. Accordingly, the input coupling electrode 40*a* and the resonance electrode 30*a* of the input stage are broad-side coupled with each other, and therefore, the coupling becomes stronger than the edge-coupling. Further, the strip-shaped input coupling electrode 40*a* is connected to the auxiliary input coupling electrode 41*a* by the second penetration conductor 52*a*, and the contact point 71*a* of the input coupling electrode 40*a* and the second penetration conductor 52*a* is adapted to be located at an end of the input coupling electrode 40*a*, which is near the other end of the resonance electrode 30*a* of the input stage rather than the center of the input coupling electrode 40*a* in the longitudinal direction, and the other end of the input coupling electrode 40*a* is the open end. An electrical signal inputted from an external circuit is supplied to the input coupling electrode 40*a* through the contact point 71*a*. By doing so, the input coupling electrode 40*a* and the resonance electrode 30*a* of the input stage are coupled with each other in an inter-digital type, and therefore, a coupling by magnetic fields are added to a coupling by electric fields, so that the coupling becomes stronger than the comb-line type coupling alone or capacitive coupling alone. As such, since the input coupling electrode 40*a* is not only broad-side coupled but also coupled in an inter-digital type with the resonance electrode 30*a* of the input stage in its entirety, the input coupling electrode 40*a* ends up to be coupled with the resonance electrode 30*a* of the input stage very strongly.

Similarly, the strip-shaped input coupling electrode 40*b* is arranged on the inter-layer portion B different from the inter-layer portion A on which the resonance electrodes 30*a*, 30*b*, and 30*c* are arranged, so that its entirety is opposite to the resonance electrode 30*b* of the output stage, and therefore, the output coupling electrode 40*b* faces the resonance electrode 30*b* of the output stage over more than half of the length of the resonance electrode 30*b* of the output stage. Accordingly, the output coupling electrode 40*b* and the resonance electrode 30*b* of the output stage are broadside coupled with each other, and therefore, the coupling becomes stronger than the edge-coupling. Further, the strip-shaped input coupling electrode 40*b* is connected to the auxiliary output coupling electrode 41*b* by the second penetration conductor 52*b*, and the contact point 71*b* of the output coupling electrode 40*b* and the second penetration conductor 52*b* is adapted to be located at an end of the output coupling electrode 40*b*, which is near the other end of the resonance electrode 30*b* of the output stage rather than the center of the output coupling electrode 40*b* in the longitudinal direction, and the other end of the output coupling electrode 40*b* is the open end. An electrical signal inputted from an external circuit is supplied to the output coupling electrode 40*b* through the contact point 71*b*. By doing so, the output coupling electrode 40*b* and the resonance electrode 30*b* of the output stage are coupled with each other in the inter-digital type, and therefore, a coupling by magnetic fields are added to a coupling by electric fields, so that the coupling becomes stronger than the comb line-type coupling alone or capacitive coupling alone. As such, since the output coupling electrode 40*b* is not only broad-side coupled but also coupled in an inter-digital type with the resonance electrode 30*b* of the output stage in its entirety, the output coupling electrode 40*b* ends up to be coupled with the resonance electrode 30*b* of the output stage very strongly.

As such, since the input coupling electrode 40*a* and the resonance electrode 30*a* of the input stage are coupled with each other very strongly and the output coupling electrode 40*b* and the resonance electrode 30*b* of the output stage are coupled with each other very strongly, a bandpass filter may be obtained, whose insertion loss is not greatly increased at frequencies located between resonance frequencies in each resonance mode even in the broad pass band width well in excess of the region that may be achieved by the conventional filter using the ¼ wavelength resonator, and which has a flat and low-loss transmission characteristic over the entire region of the broad pass band.

In addition, it is preferable that the shape dimensions of the input coupling electrode 40*a* and the output coupling electrode 40*b* are set to be substantially identical to those of the resonance electrode 30*a* and the resonance electrode 30*b*, respectively. As the interval between the input coupling electrode 40*a* and the resonance electrode 30*a* of the input stage and the interval between the output coupling electrode 40*b* and the resonance electrode 30*b* of the output stage are smaller, the coupling may become stronger, however, they become difficult to manufacture. Therefore, the intervals are set, for example, on the order of 0.01 to 0.5 mm.

The auxiliary resonance electrodes 31*a*, 31*b*, and 31*c*, respectively, are arranged on the inter-layer portion B of the laminate 10 to have an area facing the resonance electrodes 30*a*, 30*b*, and 30*c*, respectively, and an area facing the annular ground electrode 23. The area facing each of the resonance electrodes 30*a*, 30*b*, and 30*c* is connected to the other end (open end) of each of the resonance electrodes 30*a*, 30*b*, and 30*c* by each of the first penetration conductors 51*a*, 51*b*, and 51*c* that penetrate the dielectric layer 11 located between the auxiliary resonance electrodes 31*a*, 31*b*, and 31*c* and the resonance electrodes 30*a*, 30*b*, and 30*c*. In the area where the auxiliary resonance electrodes 31*a*, 31*b*, and 31*c* face the annular ground electrode 23, capacitance is generated between the auxiliary resonance electrodes 31*a*, 31*b*, and 31*c* and the annular ground electrode 23, and this may shorten the length of the resonance electrodes 30*a*, 30*b*, and 30*c*, thus enabling a small-size bandpass filter.

Further, each of the auxiliary resonance electrodes 31*a*, 31*b*, and 31*c* is connected to the other end of each of the resonance electrodes 30*a*, 30*h*, and 30*c*, and extended therefrom in the opposite direction of the one end of each of the resonance electrodes 30*a*, 30*b*, and 30*c*. Accordingly, an assembly of the resonance electrode 30*a* of the input stage and the auxiliary resonance electrode 31*a* connected to the resonance electrode 30*a* and an assembly of the input coupling electrode 40*a* and the auxiliary input coupling electrode 41*a* connected to the input coupling electrode 40*a* are generally broad-side coupled with each other and coupled in the inter-digital type as well, thus making the coupling very strong as described in detail later. Similarly, an assembly of the resonance electrode 30*b* of the output stage and the auxiliary resonance electrode 31*b* connected to the resonance electrode 30*b* and an assembly of the output coupling electrode 40*b* and the auxiliary output coupling electrode 41*b* connected to the input coupling electrode 40*a* are generally broad-sided coupled with each other and coupled in the inter-digital type as well, thus making the coupling very strong as described in detail later.

The area of the region of each of the auxiliary resonance electrodes 31*a*, 31*b*, and 31*c* facing the annular ground electrode 23 is set, for example, on the order of 0.01 to 3 $mm^2$ in terms of the necessary size and obtainable capacitance. As the interval between regions of the auxiliary resonance electrodes 31*a*, 31*b*, and 31*c* facing the annular ground electrode 23 is smaller, larger capacitance may be generated, however, they become difficult to manufacture. For example, the interval is set on the order of, for example, 0.01 to 0.5 mm.

The auxiliary input coupling electrode 41*a* is shaped as a strip, and arranged on the inter-layer portion C different from the inter-layer portion B on which the input coupling electrode 40*a* and the output coupling electrode 40*b* are arranged, to have a region facing the auxiliary resonance electrode 31*a* connected to the resonance electrode 30*a* of the input stage and a region facing the input coupling electrode 40*a*, and the region facing the input coupling electrode 40*a* is connected to the input coupling electrode 40*a* by the second penetration conductor 52*a* that penetrates the dielectric layer 11 located between the auxiliary input coupling electrode 41*a* and the input coupling electrode 40*a*. By doing so, the auxiliary input coupling electrode 41*a* connected to the input coupling electrode 40*a* and the auxiliary resonance electrode 31*a* connected to the resonance electrode 30*a* of the input stage are broad-side coupled and this coupling is added to the coupling between the input coupling electrode 40*a* and the resonance electrode 30*a* of the input stage, thus making the coupling stronger in entirety.

Besides, since the other end of the auxiliary input coupling electrode 41*a*, which is opposite to an end of the auxiliary input coupling electrode 41*a* connected to the second penetration conductor 52*a*, is connected to the input terminal electrode 60*a* that is arranged on the top surface of the laminate 10 by the third penetration conductor 53*a*, an assembly of the resonance electrode 30*a* of the input stage and the auxiliary resonance electrode 31*a* connected to the resonance electrode 30*a* and an assembly of the input coupling electrode 40*a* and the auxiliary input coupling electrode 41*a* connected to the input coupling electrode 40*a* are generally coupled with each other in the inter-digital type, and therefore, a coupling by magnetic fields and a coupling by electric fields are added to each other, thus making the coupling stronger. Accordingly, a stronger coupling may be achieved at the end of the auxiliary input coupling electrode 41*a*, which is connected to the input coupling electrode 40*a*, than at the other end of the auxiliary input coupling electrode 41*a*, which is connected to the input terminal electrode 60*a*.

The auxiliary output coupling electrode 41*b* is shaped as a strip, and arranged on the inter-layer portion C different from the inter-layer portion B on which the input coupling electrode 40*a* and the output coupling electrode 40*b* are arranged, to have a region facing the auxiliary resonance electrode 31*b* connected to the resonance electrode 30*b* of the output stage and a region facing the output coupling electrode 40*b*, and the region facing the output coupling electrode 40*b* is connected to the output coupling electrode 40*b* by the second penetration conductor 52*h* that penetrates the dielectric layer 11 located between the auxiliary output coupling electrode 41*b* and the output coupling electrode 40*b*. By doing so, the auxiliary output coupling electrode 41*b* connected to the output coupling electrode 40*b* and the auxiliary resonance electrode 31*b* connected to the resonance electrode 30*b* of the output stage are broad-side coupled with each other, and this coupling is added to the coupling between the output coupling electrode 40*b* and the resonance electrode 30*b* of the output stage, thus making the coupling stronger in entirety.

Besides, since the other end of the auxiliary output coupling electrode 41*b*, which is opposite to an end of the auxiliary output coupling electrode 4*ba* connected to the second penetration conductor 52*b*, is connected to the output terminal electrode 60*b* that is arranged on the top surface of the laminate 10 by the third penetration conductor 53*b*, an assembly of the resonance electrode 30*b* of the output stage and the auxiliary resonance electrode 31*b* connected to the resonance electrode 30*b* and an assembly of the output coupling electrode 40*b* and the auxiliary output coupling electrode 41*b* connected to the output coupling electrode 40*b* are generally coupled with each other in the inter-digital type, and therefore, a coupling by magnetic fields and a coupling by electric fields are added to each other, thus making the coupling stronger. Accordingly, a stronger coupling may be achieved at the end of the auxiliary output coupling electrode 41*b*, which is connected to the output coupling electrode 40*b*, than at the other end of the auxiliary output coupling electrode 41*b*, which is connected to the output stage electrode 60*b*.

As such, since the assembly of the resonance electrode 30*a* of the input stage and the auxiliary resonance electrode 31*a* connected to the resonance electrode 30*a* and the assembly of the input coupling electrode 40*a* and the auxiliary input coupling electrode 41*a* connected to the input coupling electrode 40*a* are generally not only broad-side coupled but also coupled with each other in the inter-digital type, the coupling becomes very strong, and similarly, the assembly of the resonance electrode 30*b* of the output stage and the auxiliary resonance electrode 31*b* connected to the resonance electrode 30*b* and the assembly of the output coupling electrode 40*b* and the auxiliary output coupling electrode 41*b* connected to the output coupling electrode 40*b* are generally not only broad-side coupled but also coupled with each other in the inter-digital type, the coupling becomes very strong. Therefore, the increase of insertion loss at frequencies located between resonance frequencies in each resonance mode may be further decreased, and this realizes a bandpass filter having a flat and low-loss transmission characteristic over the entire region of the broad pass band.

In addition, the width of each of the auxiliary input coupling electrode 41*a* and the auxiliary output coupling electrode 41*b* is set, for example, to be substantially equal to that of each of the input coupling electrode 40*a* and the output coupling electrode 40*b*, and the length of each of the auxiliary input coupling electrode 41*a* and the auxiliary output coupling electrode 41*b* is set, for example, to be slightly longer than that of each of the auxiliary resonance electrode 31*a* and the auxiliary resonance electrode 31*b*. It might be preferable that the interval between the auxiliary input coupling electrode 41*a* and the auxiliary output coupling electrode 41*b* and the interval between the auxiliary resonance electrode 31*a* and the auxiliary resonance electrode 31*b* are narrower since the coupling becomes stronger as the interval becomes narrower, however, this may cause it difficult to manufacture them. For example, the interval is set, for example, on the order of 0.01 to 0.5 mm.

By doing so, a high-capacity bandpass filter may be achieved according to the first embodiment, which is very appropriate as a filter for UWB and has a flat and low-loss transmission characteristic over the entire region of the very broad pass band that corresponds to 40% by the relative bandwidth well in excess of the region that may be realized by the conventional filter using the ¼ wavelength resonator.

Second Embodiment

Figure 5:
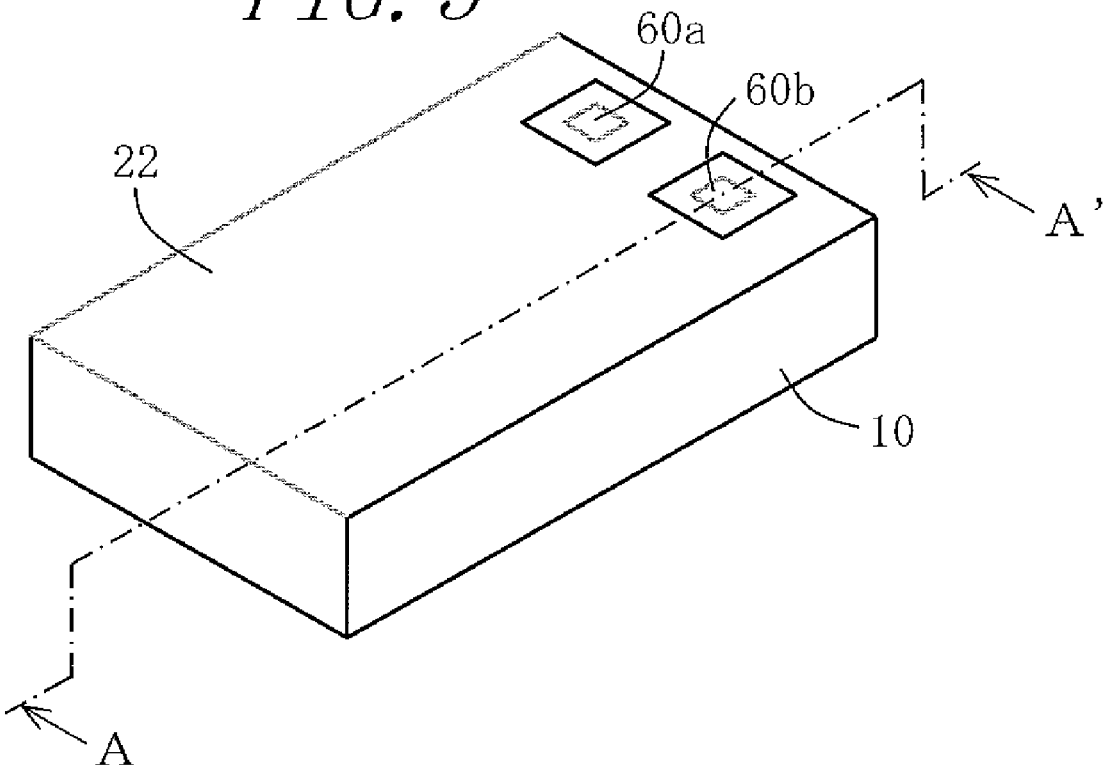
FIG. 5 is a perspective view schematically illustrating the external appearance of a bandpass filter according to a second embodiment of the present invention.
Figure 6:
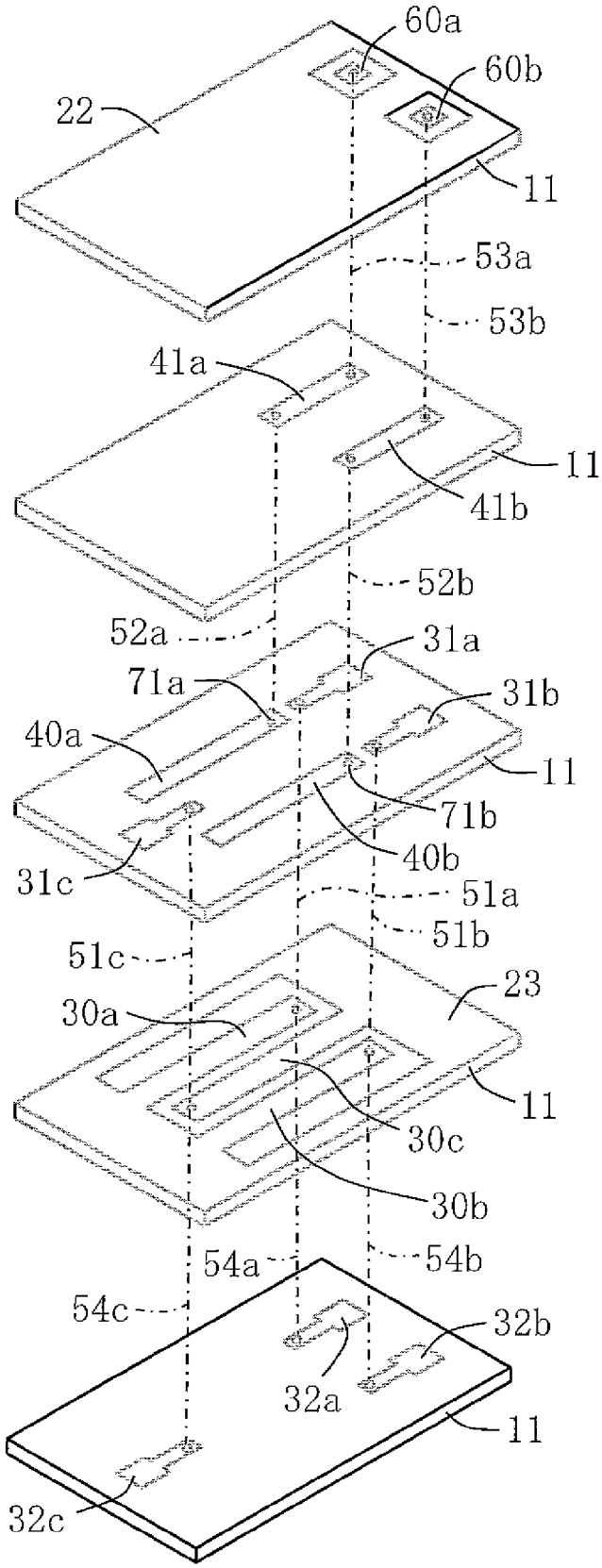
FIG. 6 is an exploded perspective view schematically illustrating the bandpass filter shown in FIG. 5.
Figure 7A:
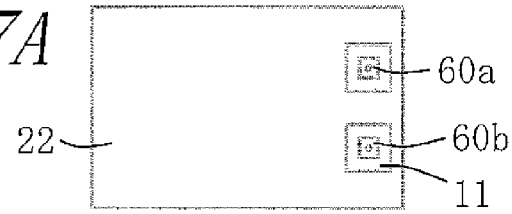
FIG. 7A to FIG. 7F are plan views schematically illustrating an upper surface, a lower surface, and interlayer portions of the bandpass filter shown in FIG. 5.
Figure 7B:
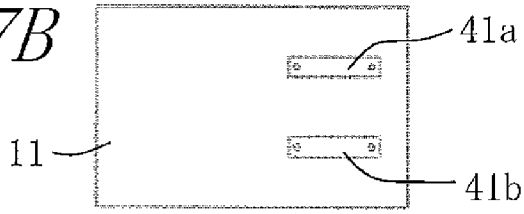
Figure 7C:
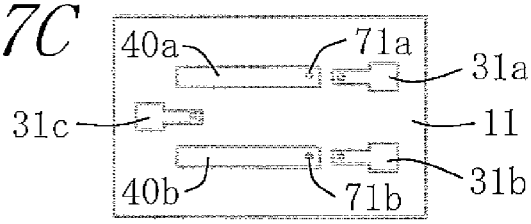
Figure 7D:
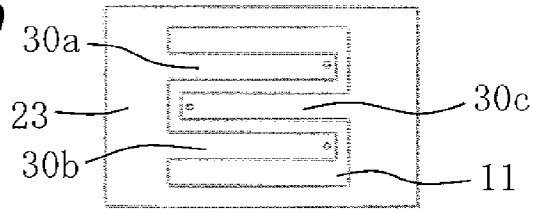
Figure 7E:
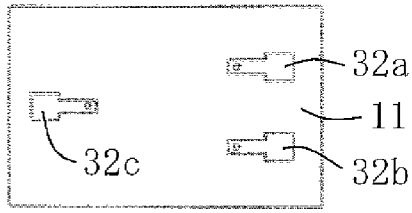
Figure 7F:
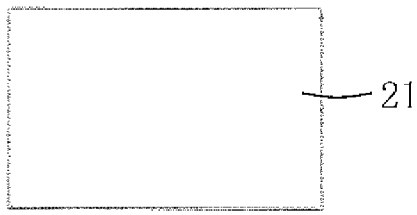
Figure 8:
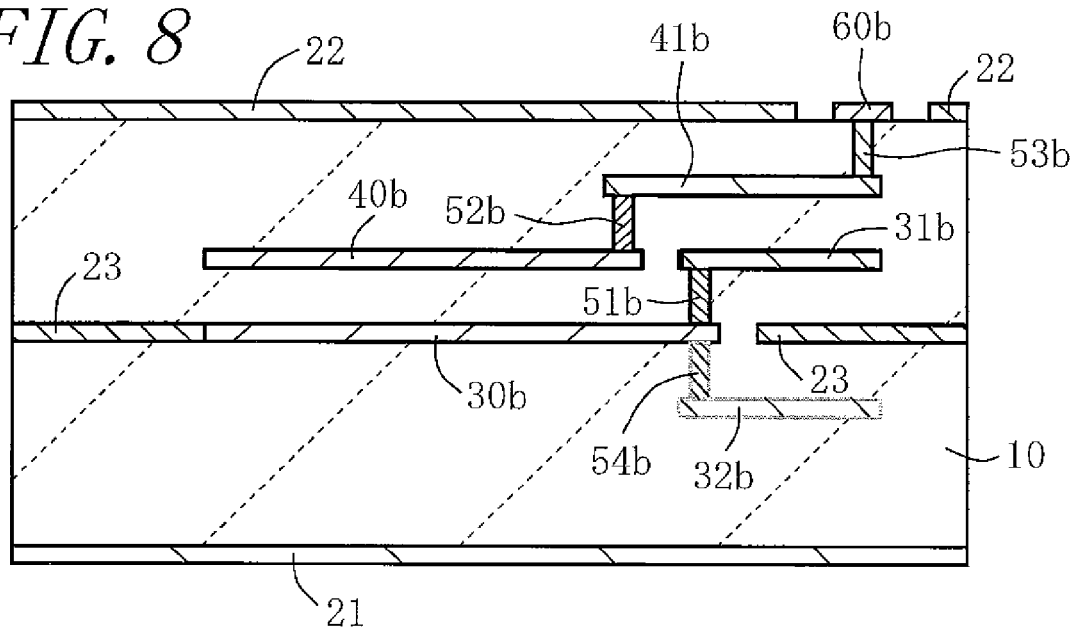
FIG. 8 is a cross sectional view taken along the line A-A' shown in FIG. 5.

FIG. 5 is a perspective view schematically illustrating the external appearance of a bandpass filter according to a second embodiment of the present invention. FIG. 6 is an exploded perspective view schematically illustrating the bandpass filter shown in FIG. 5. FIG. 7A to FIG. 7F are plan views schematically illustrating the top and bottom surfaces and inter-layer portions of the bandpass filter shown in FIG. 5. FIG. 8 is a cross sectional view taken along the line A-A' of FIG. 5. Further, the following descriptions focus on only the differences from the first embodiments, wherein the same reference numerals refer to the same constitutional elements, and therefore, the repetitive descriptions will be omitted.

The bandpass filter according to the second embodiment has a characteristic of further including second auxiliary resonance electrodes 32*a*, 32*b*, and 32*c*. The second auxiliary resonance electrodes 32*a*, 32*b*, and 32*c* are arranged on the inter-layer portion D which is located at the opposite side of the inter-layer portion B on which the auxiliary resonance electrode 31*a*, 31*b*, and 31*c* are arranged with respect to the inter-layer portion A on which the resonance electrodes 30*a*, 30*b*, and 30*c* and the annular ground electrode 23 are arranged. The second auxiliary resonance electrodes 32*a*, 32*b*, and 32*c*, respectively, have regions facing the resonance electrodes 30*a*, 30*b*, and 30*c*, respectively, and a region facing the annular ground electrode 23, wherein the regions facing the resonance electrodes 30*a*, 30*b*, and 30*c*, respectively, are connected to the other ends (open ends) of the resonance electrodes 30*a*, 30*b*, and 30*c*, respectively, by the fourth penetration conductors 54*a*, 54*b*, and 54*c*, respectively, that pass through the dielectric layer 11 located between the second auxiliary resonance electrodes 32*a*, 32*b*, and 32*c* and the resonance electrodes 30*a*, 30*b*, and 30*c*.

By doing so, the capacitance generated between the second auxiliary resonance electrodes 32*a*, 32*b*, and 32*c* and the annular ground electrode 23 is added to the capacitance generated between the auxiliary resonance electrodes 31*a*, 31*b*, and 31*c* and the annular ground electrode 23, and therefore, the capacitance between the open ends of the resonance electrodes 30*a*, 30*b*, and 30*c* and the ground potential is further increased, and this may further shorten the length of the resonance electrodes 30*a*, 30*b*, and 30*c*, thus enabling a smaller-size bandpass filter. Further, the planar shape of each of the auxiliary resonance electrode 31*a*, 31*b*, and 31*c* and each of the second auxiliary resonance electrode 32*a*, 32*b*, and 32*c*, may be made small in comparison with the bandpass filter according to the first embodiment as described above in a case where there is no increase of the capacitance between the open end of each of the resonance electrode 30*a*, 30*b*, and 30*c* and the ground potential, and therefore, further size-decreased bandpass filter may be achieved. The area of the portion of each of the second auxiliary resonance electrodes 32*a*, 32*b*, and 32*c* facing the annular ground electrode 23 is set, for example, on the order of 0.01 to 3 $mm^2$ in consideration of a balance between the necessary size and obtainable capacitance. Larger capacitance may be generated as the interval between the portions of the second auxiliary resonance electrode 32*a*, 32*b*, and 32*c* facing the annular ground electrode 23 becomes narrower, however, this causes it to be difficult to manufacture them. For example, the interval is set, for example, on the order of 0.01 to 0.5 mm.

As such, a further size-reduced bandpass filter may be achieved in comparison with the bandpass filter according to the first embodiment described above, according to the second embodiment.

Third Embodiment

Figure 9:
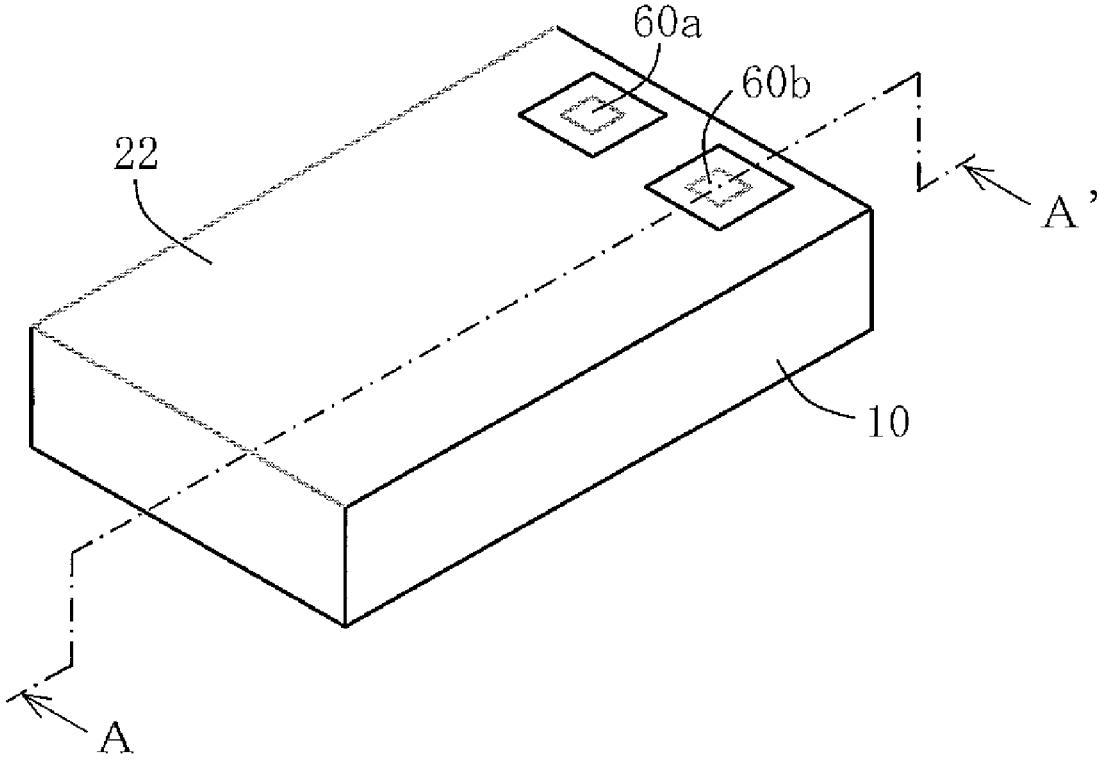
FIG. 9 is a perspective view schematically illustrating the external appearance of a bandpass filter according to a third embodiment of the present invention.
Figure 10:
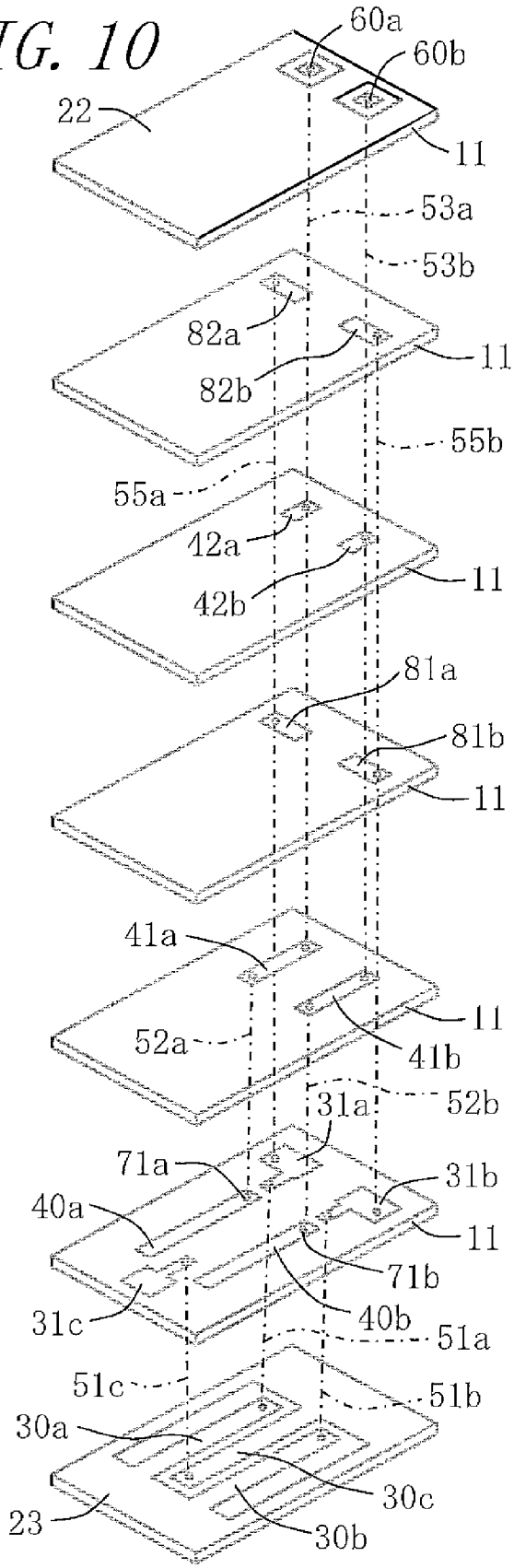
FIG. 10 is an exploded perspective view schematically illustrating the bandpass filter shown in FIG. 9.
Figure 11A:
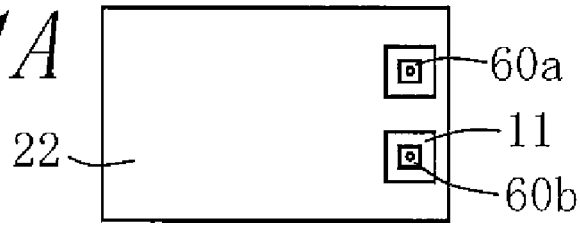
FIG. 11A to FIG. 11H are plan views schematically illustrating an upper surface, a lower surface, and inter-layer portions of the bandpass filter shown in FIG. 9.
Figure 11B:
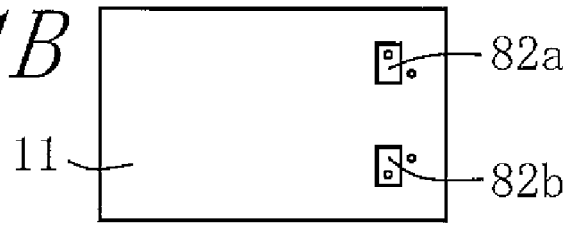
Figure 11C:
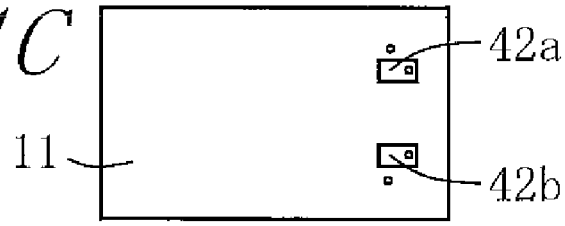
Figure 11D:
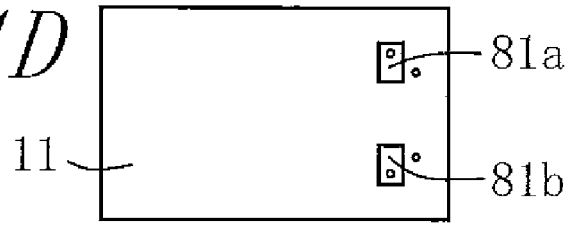
Figure 11E:
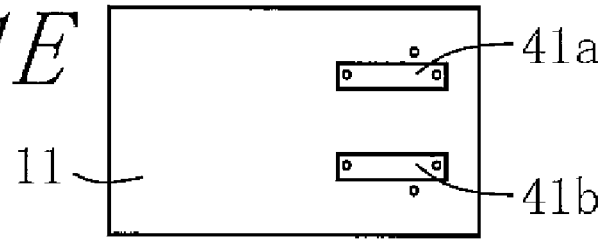
Figure 11F:
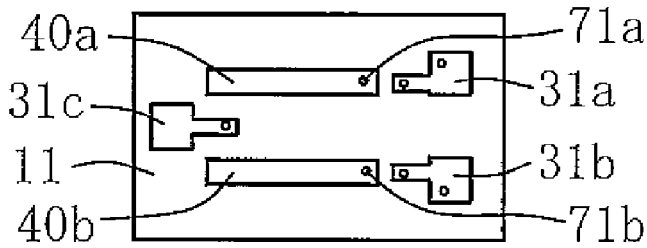
Figure 11G:
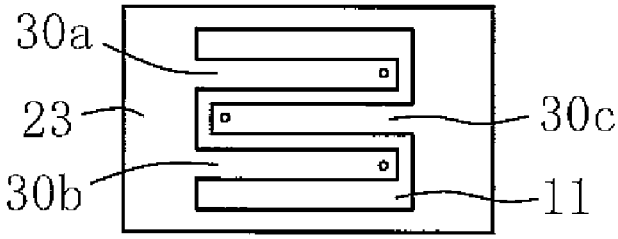
Figure 11H:
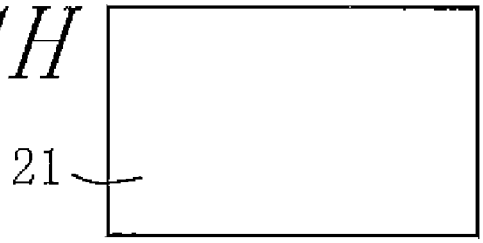
Figure 12:
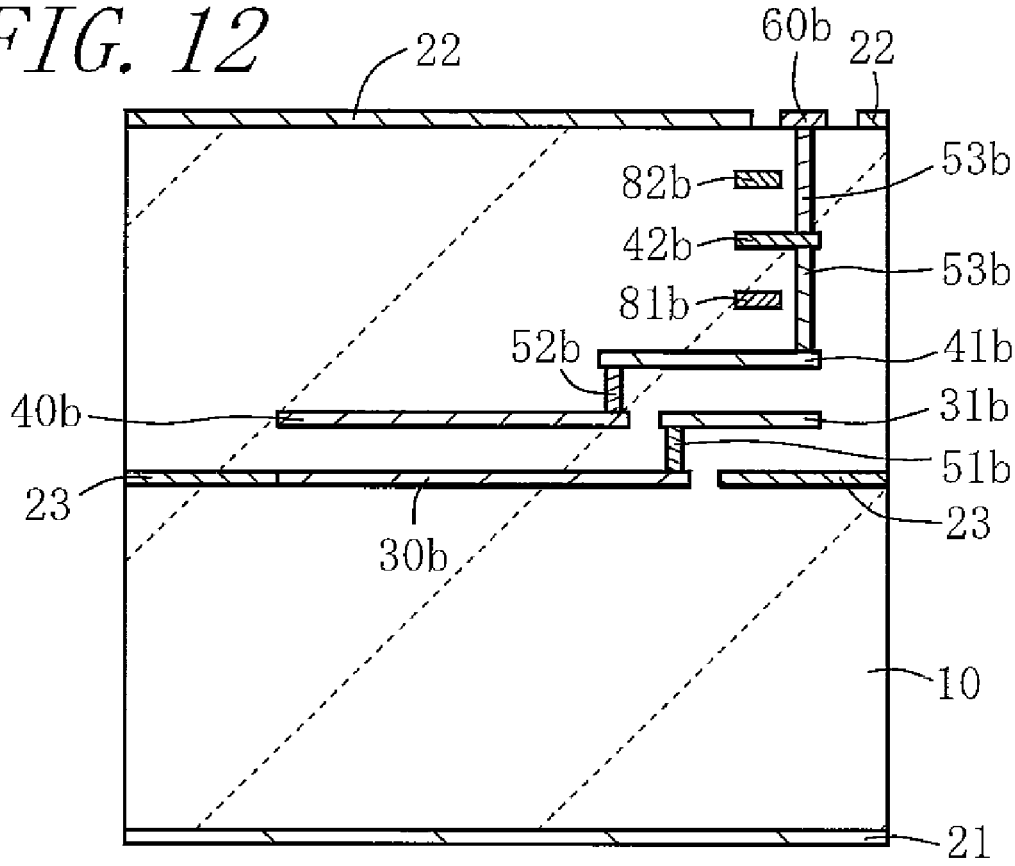
FIG. 12 is a cross sectional view taken along the line A-A' shown in FIG. 9.

FIG. 9 is a perspective view schematically illustrating the external appearance of a bandpass filter according to a third embodiment of the present invention. FIG. 10 is an exploded perspective view schematically illustrating the bandpass filter shown in FIG. 9. FIG. 11A to FIG. 11H are plan views schematically illustrating the top and bottom surfaces and inter-layer portions of the bandpass filter shown in FIG. 9. FIG. 12 is across sectional view taken along the line A-A' of FIG. 9. Further, the following descriptions focus on only the differences from the first embodiments, wherein the same reference numerals refer to the same constitutional elements, and therefore, the repetitive descriptions will be omitted.

The bandpass filter according to the third embodiment has a characteristic in that a first input coupling reinforcement electrode 81*a*, a part of which faces the auxiliary input coupling electrode 41*a*, and a first output coupling reinforcement electrode 81*b*, a part of which faces the auxiliary output coupling electrode 41*b*, are arranged on the inter-layer portion E of the laminate 10 which is located at the opposite side of the inter-layer portion B on which the input coupling electrode 40*a*, the output coupling electrode 40*b*, and the auxiliary resonance electrode 31*a*, 31*b*, and 31*c* are arranged with respect to the inter-layer portion C on which the auxiliary input coupling electrode 41*a* and the auxiliary output coupling electrode 41*b* are arranged; a second auxiliary input coupling electrode 42*a*, a part of which faces the first input coupling reinforcement electrode 81*a*, and a second auxiliary output coupling electrode 42*b*, a part of which faces the first output coupling reinforcement electrode 81*b*, are arranged on the inter-layer portion F of the laminate 10 located at the opposite side of the inter-layer portion C on which the auxiliary input coupling electrode 41*a* and the auxiliary output coupling electrode 41*b* are arranged, with respect to the inter-layer portion E on which the first input coupling reinforcement electrode 81*a* and the first output coupling reinforcement electrode 81*b* are arranged; and a second input coupling reinforcement electrode 82*a*, a part of which faces the second auxiliary input coupling electrode 42*a*, and a second output coupling reinforcement electrode 82*b*, a part of which faces the second auxiliary output coupling electrode 42*h*, are arranged on the inter layer portion C of the laminate 10 located at the opposite side of the inter-layer portion E on which the first input coupling reinforcement electrode 81*a* and the first output coupling reinforcement electrode 81*b* are arranged with respect to the inter-layer portion F on which the second auxiliary input coupling electrode 42*a* and the second auxiliary output coupling electrode 42*b* are arranged.

Further, the second auxiliary input coupling electrode 42*a* is connected to the third penetration conductor 53*a* that connects the auxiliary input coupling electrode 41*a* and the input terminal electrode 60*a* to each other, and the second auxiliary output coupling electrode 42*b* is connected to the third penetration conductor 53*b* that connects the auxiliary output coupling electrode 41*b* and the output terminal electrode 60*b* to each other. The first input coupling reinforcement electrode 81*a* and the second input coupling reinforcement electrode 82*a* are connected to the auxiliary resonance electrode 31*a* that is connected to the resonance electrode 30*a* of the input stage by the fifth penetration conductor 55*a*, and the first output coupling reinforcement electrode 81*b* and the second output coupling reinforcement electrode 82*b* are connected to the auxiliary resonance electrode 31*b* that is connected to the resonance electrode 30*b* of the output stage by the fifth penetration conductor 55*b*.

In the bandpass filter according to the third embodiment configured as above, the coupling of the first input coupling reinforcement electrode 81*a* and the second input coupling reinforcement electrode 82*a*, and the coupling of the auxiliary input coupling electrode 41*a* and the second auxiliary input coupling electrode 42*a* are added to the coupling of the input coupling electrode 40*a* and the auxiliary input coupling electrode 41*a*, and the coupling of the resonance electrode 30*a* of the input stage and the auxiliary resonance electrode 31*a* connected to the resonance electrode 30*a*, respectively, and this makes the coupling stronger. Similarly, the coupling of the first output coupling reinforcement electrode 81*b* and the second output coupling reinforcement electrode 82*b*, and coupling of the auxiliary output coupling electrode 41*b* and the second auxiliary output coupling electrode 42*b* are added to the coupling of the output coupling electrode 40*b* and the auxiliary output coupling electrode 41*b*, and the coupling of the resonance electrode 30*b* of the output stage and the auxiliary resonance electrode 31*b* connected to the resonance electrode 30*b*, respectively, and this makes the coupling stronger. By doing this, increase in insertion loss is further reduced at frequencies located between resonance frequencies in each resonance mode even in a very broad pass bandwidth, and therefore, a bandpass filter may be achieved, which has a flat and low-loss transmission characteristic over the entire region of the very broad pass band.

Fourth Embodiment

Figure 13:
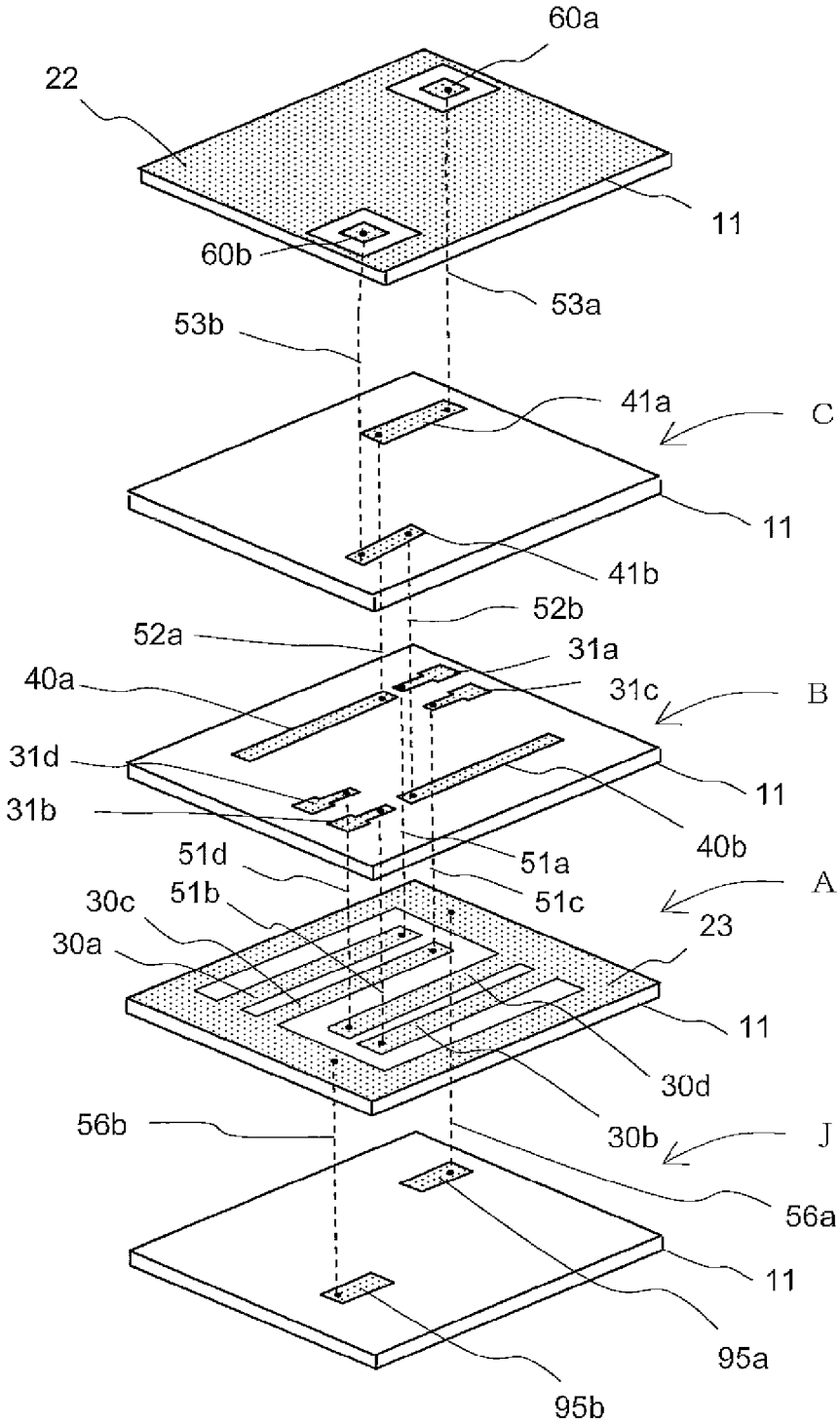
FIG. 13 is an exploded perspective view schematically illustrating a bandpass filter according to fourth embodiment of the present invention.

FIG. 13 is an exploded perspective view schematically illustrating a bandpass filter according to fourth embodiment of the present invention. Further, the following descriptions focus on only the differences from the first embodiment, wherein the same reference numerals refer to the same constitutional elements, and therefore, repetitive descriptions will be omitted.

In the bandpass filter according to this embodiment, four strip-shaped resonance electrodes 30*a*, 30*b*, 30*c*, and 30*d* are arranged on an inter-layer portion A of the laminate 10 in parallel with each other as shown in FIG. 13, wherein the resonance electrodes 30*a* and 30*c* are arranged so that the ground end of each resonance electrode is located at the same side, the resonance electrodes 30*c* and 30*d* are arranged so that the ground ends of the resonance electrodes are opposite with each other, and the resonance electrodes 30*d* and 30*b* are arranged so that the ground end of each resonance electrode is located at the same side. Accordingly, the resonance electrodes 30*a* and 30*c* are coupled with each other in a comb-line type, the resonance electrodes 30*c* and 30*d* are coupled with each other in an inter-digital type, and the resonance electrodes 30*d* and 30*b* are coupled with each other in a comb-line type.

In the bandpass filter according to this embodiment, further, auxiliary resonance electrodes 31*a*, 31*b*, 31*c*, and 31*d* are arranged on the inter-layer portion B of the laminate 10. The auxiliary resonance electrodes 31*a*, 31*b*, 31*c*, and 31*d* are arranged to face the annular ground electrode 23 and connected to the resonance electrodes 30*a*, 30*b*, 30*c*, and 30*d* by the first penetration conductors 51*a*, 51*b*, 51*c*, and 51*d* that penetrate the dielectric layer 11, respectively.

In the bandpass filter according to this embodiment, further, a first coupling electrode 95*a* is arranged on an inter-layer portion located under the inter-layer portion A of the laminate 10, which is arranged to face the other end (open end) of each of the resonance electrodes 30*a* and 30*c* and is connected to the annular ground electrode 23 through a sixth penetration conductor 56*a*. Further, a second coupling electrode 95*b* connected to the annular ground electrode 23 through a sixth penetration conductor 56*b* is arranged on the inter-layer portion J so as to face the other end (open end) of each of the resonance electrodes 30*d* and 30*b*.

In the bandpass filter according to the embodiment, the first coupling electrode 95*a* increases the capacitance between each of the resonance electrodes 30*a* and 30*c* and the ground potential, and the second coupling electrode 95*b* increases the capacitance between each of the resonance electrodes 30*d* and 30*b* and the ground potential. Therefore, the length of the resonance electrodes 30*a*, 30*b*, 30*c*, and 30*d* and the auxiliary resonance electrodes 31*a*, 31*b*, 31*c*, and 31*d* can be reduced, thus a small-size bandpass filter can be obtained.

Further, the bandpass filter according to the present embodiment may strengthen the electromagnetic coupling between adjacent resonance electrodes 30*a* and 30*c* by the first coupling electrode 95*a* and the electromagnetic coupling between adjacent resonance electrodes 30*d* and 30*b* by the second coupling electrode 95*b*. Accordingly, it may be possible to achieve a bandpass filter having a broad pass band like in a case where the overall resonance electrodes 30*a*, 30*b*, 30*c*, and 30*d* are electromagnetically coupled with each other in an inter-digital type.

Besides the form shown in FIG. 13 the entire resonance electrodes 30*a*, 30*b*, 30*c*, and 30*d* may be electromagnetically coupled with each other in a comb-line type by arranging the entire resonance electrodes 30*a*, 30*b*, 30*c*, and 30*d* so that one end thereof is located at the same side (not shown). In the comb-line type coupling, it is preferred to enable an electromagnetic coupling having necessary strength to be made, for example, by making the interval between the resonance electrodes narrower than in the inter-digital type coupling.

Fifth Embodiment

Figure 14:
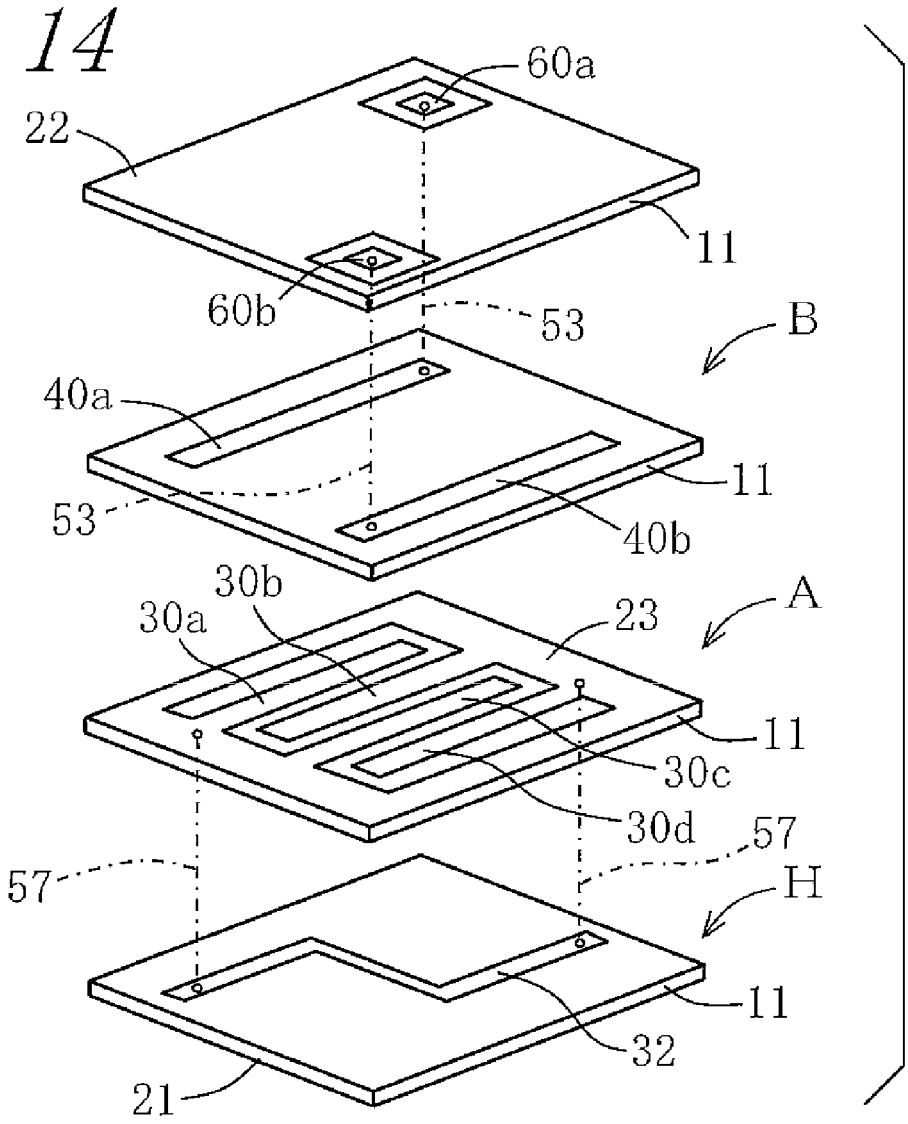
FIG. 14 is an exploded perspective view schematically illustrating the external appearance of a bandpass filter according to a fifth embodiment of the present invention.

FIG. 14 is an exploded perspective view schematically illustrating a bandpass filter according to a fifth embodiment of the present invention. Further, the following descriptions focus on only the differences from the first embodiment, wherein the same reference numerals refer to the same constitutional elements, and therefore, repetitive descriptions will be omitted.

The bandpass filter according to the fifth embodiment includes a laminate which is formed by stacking a plurality of dielectric layers 11; a first ground electrode 21 arranged on the bottom surface of the laminate; a second ground electrode 22 arranged on the top surface of the laminate; strip-shaped resonance electrodes 30*a*, 30*b*, and 30*c* (hereinafter, sometimes referred to as 'first resonance electrode') that are arranged on an inter-layer portion A of the laminate in parallel with each other; an annular ground electrode 23 shaped as a ring on the inter-layer portion A of the laminate to surround the peripheries of the resonance electrodes 30*a*, 30*b*, and 30*c*, wherein one end (ground end) of each of the resonance electrodes 30*a*, 30*b*, and 30*c* is connected to the annular ground electrode 23; a strip-shaped input coupling electrode 40*a* arranged on an inter-layer portion B located over the inter-layer portion A of the laminate to face the resonance electrode 30*a* of the input stage; a strip-shaped output coupling electrode 40*b* arranged to face the resonance electrode 30*d* of the output stage; a resonance electrode coupling conductor 32 that is arranged on an inter-layer portion H located under the inter-layer portion A of the laminate and has a region facing each of the resonance electrodes so that one end and the other end thereof are connected to the annular ground electrode 23 through the seventh penetration conductor 57 and electromagnetically coupled with the resonance electrode 30*a* of the input stage and the resonance electrode 30*d* of the output stage in a nearly uniform manner; an input terminal electrode 60*a* arranged on the top surface of the laminate to be connected to the input coupling electrode 40*a*; and an output terminal electrode 60*b* connected to the output coupling electrode 40*b*.

Although not being shown, the first ground electrode 21 is arranged on the entire surface of the bottom surface of the laminate (the opposite surface of the surface of the dielectric layer 11 on which the resonance electrode coupling conductor 32 is arranged), and the second ground electrode 22 is arranged on the nearly entire surface of the surface of the laminate except for the peripheries of the input terminal electrode 60*a* and the output stage electrode 60*b*, and therefore, the first ground electrode 21 and the second ground electrode 22 are connected to the ground potential, thus constituting a strip line resonator together with the resonance electrodes 30*a*, 30*b*, 30*c*, and 30*d*.

Since the strip-shaped resonance electrodes 30*a*, 30*b*, 30*c*, and 30*d* constitute a strip line resonator together with the first ground electrode 21 and the second ground electrode 22, and one end of each of the resonance electrode 30*a*, 30*b*, 30*c*, and 30*d* is connected to the annular ground electrode 23, thus to the ground potential, the strip line resonator functions as a ¼ wavelength resonator.

Further, the resonance electrodes 30*a*, 30*b*, 30*c*, and 30*d* are arranged on the inter-layer portion A of the laminate in parallel with each other to be electromagnetically coupled (edge-coupled) with each other. As the interval between the resonance electrodes 30*a*, 30*b*, 30*c*, and 30*d* is smaller, a stronger coupling may be achieved, however, this causes it difficult to manufacture them. Therefore, the interval is set, for example, on the order of 0.05 to 0.5 mm. Besides, the resonance electrode 30*a*, 30*b*, 30*c*, and 30*d* are formed so that one end (ground end) of each of the resonance electrodes is alternately arranged to the other end (open end) of its adjacent resonance electrode, i.e. arranged in an inter-digital type, and therefore, a coupling by electric fields and a coupling by magnetic fields are added to each other, and this makes the coupling stronger than when they are coupled in a comb-line form. As such, since the resonance electrodes 30*a*, 30*b*, 30*c*, and 30*d* are not only edge-coupled but also coupled with each other in the inter-digital type, the frequency interval between resonance frequencies in each resonance mode is adapted to be suitable for achieving a broad pass band width on the order of 30% by the relative bandwidth which is well in excess of the region that could be achieved by the conventional filter using the ¼ wavelength resonator and is very appropriate as a bandpass filter for UWB.

The inventor found that it may not be preferable in achieving a pass band width on the order of 30% by the relative bandwidth not only to broad-side couple but also to couple the resonance electrodes 30*a*, 30*b*, 30*c*, and 30*d* in the inter-digital type because the coupling becomes too strong.

Even though four resonance electrodes have been provided in this embodiment shown in FIG. 14, four or more resonance electrodes may be provided for the present invention and the number of the resonance electrodes does not matter as long as the losses are not increased. For example, six resonance electrodes may be provided for the present invention, which will be described later.

The annular ground electrode 23 is arranged in the shape of a ring on the inter-layer portion A of the laminate to surround the peripheries of the resonance electrodes 30*a*, 30*b*, 30*c*, and 30*d*, wherein the annular ground electrode 23 is connected to one end (ground end) of each of the resonance electrodes 30*a*, 30*b*, 30*c*, and 30*d*. Since the annular ground electrode 23 itself is connected to the ground potential, the annular ground electrode 23 allows the one end of each of the resonance electrodes 30*a*, 30*b*, 30*c*, and 30*d* to be connected to the ground potential. The one end of each of the resonance electrodes 30*a*, 30*b*, 30*c*, and 30*d* is not directly connected to the first ground electrode 21 and the second ground electrode 22 with penetration conductors, but the one end of each of the resonance electrodes 30*a*, 30*b*, 30*c*, and 30*d* arranged in the inter-digital type may be easily connected to the ground potential by the annular ground electrode 23 even though the bandpass filter is formed at a portion in the module substrate. Further, the annular ground electrode 23 surrounds the peripheries of the resonance electrodes 30*a*, 30*b*, 30*c*, and 30*d*, and this may reduce leakage of electromagnetic waves emitted from the resonance electrodes 30*a*, 30*b*, 30*c*, and 30*d* to the surroundings. This effect is particularly advantageous in preventing the other portions of the module substrate from being negatively affected in a case where the bandpass filter is formed in a portion of the module substrate.

The strip-shaped input coupling electrode 40*a* is arranged on the inter-layer portion B different from the inter-layer portion A on which the resonance electrodes 30*a*, 30*b*, 30*c*, and 30*d* are arranged (the inter-layer portion located above the inter-layer portion A on which the resonance electrodes 30*a*, 30*b*, 30*c*, and 30*d* are arranged) so that its entirety faces the resonance electrode 30*a* of the input stage, and therefore, is adapted to face the resonance electrode 30*a* of the input stage over more than half of the length of the resonance electrode 30*a* of the input stage. Accordingly, the input coupling electrode 40*a* and the resonance electrode 30*a* of the input stage are broad-side coupled with each other, and this makes the coupling stronger compared to when they are edge-coupled. Further, the contact point of the strip-shaped input coupling electrode 40*a* and the third penetration conductor 53 is located at an end of the input coupling electrode 40*a*, which is near the other end of the resonance electrode 30*a* of the input stage rather than the center of the input coupling electrode 40*a* in the longitudinal direction, and therefore, and the other end of the input coupling electrode 40*a* is the open end. An electrical signal inputted from an external circuit is supplied through the contact point to the input coupling electrode 40*a*. By doing so, the input coupling electrode 40*a* and the resonance electrode 30*a* are coupled with each other in the inter-digital type, and therefore, a coupling by magnetic fields and a coupling by electric fields are added to each other, and this makes the coupling stronger than when they are coupled in the comb-line type alone or capacitively coupled alone. As such, since the input coupling electrode 40*a* is broad-side coupled in its entirety with the resonance electrode 30*a* of the input stage, and coupled in the inter-digital type as well, the input coupling electrode 40*a* becomes coupled with the resonance electrode 30*a* of the input stage very strongly. Further, this principle is also true for output.

As such, since the input coupling electrode 40*a* and the resonance electrode 30*a* of the input stage are coupled with each other very strongly and the output coupling electrode 40*b* and the resonance electrode 30*b* of the output stage are coupled with each other very strongly, a bandpass filter may be obtained, whose insertion loss is not greatly increased at frequencies located between resonance frequencies in each resonance mode even in the broad pass band width well in excess of the region that may be achieved by the conventional filter using the ¼ wavelength resonator, and which has a flat and low-loss transmission characteristic over the entire region of the broad pass band.

The resonance electrode coupling conductor 32 is arranged on the inter-layer portion H different from the inter-layer portion A on which the resonance electrodes 30*a*, 30*b*, 30*c*, and 30*d* are arranged (the inter-layer portion located under the inter-layer portion A on which the resonance electrodes 30*a*, 30*b*, 30*c*, and 30*d* are arranged). One end of the resonance electrode coupling conductor 32 is connected to the ground potential (annular ground electrode 23) near one end (ground end) of the resonance electrode 30*a* of the input stage through the seventh penetration conductor 57, and the other end of the resonance electrode coupling conductor 32 is connected to the ground potential (annular ground electrode 23) near one end (ground end) of the resonance electrode 30*d* of the output stage through the seventh penetration conductor 57, and therefore, the resonance electrode coupling conductor 32 has a region facing each resonance electrode to be electromagnetically coupled with the resonance electrode 30*a* of the input stage and the resonance electrode 30*d* of the output stage in a nearly uniform manner.

In the embodiment shown in FIG. 14, the resonance electrode coupling conductor 32 includes an input stage coupling region that faces the resonance electrode 30*a* of the input stage, an output stage coupling region that faces the resonance electrode 30*d* of the output stage, and a connection region that connects the input stage coupling region and the output stage coupling region perpendicularly to the input stage coupling region and the output stage coupling region. That is, the resonance electrode coupling conductor 32 is formed in a so-called "crank structure". In this structure, one portion which is near one end (ground end) of the resonance electrode 30*a* of the input stage and one portion which is near one end (ground end) of the resonance electrode 30*d* of the output stage are adapted to be coupled with each other. Here, the resonance electrode coupling conductor 32 is preferably formed to be point-symmetrical with respect to a point which is far away at the same distance from one end and the other end of the resonance electrode coupling conductor 32 from the point of view of filter design, and particularly, the shape shown in FIG. 14 is most preferred, however, any shapes may be available as long as they are adapted to be point-symmetrical.

In the resonance electrode coupling conductor 32 whose one end is connected to the annular ground electrode 23 near the one end (ground end) of the resonance electrode 30*a* of the input stage and the other end is connected to the annular ground electrode 23 near the one end (ground end) of the resonance electrode 30*d* of the output stage, a portion near one end (ground end) of the resonance electrode 30*a* of the input stage and a portion near one end (ground end) of the resonance electrode 30*d* of the output stage are coupled with each other, so that the resonance electrode of the input stage and the resonance electrode of the output stage end up to be inductively coupled with each other. In the meanwhile, a capacitive coupling is achieved between the resonance electrodes which are neighbored to each other (between 30*a* and 30*b*, between 30*b* and 30*c*, and between 30*c* and 30*d*). This structure constitutes a so-called elliptic function filter. Accordingly, it can be possible to form one attenuation pole at the lower band side and one attenuation pole at the higher band side than the pass band. By doing so, there may be achieved a filter characteristic of being abruptly attenuated at the bands other than the pass band.

In addition, a four-stage resonator, as an example of the elliptic function filter, may form attenuation poles at the lower band side and the higher band side than the pass band as long as the four-stage resonator has the following relationship: the coupling between the first-stage resonator and the second-stage resonator is positive (+), the coupling between the second-stage resonator and the third-stage resonator is positive (+), the coupling between the third-stage resonator and the fourth-stage resonator is positive (+), and the coupling between the first-stage resonator and the fourth-stage resonator is negative (−).

By doing so, a high-capacity bandpass filter may be achieved according to the fifth embodiment, which has a flat and low-loss transmission characteristic over the entire region of the very broad pass band which reaches 30% by the relative bandwidth that is well in excess of the region that may be realized by the conventional filter using the conventional ¼ wavelength resonator, has attenuation poles at the lower band side and higher band side than the pass band is very appropriate as a filter for UWB.

Sixth Embodiment

Figure 15:
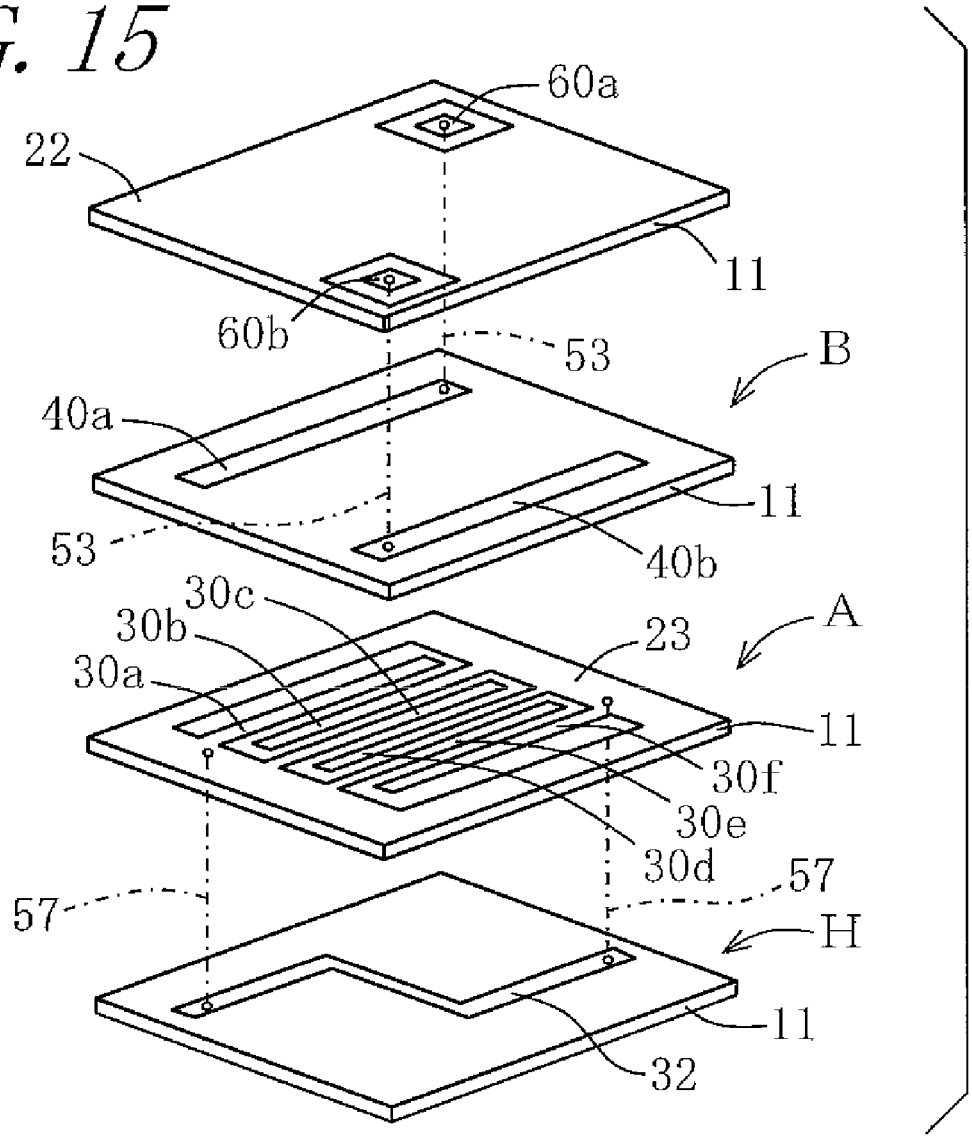
FIG. 15 is an exploded perspective view schematically illustrating the external appearance of a bandpass filter according to a sixth embodiment of the present invention.

FIG. 15 is an exploded perspective view schematically illustrating a bandpass filter according to a sixth embodiment of the present invention. The only difference in the structure from the fifth embodiment is that the resonance electrode is configured to have six stages, such as the resonance electrodes 30*a*, 30*b*, 30*c*, 30*d*, 30*e*, and 30*f*.

Even in the bandpass filter according to the sixth embodiment, there is the resonance electrode coupling conductor 32 whose one end is connected to the annular ground electrode 23 near one end (ground end) of the resonance electrode 30*a* of the input stage through the seventh penetration conductor 57 and the other end is connected to the annular ground electrode 23 near one end (ground end) of the resonance electrode 30*f* of the output stage through the seventh penetration conductor 57. Therefore, the resonance electrode coupling conductor 32 is adapted to be inductively coupled with the resonance electrode of the input stage and the resonance electrode of the output stage at a portion near one end (ground end) of the resonance electrode 30*a* of the input stage and at a portion near one end of (ground end) of the resonance electrode 30*f* of the output stage. At the same time, a capacitive coupling is made between the adjacent resonance electrodes, specifically, between 30*a* and 30*b*, between 30*b* and 30*c*, between 30*c* and 30*d*, between 30*d* and 30*e*, and between 30*e* and 30*f*). This structure constitutes a so-called pseudo elliptic function filter. Accordingly, an attenuation pole may be formed at the lower band side and an attenuation pole at the higher band side than the pass band. By doing so, there may be achieved a filter characteristic of being abruptly attenuated at the other bands than the pass band.

The pseudo elliptic function filter, for example, a six-stage resonator, may form attenuation poles at the lower band side and the higher band side than the pass band as long as it has the following relationship: the coupling between the first-stage resonator and the second-stage resonator is positive (+), the coupling between the second-stage resonator and the third-stage resonator is positive (+), the coupling between the third-resonator and the fourth-resonator is positive (+), the coupling between the fourth-stage resonator and the fifth-stage resonator is positive (+), the coupling between the fifth-stage resonator and the sixth-stage resonator is positive (+), and the coupling between the first-stage resonator and the sixth-stage resonator is negative (−). Here, "positive" corresponds to being capacitive and "negative" corresponds to being inductive.

As such, there may be achieved a bandpass filter according to the sixth embodiment, which has an attenuation characteristic of being more abruptly attenuated than the bandpass filter according to the fifth embodiment described above.

Seventh Embodiment

Figure 16:
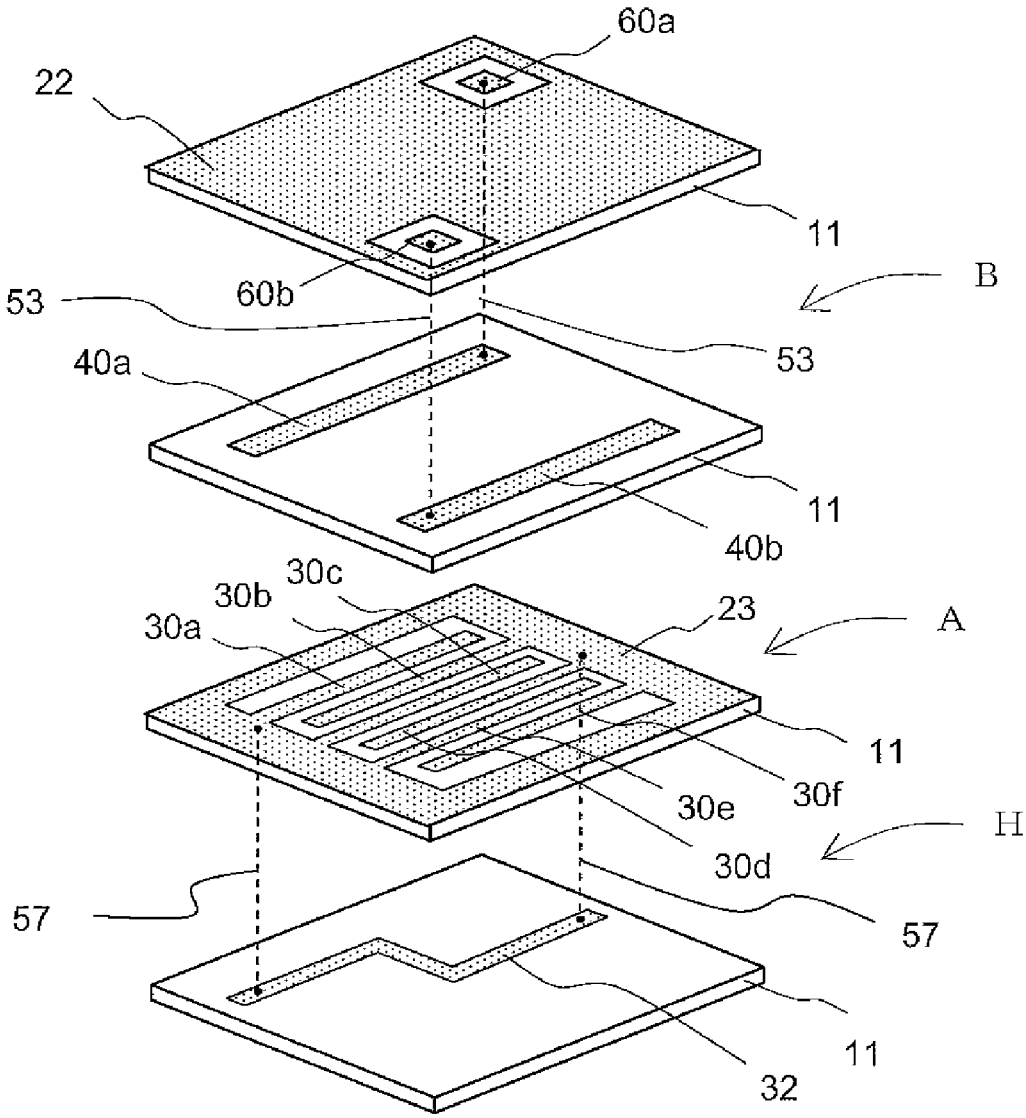
FIG. 16 is an exploded perspective view schematically illustrating the external appearance of a bandpass filter according to seventh embodiment of the present invention.

FIG. 16 is an exploded perspective view schematically illustrating the external appearance of a bandpass filter according to seventh embodiment of the present invention. Further, the following descriptions focus on only the differences from the sixth embodiment, wherein the same reference numerals refer to the same constitutional elements, and therefore, repetitive descriptions will be omitted.

In the bandpass filter according to this embodiment, a resonance electrode group is formed, which is composed of four adjacent resonance electrodes 30*a*, 30*b*, 30*c*, and 30*d* among the six resonance electrodes 30*a*, 30*b*, 30*c*, 30*d*, 30*e*, and 30*f* that are arranged on the inter-layer portion A of the laminate 10 as shown in FIG. 16. A first end of the resonance electrode coupling conductor 32 arranged on the inter-layer portion H of the laminate 10 is connected to the annular ground electrode 23 through a seventh penetration conductor 57 in the vicinity of ground end of the first resonance electrode 30*a* which is the closest to the input stage among the resonance electrode group, the first end of the resonance electrode coupling conductor 32 is grounded. A second end of the resonance electrode coupling conductor 32 is connected to the annular ground electrode 23 through a seventh penetration conductor 57 in the vicinity of ground end of the first resonance electrode 30*d* which is the farthest to the input among the resonance electrode group, the second end of the resonance electrode coupling conductor 32 is grounded. The resonance electrode coupling conductor 32 has a region that face to and electromagnetically coupled with the ground end of the first resonance electrode 30*a* and a region that face to and electromagnetically coupled with the ground end of the first resonance electrode 30*d*.

In the bandpass filter according to this embodiment configured as above, a signal transmitted by an inductive coupling through the resonance electrode coupling conductor 32 and a signal transmitted by a capacitive coupling between adjacent resonance electrodes have a phase difference of 180° from each other between the closest resonance electrode 30*a* and the farthest resonance electrode 30*d* of the resonance electrode group composed of the four adjacent resonance electrodes 30*a*, 30*b*, 30*c*, and 30*d*, and therefore, two signals may cancel each other out. Therefore, it may be possible to form attenuation poles, which cause few signals to be transmitted, near both sides of the pass band in the transmission characteristic of the bandpass filter like in the above-mentioned fifth embodiment and the bandpass filter according to the sixth embodiment.

In this embodiment, the resonance electrodes constituting the resonance electrode group need to have an even number that is equal to or more than four. For example, if the number of the resonance electrodes constituting the resonance electrode group is odd, a signal transmitted by an inductive coupling through the resonance electrode coupling conductor 32 and a signal transmitted by a capacitive coupling between adjacent resonance electrodes have a phase difference of 180° with respect to each other and thus the two signals cancel each other out, and this phenomenon occurs only at higher frequency side than the pass band of the bandpass filter even though an inductive coupling is created by the resonance electrode coupling conductor 32 between the closest resonance electrode and the farthest resonance electrode in the resonance electrode group. Therefore, it is impossible to form attenuation poles near both sides of the pass band in the transmission characteristic of the bandpass filter. Further, in a case where the number of the resonance electrodes constituting the resonance electrode group is two, there is only an LC parallel resonant circuit by an inductive coupling and a capacitive coupling between the resonance electrodes, even though the resonance electrodes are connected to each other by the resonance electrode coupling conductor 32, and thus only one attenuation pole is created and it is impossible to form attenuation poles near both ends of the pass band.

Eighth Embodiment

Figure 17:
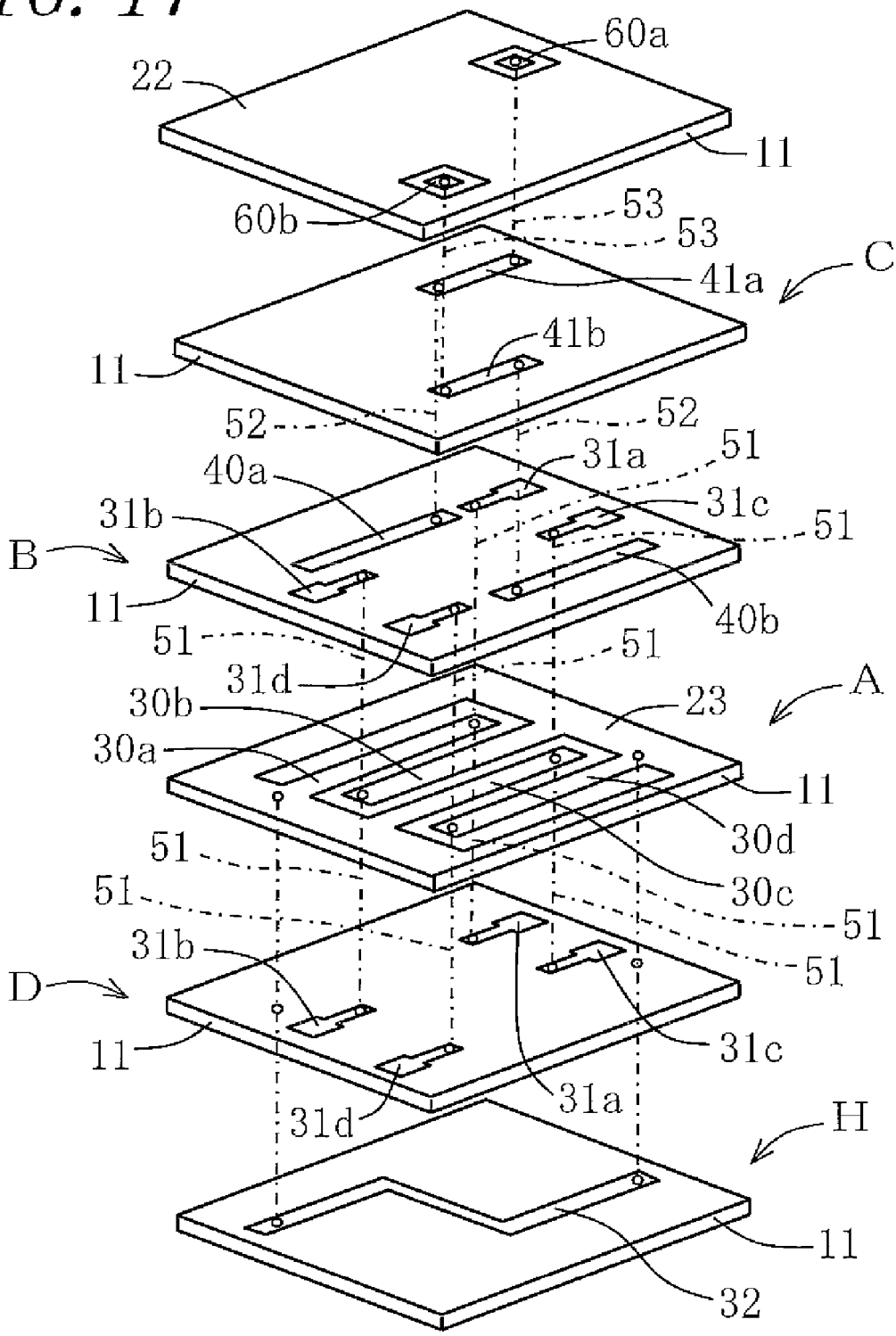
FIG. 17 is an exploded perspective view schematically illustrating the external appearance of a bandpass filter according to a eighth embodiment of the present invention.

FIG. 17 is an exploded perspective view schematically illustrating a bandpass filter according to a eighth embodiment of the present invention. The difference in structure from the fifth embodiment shown in FIG. 14 is that the auxiliary resonance electrodes 31*a*, 31*b*, 31*c*, and 31*d* are arranged on the inter-layer portion B located above the inter-layer portion A on which the resonance electrodes 30*a*, 30*b*, 30*c*, and 30*d* and the annular ground electrode 23 are arranged, each having a region facing the annular ground electrode 23 and a region facing each of the resonance electrodes 30*a*, 30*b*, 30*c*, and 30*d*, and the auxiliary resonance electrodes 31*a*, 31*b*, 31*c*, and 31*d* are arranged on the inter-layer portion D located under the inter-layer portion A on which the resonance electrodes 30*a*, 30*b*, 30*c*, and 30*d* and the annular ground electrode 23 are arranged, each having a region facing the annular ground electrode 23 and a region facing each of the resonance electrodes 30*a*, 30*b*, 30*c*, and 30*d*. The resonance electrodes 30*a*, 30*b*, 30*c*, and 30*d* and the auxiliary resonance electrodes 31*a*, 31*b*, 31*c*, and 31*d* are connected to each other through the first penetration conductors 51 that penetrate the dielectric layer 11. By doing so, the capacitance between the auxiliary resonance electrodes 31*a*, 31*b*, 31*c*, and 31*d* and the annular ground electrode 23 is added, and therefore, the capacitance between the other ends (open ends) of the resonance electrodes 30*a*, 30*b*, 30*c*, and 30*d* and the ground potential is further increased, and therefore, the length of the resonance electrodes 30*a*, 30*b*, and 30*c* may be shortened, thus enabling a smaller-size bandpass filter.

In addition, in the eighth embodiment shown in FIG. 17, each of the auxiliary resonance electrodes 31*a*, 31*b*, 31*c*, and 31*d* is provided in pair: one at the upper side and one at the lower side. In a case where it does not matter if the length of the resonance electrodes are shortened, the auxiliary resonance electrodes 31*a*, 31*b*, 31*c*, and 31*d* may be configured to be provided either above or under the inter-layer portion A on which the resonance electrodes 30*a*, 30*b*, 30*c*, and 30*d* and the annular ground electrode 23 are arranged.

Further, in addition to the formation of the auxiliary resonance electrode 31*a* through 31*d*, the auxiliary input coupling electrode 41*a* and the auxiliary output coupling electrode 41*b* are formed to correspond to the input coupling electrode 40*a* and the output coupling electrode 40*b*, respectively, on the inter-layer portion C different from the inter-layer portion A on which the resonance electrodes 30*a*, 30*b*, 30*c*, and 30*d* and the annular ground electrode 23 are arranged and the inter-layer portions B and D on which the auxiliary resonance electrodes 31*a*, 31*b*, 31*c*, and 31*d* are arranged.

As such, there may be achieved a bandpass filter according to the eighth embodiment, whose size is further reduced compared to the bandpass filter according to the fifth embodiment.

Further, the auxiliary input coupling electrode 41*a* shown in FIG. 17 is shaped as a strip and arranged to have a region facing the auxiliary resonance electrode 31*a* and a region facing the input coupling electrode 40*a*, and the region facing the input coupling electrode 40*a* is connected to the input coupling electrode 40*a* through the second penetration conductor 52 that penetrates the dielectric layer 11 located between the auxiliary input coupling electrode 41*a* and the input coupling electrode 40*a*. By doing so, the auxiliary input coupling electrode 41*a* and the auxiliary resonance electrode 31*a* are broad-side coupled with each other, and this coupling is added to a coupling between the input coupling electrode 40*a* and the resonance electrode 30*a* of the input stage, thus making the overall coupling stronger.

Similarly, the auxiliary output coupling electrode 41*b* is shaped as a strip, and arranged to have a region facing the auxiliary resonance electrode 31*d* and a region facing the output coupling electrode 40*b*, and the region facing the output coupling electrode 40*b* is connected to the output coupling electrode 40*b* through the second penetration conductor 52 that penetrates the dielectric layer 11 located between the auxiliary output coupling electrode 41*b* and the output coupling electrode 40*b*. By doing so, the auxiliary output coupling electrode 41*b* and the auxiliary resonance electrode 31*d* are broad-side coupled with each other, and this coupling is added to a coupling between the output coupling electrode 40*b* and the resonance electrode 30*d* of the output stage, thus making the overall coupling stronger.

As such, an assembly of the resonance electrode 30*a* of the input stage and the auxiliary resonance electrode 31*a* connected to the resonance electrode 30*a* and an assembly of the input coupling electrode 40*a* and the auxiliary input coupling electrode 41*a* connected to the input coupling electrode 40*a* are coupled with each other in the inter-digital type, thus making the two assemblies coupled with each other very strongly, and similarly, an assembly of the resonance electrode 30*b* of the output stage and the auxiliary resonance electrode 31*b* connected to the resonance electrode 30*b* and an assembly of the output coupling electrode 40*b* and the auxiliary output coupling electrode 41*b* connected to the output coupling electrode 40*b* are generally not only broad-side coupled but also coupled with each other in the inter digital type, thus making the two assemblies coupled with each other very strongly, and therefore, increase of insertion loss is further reduced at frequencies between resonance frequencies in each resonance mode, and this realizes a bandpass filter having a flat and low-loss transmission characteristic over the entire region of the broad pass band.

Ninth Embodiment

Figure 18:
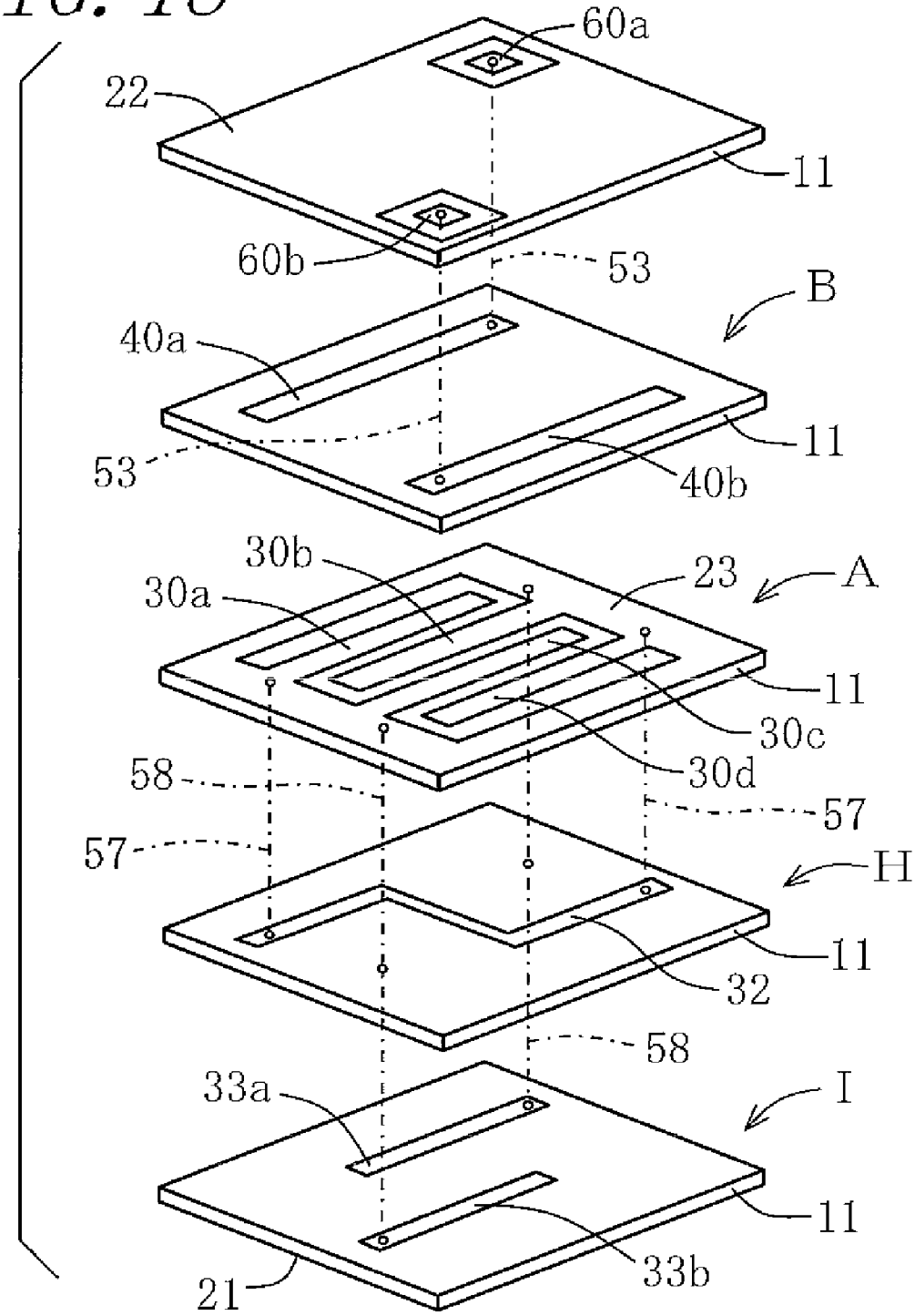
FIG. 18 is an exploded perspective view schematically illustrating the external appearance of a bandpass filter according to a ninth embodiment of the present invention.

FIG. 18 is an exploded perspective view schematically illustrating a bandpass filter according to a ninth embodiment of the present invention. Further, the following descriptions focus on only the differences from the fifth embodiment, wherein the same reference numerals refer to the same constitutional elements, and therefore, repetitive descriptions will be omitted. The bandpass filter according to the ninth embodiment is similar to the bandpass filter according to the fifth embodiment of FIG. 14, however, it should be noted that the second resonance electrodes 33*a* and 33*b* are formed on the inter-layer portion I which is located further under the inter-layer portion H on which the resonance electrode coupling conductor 32 is arranged.

The bandpass filter according to the ninth embodiment includes an laminate formed by stacking a plurality of dielectric layers 11; a first ground electrode 21 arranged on the bottom surface of the laminate; a second ground electrode 22 arranged on the top surface of the laminate; strip-shaped first resonance electrodes 30*a*, 30*b*, 30*c*, and 30*d* arranged on an inter-layer portion A of the laminate in parallel with each other; an annular ground electrode 23 shaped as a ring to surround the peripheries of the resonance electrodes 30*a*, 30*b*, 30*c*, and 30*d* on the inter-layer portion A of the laminate, wherein one end (ground end) of each of the resonance electrodes 30*a*, 30*b*, 30*c*, and 30*d* is connected to the annular ground electrode 23; a strip-shaped input coupling electrode 40*a* arranged on an inter-layer portion B located over the inter-layer portion A of the laminate to face the resonance electrode 30*a* of the input stage; a strip-shaped output coupling electrode 40*b* arranged to face the resonance electrode 30*d* of the output stage; a resonance electrode coupling conductor 32 arranged on an inter-layer portion H located under the inter-layer portion A of the laminate and having a region facing each resonance electrode so that one end and the other end of the resonance electrode coupling conductor 32 are connected to the annular ground electrode 23 through seventh penetration conductors 57 and electromagnetically coupled with the resonance electrode 30*a* of the input stage and the resonance electrode 30*d* of the output stage in a nearly uniform manner; second resonance electrodes 33*a* and 33*b* arranged on an inter-layer portion I which is located further under the inter-layer portion H on which the resonance electrode coupling conductor 32 is arranged to be parallel with the first resonance electrodes 30*a*, 30*b*, 30*c*, and 30*d*, wherein one end of each of the second resonance electrodes 33*a* and 33*b* is connected to the ground potential through the eighth penetration conductor 58, wherein the second resonance electrodes 33*a* and the second resonance electrode 33*b* are different in length from the resonance electrodes 30*a*, 30*b*, 30*c*, and 30*d*; an input terminal electrode 60*a* arranged on the top surface of the laminate to be connected to the input coupling electrode 40*a*; and an output terminal electrode 60*b* connected to the output coupling electrode 40*b*.

Although being not shown, the first ground electrode 21 is arranged on the entire surface of the bottom surface of the laminate (which is the opposite surface of the surface on which the second resonance electrodes 33*a* and 33*b* are arranged) and the second ground electrode 22 is arranged on the nearly entire surface of the top surface of the laminate, except for the peripheries of the input terminal electrode 60*a* and the output stage electrode 60*b*, and therefore, either one of the first ground electrode 21 or the second ground electrode 22 may be connected to the ground potential, thus constituting a strip line resonator together with the resonance electrodes 30*a*, 30*b*, 30*c*, and 30*d*.

Even though four first resonance electrodes are provided in the embodiment shown in FIG. 18, four or more first resonance electrodes may be provided for the present invention and the number of the first resonance electrodes does not matter as long as the first resonance electrodes are provided in such an extent not to increase the loss. For example, six first resonance electrodes may be provided as described later.

The strip-shaped second resonance electrodes 33*a* and 33*b* are arranged in parallel with the first resonance electrodes 30*a*, 30*b*, 30*c*, and 30*d* on the inter-layer portion I which is located under the inter-layer portion H on which the resonance electrode coupling conductor 32 is arranged, to have the different length from that of the resonance electrodes 30*a*, 30*b*, 30*c*, and 30*d* (shorter than the length of the first resonance electrodes 30*a*, 30*b* 30*c*, and 30*d* in the Embodiment). Further, one end of each of the second resonance electrode 33*a* and 33*b* is connected to the ground potential (annular ground electrode 23) through the eighth penetration conductor 58. Specifically, the second resonance electrode 33*a* is connected near one end (ground end) of the first resonance electrode 30*b* through the eighth penetration conductor 58 and the second resonance electrode 33*b* is connected near one end (ground end) of the first resonance electrode 30*c* through the eighth penetration conductor 58. This structure causes the resonance frequency to be located near the cut-off frequency at the outside of the pass band therefore, may function as a so-called counteraction resonator (notch filter). In addition, the expression "near the cut-off frequency at the outside of the pass band" refers to a band between an attenuation pole formed by the resonance electrode coupling conductor 32 and the cutoff frequency, wherein the term "attenuation pole formed by the resonance electrode coupling conductor 32" refers to an attenuation pole formed at the lower band side or higher band side than the pass band in the construction where the second resonance electrode 33*a* and 33*b* are not arranged.

Here, one or more second resonance electrodes may be provided and the number thereof does not matter as long as the second resonance electrode is provided in such an extent not to increase the loss of the filter. However, in view of a fact that it allows filter design to be easily done to form the filter in point symmetry with respect to the center of the filter formation region similarly to a general filter that is formed to have an symmetrical equivalent circuit, the second resonance electrode is preferably arranged in point symmetry with respect to the filter region surrounded by the annular ground electrode 23. Therefore, the bandpass filter has the first resonance electrode in even numbers (four in this Embodiment) and the second resonance electrode in even numbers (two in this Embodiment) as shown in FIG. 18, and therefore, is preferably formed in point symmetry as seen from the above, with respect to the intersection point of a line connecting one end of the resonance electrode 30*a* of the input stage and one end of the resonance electrode 30*d* of the output stage and a line connecting the other end of the resonance electrode 30*a* of the input stage and the other end of the resonance electrode 30*d* of the output stage.

Further, even though the second resonance electrodes 33*a* and 33*b* are formed to be shorter than the resonance electrodes 30*a*, 30*b*, 30*c*, and 30*d* in the embodiment, the length is determined according to whether the attenuation pole is formed at lower band side or higher band side than the pass band. That is, in a case where the attenuation pole is formed at lower band side than the pass band, the second resonance electrode 33*a* and 33*b* are formed longer than the resonance electrodes 30*a*, 30*b*, 30*c*, and 30*d*, and in a case where the attenuation pole is formed at higher band side than the pass band, the second resonance electrode 33*a* and 33*b* are formed shorter than the resonance electrodes 30*a*, 30*b*, 30*c*, and 30*d*. In this embodiment, the second resonance electrodes 33*a* and 33*b* are formed shorter than the resonance electrodes 30*a*, 30*b*, 30*c*, and 30*d* since the attenuation pole is formed at higher band side than the pass band.

Further, even though the inter-layer portion I on which the second resonance electrode 33*a* and 33*b* are arranged is located under the inter-layer portion H on which the resonance electrode coupling conductor 32 is arranged, the arrangement may be made vice versa.

As such, the construction which has the strip-shaped second resonance electrodes 33*a* and 33*b* may provide a further abrupt attenuation characteristic compared to the construction without the second resonance electrodes 33*a* and 33*b*.

Here, it is necessary to consider the amount of coupling between the second resonance electrodes and the first resonance electrodes upon preparation of the second resonance electrodes. Specifically, in a case where the second resonance electrodes is longer than the first resonance electrode, the ratio of the length (area) of the region of the second resonance electrode overlapping the first resonance electrode with respect to the entire region of the second resonance electrode in the longitudinal direction of the second resonance electrode is small, and therefore, the second resonance electrodes is preferably arranged to be adjacent to the first resonance electrode that has an inter-digital relationship with the second resonance electrode as seen from the above (the portion which is connected to the ground potential is opposite between the first resonance electrode and the second resonance electrode) to earn the amount of coupling, and preferably arranged to face the first resonance electrode that has an inter-digital relationship with the second resonance electrode if it is desired that the second resonance electrode is best coupled with the first resonance electrode. In the meanwhile, in a case where the second resonance electrode is shorter than the first resonance electrode, the second resonance electrode overlaps the first resonance electrode in its entirety in the longitudinal direction, and therefore, it is preferable that the second resonance electrode is arranged to be adjacent to the first resonance electrode that has a comb-line relationship as seen from the above (the portion which is connected to the ground potential is the same between the first resonance electrode and the second resonance electrode) to reduce the amount of coupling, and it is particularly preferable that the second resonance electrode is arranged to be close to the first resonance electrode that has a comb-line relationship as seen from the above in such an extent that the entire region of the second resonance electrode does not face the first resonance electrode. In addition, the adjustment of the amount of coupling is dependent on the thickness of a dielectric layer arranged between the first resonance electrode and the second resonance electrode, the width of each resonance electrode, the area of a facing portion, and the like. Accordingly, it is preferable to arrange the second resonance electrode at the location which may acquire the desired amount of coupling by taking these into consideration.

In this embodiment, the second resonance electrode 33*a* is arranged to be partially opposite to the first resonance electrode 30*b* as seen from the above, and the second resonance electrode 33*b* is arranged to be partially opposite to the first resonance electrode 30*c* as seen from the above.

Figure 29:
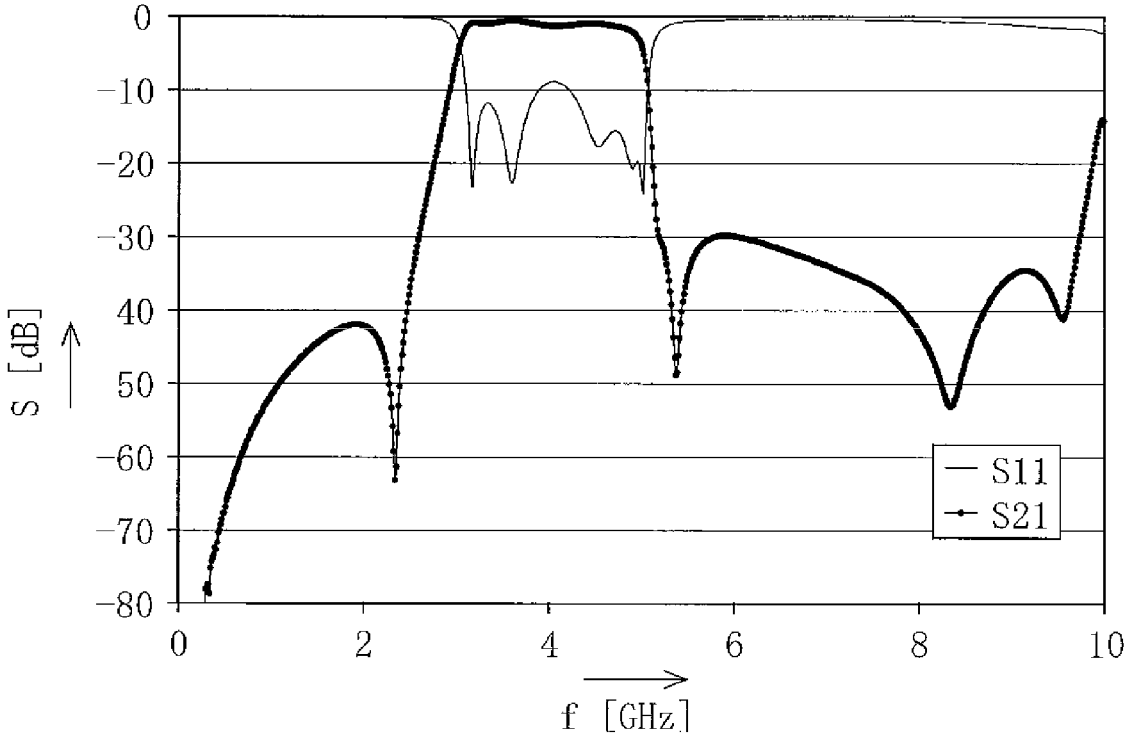
FIG. 29 is a view illustrating a result of simulation regarding a transmission characteristic of an example of the bandpass filter according to the present invention, which is shown in FIG. 22.
Figure 30:
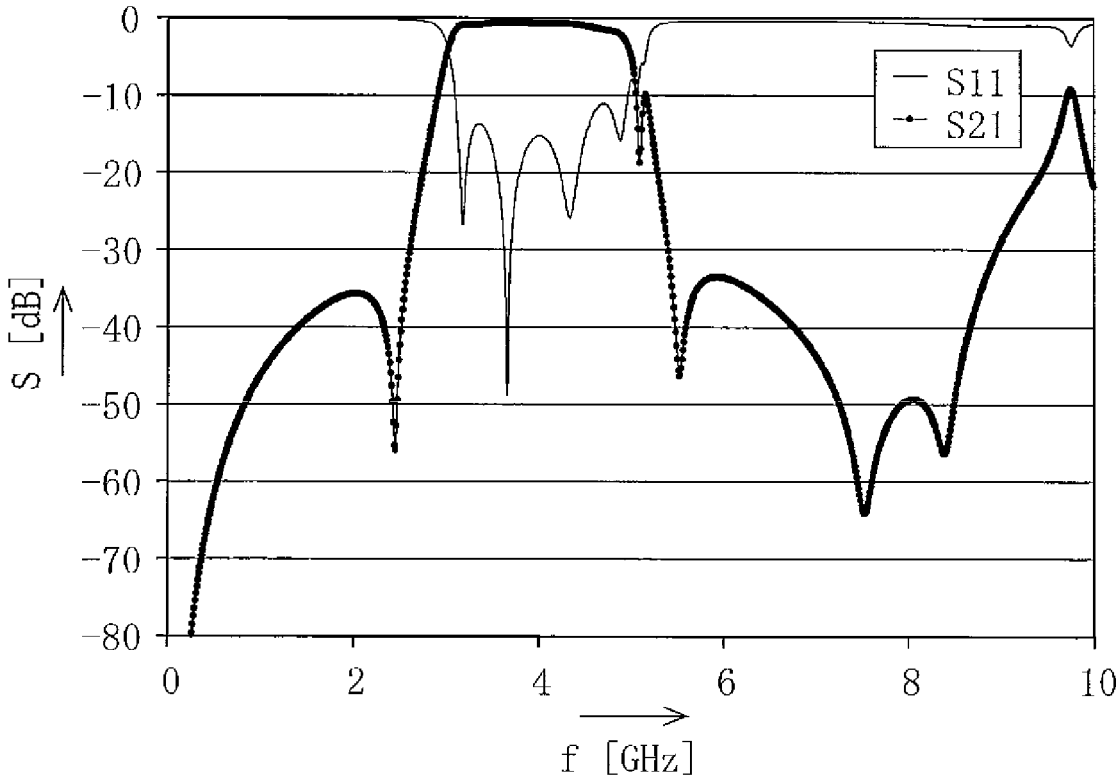
FIG. 30 is a view illustrating a result of simulation regarding a transmission characteristic of another example of the bandpass filter according to the present invention, which is shown in FIG. 22.

Hereinafter, it will be described to improve the attenuation characteristic by adjusting the amount of coupling of the second resonance electrode. For example, in a case where the desired amount of coupling is not obtained as shown in FIG. 30, an abrupt attenuation characteristic may be obtained at bands fairly near the cutoff frequency outside the appropriate pass band, however, a sharp rising occurs at the high band side of the attenuation pole (between attenuation poles) by the second resonance electrode. In contrast, in a case where a desired amount of coupling is obtained as shown in FIG. 29, it can be seen that such sharp rising as shown in FIG. 30 does not occur and an abrupt attenuation characteristic may be obtained without the sharp rising.

By doing so, there may be achieve a high-capacity bandpass filter according to the embodiment, which has a flat and low-loss transmission characteristic over the entire region of the very broad pass band that reaches 30% by the relative bandwidth well in excess of the region that may be realized by the conventional filter using the ¼ wavelength resonator, has the attenuation poles at the lower band side and the higher band side than the pass band is fairy appropriate as a filter for UWB.

Figure 19A:
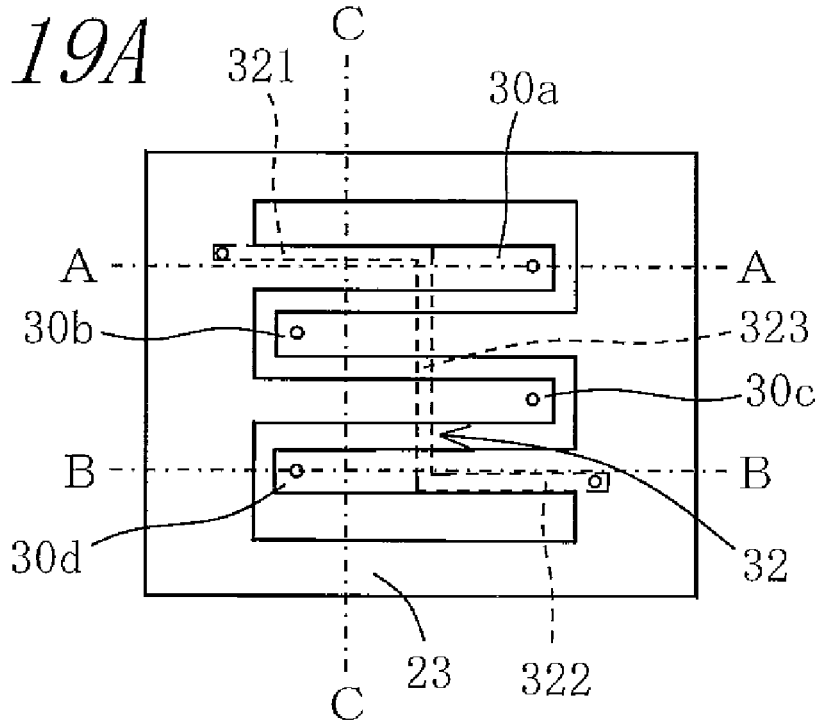
FIG. 19A and FIG. 19B are views illustrating the bandpass filters shown in FIG. 17 and FIG. 18, respectively.
Figure 19B:
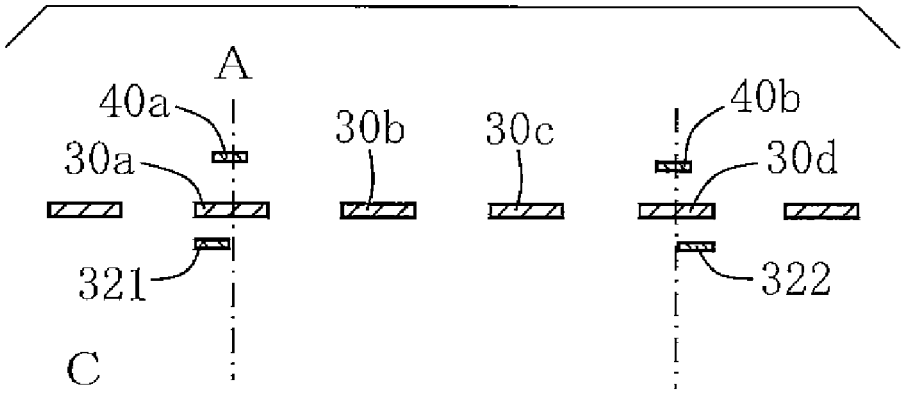

Further, FIG. 19A is a view schematically illustrating the resonance electrode coupling conductor 32 and the resonance electrodes 30*a*, 30*b*, 03*c*, and 03*d*, shown in FIG. 18, which are seen from the above, and FIG. 19B is a view schematically illustrating the resonance electrode coupling conductor 32, the resonance electrodes 30*a*, 30*b*, 30*c*, and 30*d*, the input coupling electrode 40*a*, and the output coupling electrode 40*b* shown in FIG. 18, which is seen from their cross section. As shown in FIG. 19A and FIG. 19B, it is preferable in the resonance electrode coupling conductor 32 that an input stage coupling region 321 is shaped as a strip and the central axis line extending in the longitudinal direction of the input stage coupling region 321 is arranged not to overlap the central axis line extending in the longitudinal direction of the input coupling electrode 40*a* as seen from the above, and an output stage coupling region 322 is shaped as a strip and the central axis line extending in the longitudinal direction of the output stage coupling region 322 is arranged not to overlap the central axis line extending in the longitudinal direction of the output coupling electrode 40*b* as seen from the above.

This is to suppress the occurrence of the peak at λ/2 resonance of the resonance electrode coupling conductor 32 within the use frequency band of UWB and outside the pass band by weakening a broad side coupling between the input stage coupling region 321 and the input coupling electrode 40*a* to improve the out-of-band characteristics.

In particular, it is preferable as shown in FIG. 19B that the input stage coupling region 321 is arranged not to overlap the central axis line extending in the longitudinal direction of the input coupling electrode 40*a* as seen from the above and the output stage coupling region 322 is arranged not to overlap the central axis line extending in the longitudinal direction of the output coupling electrode 40*b*. By doing so, it may be possible to weaken the coupling between the resonance electrode coupling conductor 32 and the input coupling electrode 40*a* and the coupling between the resonance electrode coupling conductor 32 and the output coupling electrode 40*b* while maintaining the coupling between the resonance electrode coupling conductor 32 and the first resonance electrodes 30*a*, 30*b*, 30*c*, and 30*d*. In addition, even though the input stage coupling region 321 and the resonance electrode 30*a* of the input stage face each other, the term "face" means that there are no protrusions as seen from above since the input stage coupling region 321 and the resonance electrode 30*a* of the input stage overlap each other. If there is a protrusion where the input stage coupling region 321 and the resonance electrode 30*a* of the input stage do not overlap each other, the losses could be increased. This is also true for the relationship between the output stage coupling region 322 and the resonance electrode 30*d* of the output stage.

Tenth Embodiment

Figure 20:
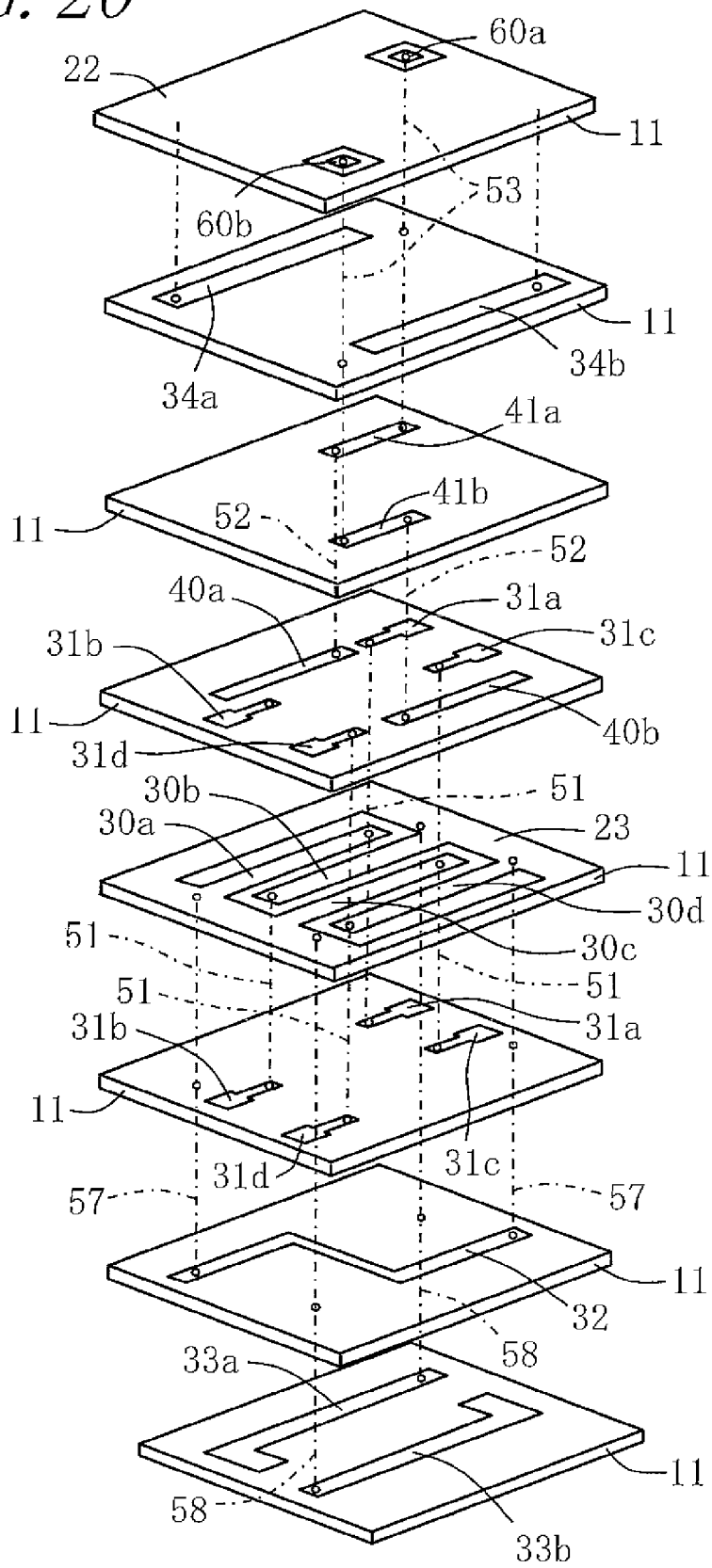
FIG. 20 is an exploded perspective view schematically illustrating the external appearance of a bandpass filter according to an tenth embodiment of the present invention.

FIG. 20 is an exploded perspective view schematically illustrating a bandpass filter according to an tenth embodiment of the present invention. It is preferable as shown in FIG. 20 that in addition to the structure shown in FIG. 18 according to the ninth embodiment, a strip-shaped input coupling resonance electrode 34*a* electromagnetically coupled with the input coupling electrode 40*a* and a strip-shaped output coupling resonance electrode 34*b* electromagnetically coupled with the output coupling electrode 40*b*, one end of each of the input coupling resonance electrode 34*a* and the output coupling resonance electrode 34*b* is connected to the ground potential to function as a ¼ wavelength resonator, are arranged on the inter-layer portion that is located over the inter layer portion on which the input coupling electrode 40*a* and the output coupling electrode 40*b* are arranged and outside the region between the resonance electrode 30*a* of the input stage and the resonance electrode 30*d* of the output stage as seen from the above.

This structure allows the input coupling resonance electrode 34*a* and the output coupling resonance electrode 34*b* to function as a counteraction resonator, and therefore, an attenuation pole may be formed separately from the attenuation pole formed by the second resonance electrode. The attenuation pole is expanded at the higher band side without changing the size of the pass band by adjusting the length of the input coupling resonance electrode 34*a* and the output coupling resonance electrode 34*b*, thus making it possible to improve the skirt characteristic (making the skirt characteristic more abrupt).

Here, the input coupling resonance electrode 34*a* is coupled with the input coupling electrode 40*a*, and the output coupling resonance electrode 34*b* is coupled with the output coupling electrode 40*b*. If the input coupling resonance electrode 34*a* is positioned within the region between the resonance electrode 30*a* of the input stage and the resonance electrode 30*d* of the output stage, the coupling between the input coupling resonance electrode 34*a* and the input coupling electrode 40*a* becomes too strong, and this may weaken the coupling between the input coupling electrode 40*a* and the resonance electrode 30*a* of the input stage, thus causing the filter characteristics to be lost. If the input coupling resonance electrode 34*a* goes further deeply inside the region, the input coupling resonance electrode 34*a* ends up to be coupled with the resonance electrode 30*b*, also causing the filter characteristics to be lost. In the meanwhile, in a case where the input coupling resonance electrode 34*a* is located on or under the same inter-layer portion as that on which the input coupling electrode 40*a* is arranged, the input coupling resonance electrode 34*a* ends up to be coupled with the resonance electrode 30*a*, thus causing the filter characteristics to be lost.

This is much the same for the output coupling resonance electrode 34*b*.

Even though the input coupling resonance electrode 34*a* and the output coupling resonance electrode 34*b* are provided in the embodiment in terms of facility in design, it may be possible to provide either one of the input coupling resonance electrode 34*a* or the output coupling resonance electrode 34*b*.

Eleventh Embodiment

Figure 21:
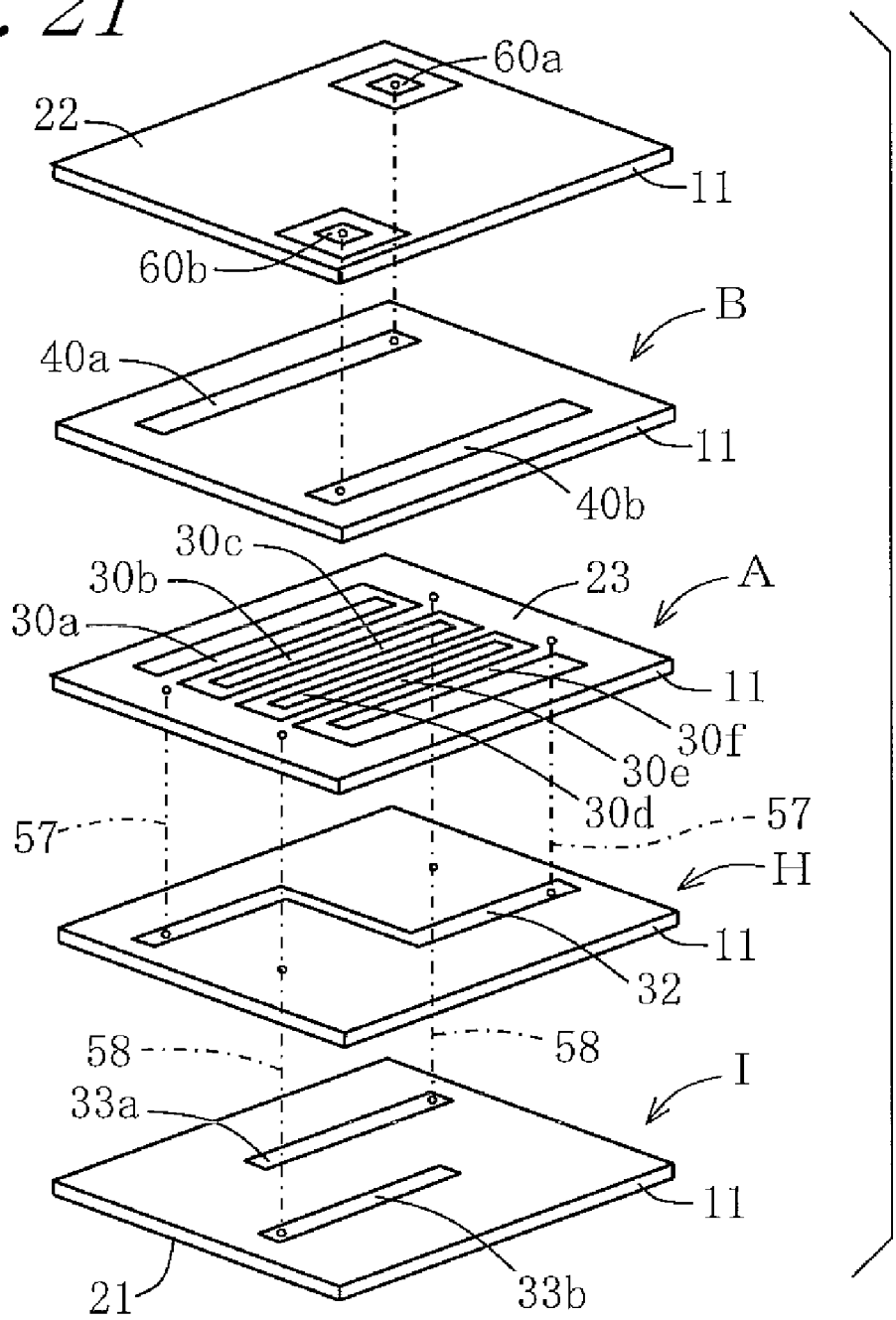
FIG. 21 is an exploded perspective view schematically illustrating the external appearance of a bandpass filter according to a eleventh embodiment of the present invention.

FIG. 21 is an exploded perspective view schematically illustrating a bandpass filter according to an eleventh embodiment of the present invention. The difference in the structure from the ninth embodiment shown in FIG. 18 is that the first resonance electrode is configured to have six stages such as 30*a*, 30*b*, 30*c*, 30*d*, 30*e*, and 30*f*.

Even in the bandpass filter according to this embodiment, there is the resonance electrode coupling conductor 32 whose one end is connected to the annular ground electrode 23 near one end (ground end) of the resonance electrode 30*a* of the input stage through the seventh penetration conductor 57 and the other end is connected to the annular ground electrode 23 near one end (ground end) of the resonance electrode 30*f* of the output stage through the seventh penetration conductor 57. Therefore, the resonance electrode coupling conductor 32 is adapted to be inductively coupled with the resonance electrode of the input stage and the resonance electrode of the output stage at a portion near one end (ground end) of the resonance electrode 30*a* of the input stage and at a portion near one end of (ground end) of the resonance electrode 30*f* of the output stage. In the meanwhile, a capacitive coupling is made between two adjacent resonance electrodes (between 30*a* and 30*b*, between 30*b* and 30*c*, between 30*c* and 30*d*, between 30*d* and 30*e*, and between 30*e* and 30*f*) among the six first resonance electrodes. This structure constitutes a so-called pseudo elliptic function filter. Accordingly, an attenuation pole may be formed at the lower band side and an attenuation pole at the higher band side than the pass band. By doing so, there may be achieved a filter characteristic of being abruptly attenuated at the other bands than the pass band.

In addition, the pseudo elliptic function filter, for example, a six-stage resonator, may form attenuation poles at the lower band side and the higher band side than the pass band as long as it has the following relationship: the coupling between the first-stage resonator and the second-stage resonator is positive (+), the coupling between the second-stage resonator and the third-stage resonator is positive (+), the coupling between the third-resonator and the fourth-resonator is positive (+), the coupling between the fourth-stage resonator and the fifth-stage resonator is positive (+), the coupling between the fifth-stage resonator and the sixth-stage resonator is positive (+), and the coupling between the first-stage resonator and the sixth-stage resonator is negative (−). Here, "positive" corresponds to being capacitive and "negative" corresponds to being inductive.

As such, there may be achieved a bandpass filter according to the sixth embodiment, which has an attenuation characteristic of being more abruptly attenuated than the bandpass filter according to the ninth embodiment described above.

Twelfth Embodiment

Figure 22:
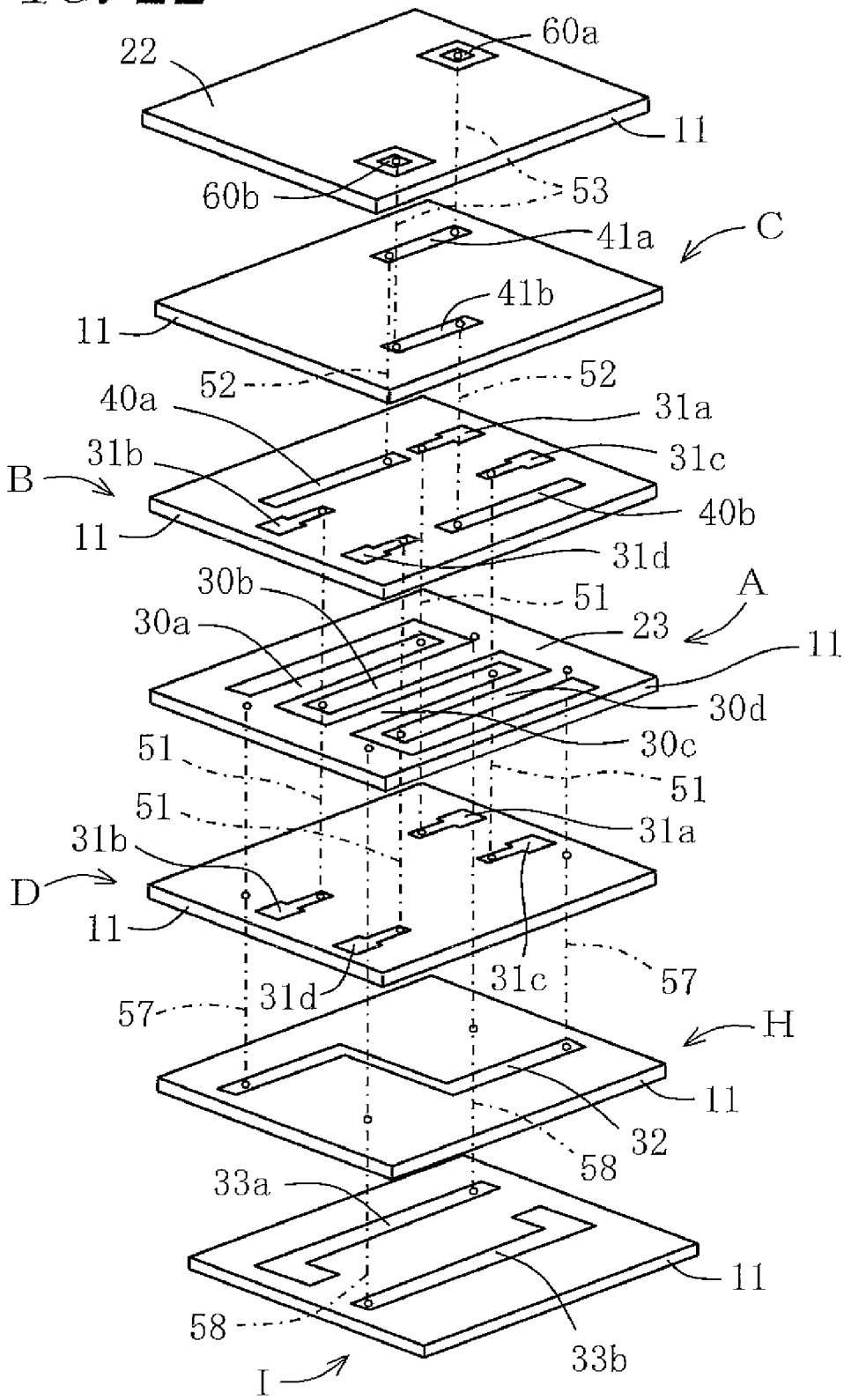
FIG. 22 is an exploded perspective view schematically illustrating the external appearance of a bandpass filter according to a twelfth embodiment of the present invention.

FIG. 22 is an exploded perspective view schematically illustrating a bandpass filter according to a twelfth embodiment of the present invention. The difference in structure from the ninth embodiment shown in FIG. 18 is that the auxiliary resonance electrodes 31*a*, 31*b*, 31*c*, and 31*d* are arranged on the inter-layer portion B located above the inter-layer portion A on which the first resonance electrodes 30*a*, 30*b*, 30*c*, and 30*d* and the annular ground electrode 23 are arranged, each having a region facing the annular ground electrode 23 and a region facing each of the first resonance electrodes 30*a*, 30*b*, 30*c*, and 30*d*, and the auxiliary resonance electrodes 31*a*, 31*b*, 31*c*, and 31*d* are arranged on the inter-layer portion D located under the inter-layer portion A on which the first resonance electrodes 30*a*, 30*b*, 30*c*, and 30*d* and the annular ground electrode 23 are arranged, each having a region facing the annular ground electrode 23 and a region facing each of the first resonance electrodes 30*a*, 30*b*, 30*c*, and 30*d*. The first resonance electrodes 30*a*, 30*b*, 30*c*, and 30*d* and the auxiliary resonance electrodes 31*a*, 31*b*, 31*c*, and 31*d* are connected to each other through the first penetration conductors 51 that penetrate the dielectric layer 11. By doing so, the capacitance between the auxiliary resonance electrodes 31*a*, 31*b*, 31*c*, and 31*d* and the annular ground electrode 23 is added, and therefore, the capacitance between the other ends (open ends) of the first resonance electrodes 30*a*, 30*b*, 30*c*, and 30*d* and the ground potential is further increased, and therefore, the length of the first resonance electrodes 30*a*, 30*b*, and 30*c* may be shortened, thus enabling a smaller-size bandpass filter.

In addition, in the twelfth embodiment shown in FIG. 22, each of the auxiliary resonance electrodes 31*a*, 31*b*, 31*c*, and 31*d* is provided in pair: one at the upper side and one at the lower side. In a case where it does not matter if the length is shortened, the auxiliary resonance electrodes 31*a*, 31*b*, 31*c*, and 31*d* may be configured to be provided either above or under the inter layer portion A on which the first resonance electrodes 30*a*, 30*b*, 30*c*, and 30*d* and the annular ground electrode 23 are arranged.

Further, in addition to the formation of the auxiliary resonance electrode 31*a* and 31*d*, the auxiliary input coupling electrode 41*a* and the auxiliary output coupling electrode 41*b* are formed to correspond to the input coupling electrode 40*a* and the output coupling electrode 40*b*, respectively, on the inter-layer portion C different from the inter-layer portion A on which the first resonance electrodes 30*a*, 30*b*, 30*c*, and 30*d* and the annular ground electrode 23 are arranged and the inter-layer portions B and Don which the auxiliary resonance electrodes 31*a*, 31*b*, 31*c*, and 31*d* are arranged.

Even though the second resonance electrodes 33*a* and 33*b* are formed to be shorter than the first resonance electrodes 30*a*, 30*b*, 30*c*, and 30*d* in the ninth embodiment shown in FIG. 18, the second resonance electrodes 33*a* and 33*b* are lengthened as the first resonance electrodes 30*a*, 30*b*, 30*c*, and 30*d* are shortened as described above. Therefore, the second resonance electrodes 33*a* and 33*b* obtains capacitance between the second resonance electrodes 33*a* and 33*b* and the annular ground electrode 23 and are shortened by forming the second resonance electrodes 33*a* and 33*b* to have the broad width so that the other end of each of the second resonance electrodes 33*a* and 33*b*, which is opposite to one end thereof, which is connected to the ground potential, is protruded toward one side as shown in FIG. 22. The second resonance electrodes 33*a* and 33*b* may be formed in various shapes, such as, a shape in which the other end of the second resonance electrode 33*a* and 33*b* has been bent or shape of the letter "T".

In adjusting the amount of coupling between the first resonance electrodes and the second resonance electrodes, the second resonance electrode is positioned to be close to the first resonance electrode having an inter-digital relationship therewith to increase the amount of coupling, with the second resonance electrode lengthened more than the first resonance electrode.

Further, even though the second resonance electrode is apparently longer than the first resonance electrode, the resonance frequency of the second resonance electrode is higher than that of the first resonance electrode, and therefore, the second resonance electrode is adapted to have the resonance frequency near the cutoff frequency at the higher band side than the pass band similarly to the ninth embodiment shown in FIG. 18.

As such, a smaller-size bandpass filter may be achieved according to the twelfth embodiment compared to the bandpass filter according to the ninth embodiment.

Thirteenth Embodiment

Figure 23:
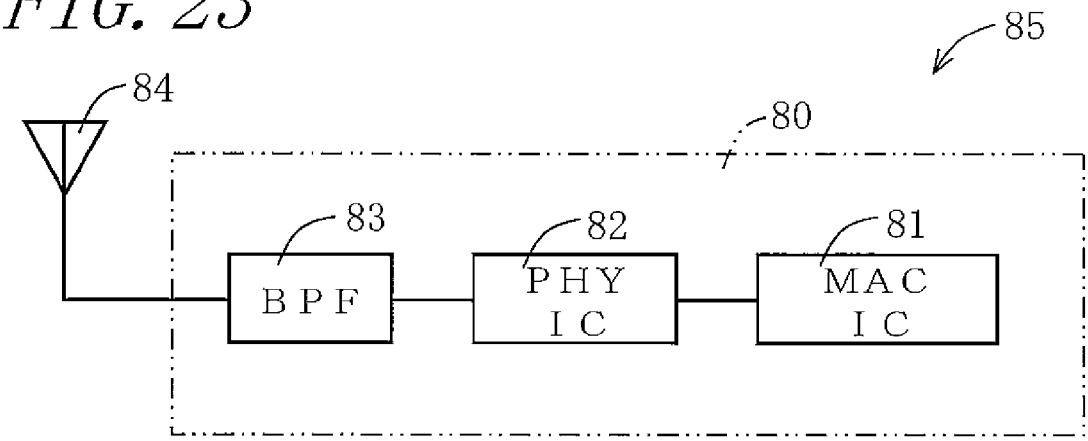
FIG. 23 is a block diagram illustrating a constructional example of a high frequency module and a radio communication device using the high frequency module according to an thirteenth embodiment of the present invention, which employ the bandpass filter according to the embodiments of the present invention.

FIG. 23 is a block diagram illustrating a constructional example of a high frequency module 80 and a radio communication device 85 using the high frequency module 80 according to an thirteenth embodiment of the present invention, which utilizes a bandpass filter according to the embodiments of the present invention. The high frequency module 80 and the radio communication device 85 according to this embodiment may use any one of the bandpass filters according to the first to twelfth embodiments as described above.

The high frequency module 80 according to the thirteenth embodiment includes a Medium Access Control (MAC) circuit (IC) 81 that performs medium access control, a Physical Layer (PHY) circuit (IC) 82 connected to the MAC IC 81 to perform transmission/receipt of a multiband OFDM signal, and a bandpass filter 83 connected to the PHY IC 82. The radio communication device 85 further includes an antenna 84 connected to the bandpass filter 83 of the high frequency module 80. When passing through the bandpass filter 83, a transmission signal outputted from the PHY IC 82 is transmitted through the antenna 84, with signals having frequencies other than a communication band attenuated. When passing through the bandpass filter 83, a receipt signal received through the antenna 84 enters into the PHY IC 82, with the signals having frequencies other than the communication band attenuated.

The high frequency module 80 and the radio communication device 85 according to the thirteenth embodiment employs in filtering of the transmission signal and receipt signal the bandpass filters according to the first to twelfth embodiments that have a low-loss passing signal over the entire regions of the communication band, so that the attenuation of a receipt signal and a transmission signal passing the bandpass filter is reduced, and therefore, the receipt sensitivity is improved. Since the amplification degree of the transmission signal and the receipt signal may be reduced, consumption power is lowered in an amplification circuit. Accordingly, it may be possible to achieve a high-capacity high frequency module 80 and the radio communication device 85 that have a high receipt sensitivity and low consumption power.

In the bandpass filters according to the first to twelfth embodiments, the dielectric layer 11 may be formed of a resin such as epoxy resin, or ceramics such as dielectric ceramics. For example, a glass-ceramic material may be very appropriately used which is composed of a dielectric ceramic material such as $BaTiO_3$, $Pb_4Fe_2Nb_2O_{12}$, $TiO_2$ and a glass material such as $B_2O_3$, $SiO_2$, $Al_2O_3$, ZnO and may be fireable at a relatively low temperature on the order of 800 to 1200° C. Further, the thickness of the dielectric layer 11 is set, for example, on the order of 0.05 to 0.1 mm.

A conductive material whose principle constituent is an Ag alloy of, for example, Ag, Ag—Pd, and Ag—Pt or Cu-based, W-based, Mo-based, and Pd-based conductive material is fairly appropriately used for the above-described various electrodes and penetration conductors. The thickness of the various electrodes is set, for example, on the order of 0.001 to 0.05 mm.

The bandpass filters according to the first to twelfth embodiments may be manufactured, for example, as follows. To begin with, a proper organic solvent is added to ceramic based powder and mixed to form a slurry and then form a ceramic green sheet by a doctor blade method. Next, through-holes for penetration conductors, are formed at the obtained ceramic green sheet using a punching machine, and conductive paste such as Ag, Ag—Pd, Au, and Cu, is filled in the through-holes to form penetration conductors. Thereafter, the above described various electrodes are formed on the ceramic green sheet by lithography. Then, these are stacked and pressurized by a hot press device, and fired at a high temperature of 800 to 1050° C.

(Variation)

The present invention is not limited to the first to thirteenth embodiments, and a diversity of variations and modifications may be made without departing from the scope and spirit of the present invention.

Figure 24:
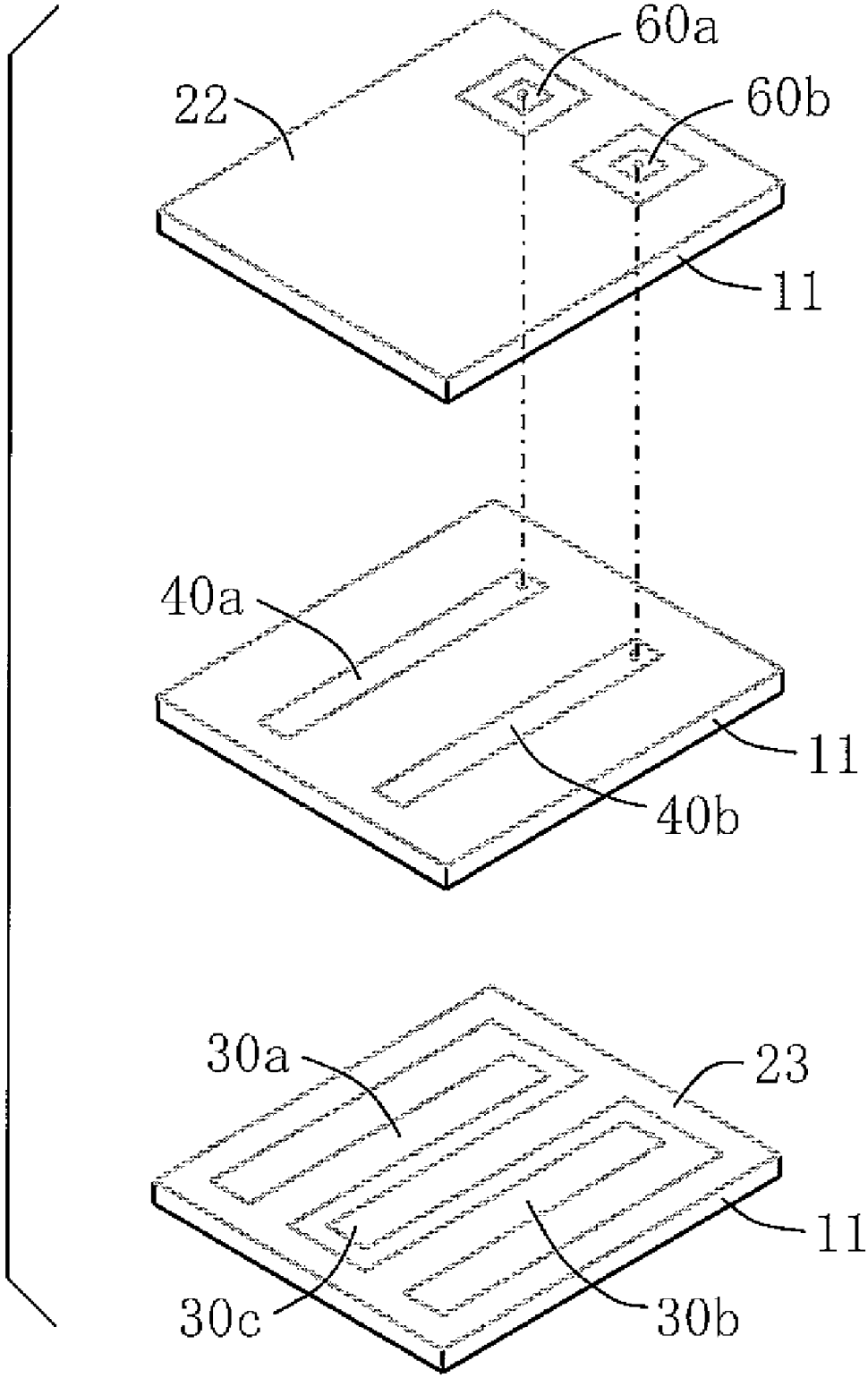
FIG. 24 is an exploded perspective view schematically illustrating a first variation to the bandpass filter according to the embodiments of the present invention.
Figure 25:
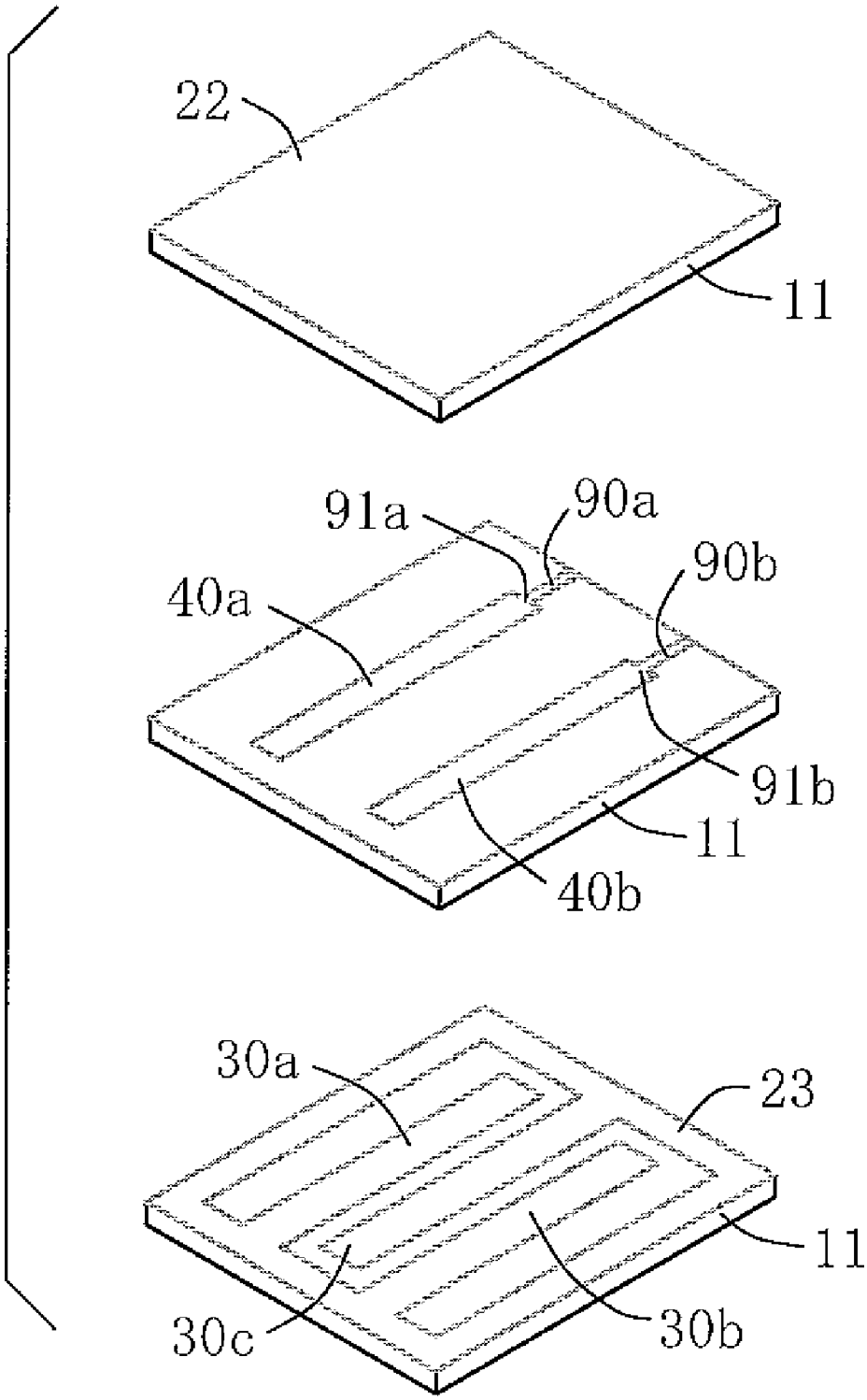
FIG. 25 is an exploded perspective view schematically illustrating a second variation to the bandpass filter according to the embodiments of the present invention.

FIG. 24 is an exploded perspective view schematically illustrating a first variation to a bandpass filter according to an embodiment of the present invention. FIG. 25 is an exploded perspective view schematically illustrating a second variation to a bandpass filter according to an embodiment of the present invention, which depicts only the region where the bandpass filter is formed in a case where the bandpass filter according to the embodiment of the present invention is formed on a region of the module substrate.

Further, the following descriptions focus on only the differences from the first embodiments with respect to the variations, wherein the same reference numerals refer to the same constitutional elements, and therefore, the repetitive descriptions will be omitted.

First, even though an example has been described in the first to third embodiments where the auxiliary resonance electrodes 31*a*, 31*b*, and 31*c*, the auxiliary input coupling electrode 41*a*, and the auxiliary output coupling electrode 41*b* are provided, it may be possible, for example, to remove the auxiliary resonance electrodes 31*a*, 31*b*, and 31*c*, the auxiliary input coupling electrode 41*a*, and the auxiliary output coupling electrode 41*b* like the bandpass filter shown in FIG. 24. In a case where it does not matter if the planar shape is large-sized, the auxiliary resonance electrodes 31*a*, 31*b*, and 31*c* are not necessary, and in this case it is natural that the auxiliary input coupling electrode 41*a* and the auxiliary output coupling electrode 41*b* are also unnecessary.

Even though an example has been described in the first to twelfth embodiments where the input terminal electrode 60*a* and the output terminal electrode 60*b* are provided, the input terminal electrode 60*a* and the output terminal electrode 60*b* are not necessary in a case where the bandpass filter is formed on a region of the module substrate. For example, an input wiring electrode 90*a* from an external circuit in the module substrate and an output wiring electrode 90*b* to the external circuit in the module substrate may be directly connected to the input coupling electrode 40*a* and the output coupling electrode 40*b*, respectively, like the bandpass filter shown in FIG. 25. In this case, a contact point 91*a* of the input coupling electrode 40*a* and the input wiring electrode 90*a* becomes a gateway through which an electrical signal inputted from the external circuit is supplied to the input coupling electrode 40*a*, and a contact point 92*b* of the output coupling electrode 40*b* and the output wiring electrode 90*b* becomes a gateway through which an electrical signal outputted to the external circuit is drawn from the output coupling electrode 40*b*.

Second, even though an example has been described in the above described first to twelfth embodiments, where the input coupling electrode 40*a*, the output coupling electrode 40*b*, and the auxiliary resonance electrodes 31*a*, 31*b*, 31*c*, and 31*d* are arranged on the same inter-layer portion of the laminate, the input coupling electrode 40*a*, the output coupling electrode 40*b*, and the auxiliary resonance electrodes 31*a*, 31*b*, 31*c*, and 31*d* may be arranged on the different inter-layer portion, the input coupling electrode 40*a* and the output coupling electrode 40*b* may be arranged on the different inter-layer portion, or the auxiliary resonance electrodes 31*a*, 31*b*, 31*c*, and 31*d* may be arranged on the different inter-layer portions from each other.

Third, even though an example has been described in the first to third, the sixth, and the twelfth embodiments where the auxiliary input coupling electrode 41*a* and the auxiliary output coupling electrode 41*b* are arranged on the same inter-layer portion C of the laminate 10, the auxiliary input coupling electrode 41*a* and the auxiliary output coupling electrode 41*b* may be arranged on the different inter-layer portion of the laminate 10.

Fourth, even though an example has been described in the first to third embodiments where three resonance electrodes 30*a*, 30*b*, and 30*c* are electromagnetically coupled with each other to constitute a bandpass filter, for example, two, or four or more resonance electrodes may be electromagnetically coupled with each other to constitute a bandpass filter. The number of resonance electrodes may be selected according to required electrical properties and acceptable shape measurements.

Fifth, even though an example has been described in the above mentioned first to twelfth embodiments where the first ground electrode 21 is arranged on the bottom surface of the laminate 10 and the second ground electrode 22 is arranged on the top surface of the laminate 10, an additive dielectric layer may be, for example, arranged under the first ground electrode 21 and an additive dielectric layer may be arranged over the second ground electrode 22.

Even though an example has been described in the thirteenth embodiment where the high frequency module 80 is composed of the MAC IC 81 performing medium access control, the PHY IC 82 connected to the MAC IC 81, and the bandpass filter 83 connected to the PHY IC 82, a one-chip IC in which the MAC IC 81 and the PHY IC 82 are integrally formed to each other may be used. Further, the high frequency module may be composed only of the PHY IC 82 and the bandpass filter 83 connected to the PHY IC 82, and the radio communication device 85 may be configured by connecting the MAC IC 81 and the antenna 84 to the high frequency module.

Sixth, even though a bandpass filter used for UWB has been described, it is needless to say that the bandpass filter of the present invention is also valid for other purposes that require broad bands.

EXAMPLE 1

Hereinafter, specific examples of electronic elements according to embodiments of the present invention will be described.

Electrical properties of the bandpass filter having such structures as shown in FIGS. 1 to 4 were calculated by simulation using a finite element method. The conditions for calculation was as follows: relative dielectric constant of the dielectric layer 11=9.4, dissipation factor of the dielectric layer 11=0.0005, and conductivity of various electrodes=$3.0\times10^7$ S/m as physical property values. As the shape measurements, the resonance electrodes 30*a*, 30*b*, and 30*c* were adapted to have the width of 0.4 mm, the length of 2.9 mm, and the interval of 0.13 mm between two adjacent resonance electrodes. The input coupling electrode 40*a* and the output coupling electrode 40*b* were adapted to have the width of 0.3 mm and the length of 2.5 mm, and the auxiliary input coupling electrode 41*a* and the auxiliary output coupling electrode 41*h* were adapted to have the width of 0.3 mm and the length of 1.45 mm. Each of the auxiliary resonance electrodes 31*a*, 31*b*, and 31*c* was adapted to have a first rectangular portion and a second rectangular portion joined to each other, wherein the first rectangular portion is arranged 0.3 mm away from the other end of each of the resonance electrodes 30*a*, 30*b*, and 30*c* and has the width of 0.45 mm and the length of 0.8 mm, and the second rectangular portion is located from the first rectangular portion toward each of the resonance electrodes 30*a*, 30*b*, and 30*c* and has the width of 0.2 mm and the length of 0.4 mm. Each of the input terminal electrode 60*a* and the output terminal electrode 60*b* were adapted to have a square portion whose one edge is 0.3 mm long and to be 0.2 mm away from the second ground electrode 22. In the external appearance, each of the first ground electrode 21, the second ground electrode 22, and the annular ground electrode 23 was adapted to have the width of 3 mm and the length of 5 mm, and the opening portion of the annular ground electrode 23 was adapted to have the width of 2.4 mm and the length of 3 mm. The bandpass filter was overall adapted to have the width of 3 mm, the length of 5 mm, and the thickness of 0.91 mm, and to have the inter-layer portion A at the center thereof in the thickness direction. The interval between the inter-layer portion A and the inter-layer portion B, and the interval between the inter-layer portion B and the inter-layer portion C, respectively, were adapted to be 0.065 mm. The thickness of various electrodes was adapted to be 0.01 mm, and the diameter of various penetration conductors was adapted to be 0.1 mm.

Figure 26:
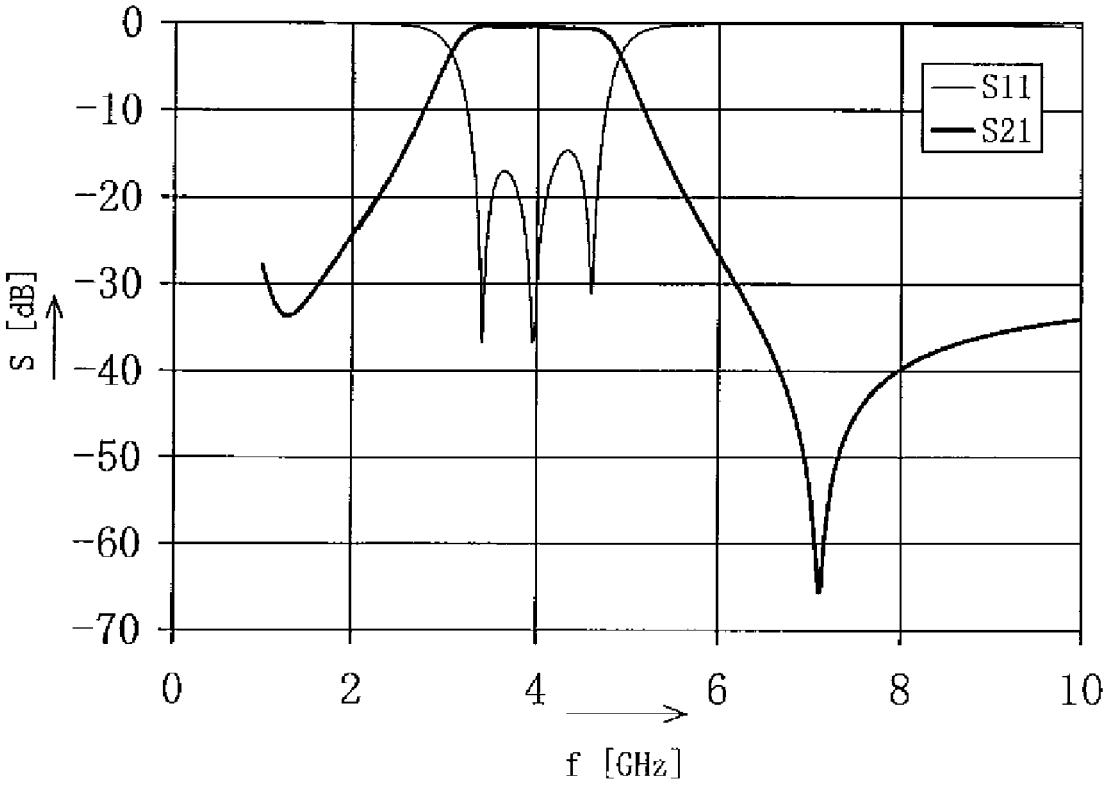
FIG. 26 is a view illustrating a result of simulation regarding an electrical characteristic of the bandpass filter according to the embodiments of the present invention.

FIG. 26 is a graph illustrating a result of the simulation, wherein horizontal axis refers to frequencies, vertical axis refers to losses, S21 refers to a transmission characteristic, and S11 refers to a reflection characteristic. The graph illustrated in FIG. 26 shows the Loss of less than 1.5 dB occurs in the frequency range of 3.2 GHz to 4.7 GHz that corresponds to 40% by the relative bandwidth, which is even broader than the region realized by the conventional filter using the conventional ¼ wavelength resonator. As such, it could be possible to achieve an excellent transmission characteristic of being flat and of low loss over the entire region of the broad pass band and therefore the effectiveness of the present invention might be verified.

EXAMPLE 2

The transmission properties of the bandpass filter having the structure according to FIG. 17 were calculated by electromagnetic simulation. The conditions of calculation were as follows: relative dielectric constant of the dielectric layer 11=9.4, dissipation factor=0.0005, and conductivity=$3.0\times10^7$ S/m. As the shape measurements of the design values used for the trial production, the resonance electrodes 30*a*, 30*b*, 03*c*, and 30*d* were adapted to have the width of 0.4 mm, the length of 2.85 mm, the interval of 0.15 mm between the resonance electrodes 30*a* and 30*b*, and the interval of 0.15 mm between the resonance electrodes 30*c* and 30*d*, and the interval of 0.15 mm between the resonance electrodes 30*b* and 30*c*. The input coupling electrode 40*a* and the output coupling electrode 40*b* were adapted to have the width of 0.3 mm and the length of 2.5 mm, and the auxiliary input coupling electrode 41*a* and the auxiliary output coupling electrode 41*b* were adapted to have the width of 0.3 mm and the length of 1.45 mm. Each of the auxiliary resonance electrodes 31*a*, 31*b*, 31*c*, and 31*d* was adapted to have a first rectangular portion and a second rectangular portion joined to each other, wherein the first rectangular portion is arranged 0.3 mm away from the other end of each of the resonance electrodes 30*a*, 30*b*, 30*c*, and 30*d* and has the width of 0.45 mm, the length of 0.8 mm, and the second rectangular portion is located from the first rectangular portion toward the resonance electrodes 30*a*, 30*b*, 30*c*, and 30*d* and has the width of 0.2 mm and the length of 0.4 mm. Each of the input terminal electrode 60*a* and the output terminal electrode 60*b* was adapted to have a square portion whose one edge is 0.3 mm long and to be 0.2 mm away from the second ground electrode 22. In the external appearance, each of the first ground electrode 21, the second ground electrode 22, and the annular ground electrode 23 was adapted to have the width of 4 mm and the length of 6 mm, and the opening portion of the annular ground electrode 23 was adapted to have the width of 2.4 mm and the length of 3 mm. The bandpass filter was overall adapted to have the width of 3 mm, the length of 5 mm, and the thickness of 0.9 mm. Each of the interval between the inter-layer portion C on which the auxiliary input coupling electrode 41*a* and the auxiliary output coupling electrode 41*b* are arranged and the inter-layer portion B located over the inter-layer portion C and on which the auxiliary resonance electrodes 31*a*, 31*b*, 31*c*, and 31*d* are arranged was adapted to be 0.065 mm. The thickness of various electrodes was adapted to be 0.013 mm, and the diameter of various penetration conductors was adapted to be 0.1 mm. The resonance electrode coupling conductor was adapted to have the width of 0.2 mm and the central connection portion of 0.1 mm to form the attenuation pole.

Figure 27:
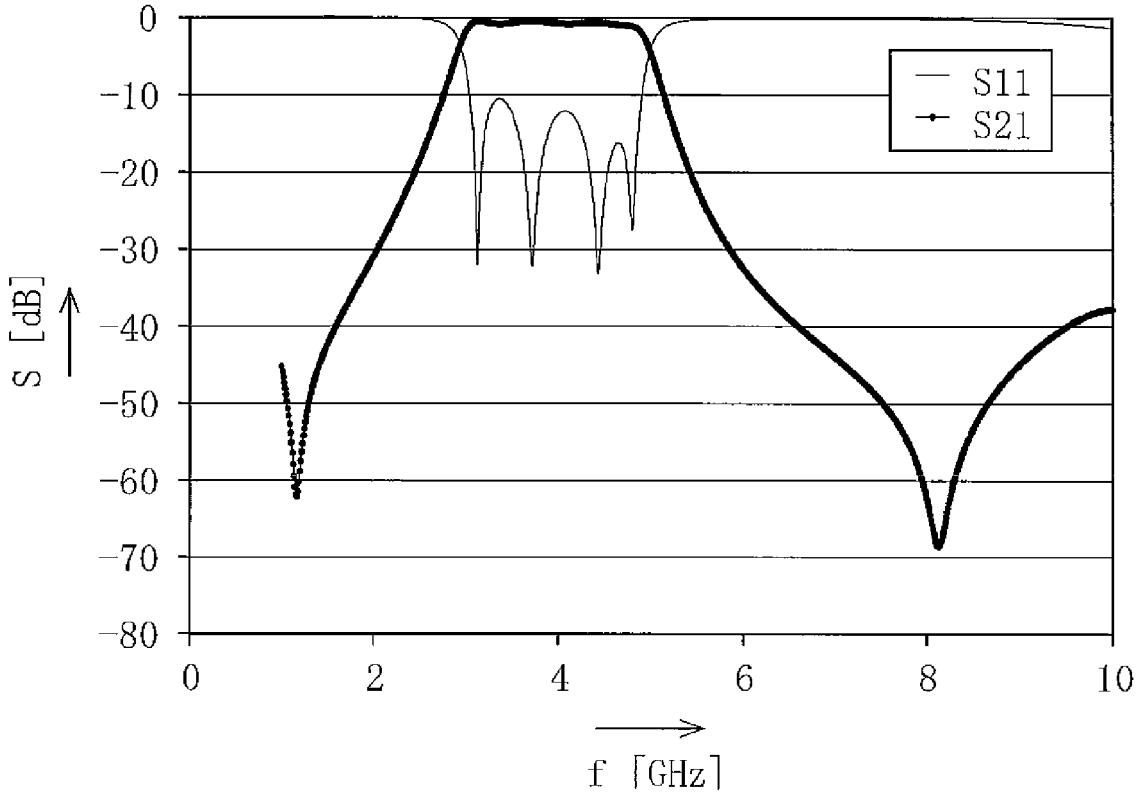
FIG. 27 is a view illustrating a result of simulation regarding a transmission characteristic of the bandpass filter according to the present invention, which is shown in FIG. 17.

FIG. 27 is a graph illustrating a result of calculation, wherein horizontal axis refers to frequencies, vertical axis refers to losses, S21 refers to a transmission characteristic, and S11 refers to a reflection characteristic. FIG. 27 shows that a loss of less than 1.5 dB occurs in the frequency range of 3.4 GHz to 4.6 GHz that corresponds to 30% by the relative bandwidth in the transmission characteristic S21, and an attenuation pole is formed at each of 2.5 GHz and 5.3 GHz other than the pass band. As such, it can be possible to obtain an excellent transmission characteristic of being capable of securing sufficient attenuation at the band other than the pass band as well as of being flat and of low loss over the entire region of the broad pass band therefore the effectiveness of the present invention might be verified.

In the meanwhile, the transfer properties of the bandpass filter having the construction without the resonance electrode coupling conductor 32 shown in FIG. 17 were calculated by electromagnetic simulation. The conditions for calculation were as follows: relative dielectric constant of the dielectric layer 11=9.4, dissipation factor=0.0005, and conductivity=$3.0\times10^7$ S/m. As the shape measurements of design values for the trial production, the resonance electrodes 30*a*, 30*b*, 30*c*, and 30*d* were adapted to have the width of 0.4 mm, the length of 2.85 mm, the interval of 0.15 mm between the resonance electrode 30*a* and the resonance electrode 30*b*, and the interval of 0.15 mm between the resonance electrode 30*c* and the resonance electrode 30*d*, and the interval of 0.20 mm between the resonance electrode 30*b* and the resonance electrode 30*c*. Each of the input coupling electrode 40*a* and the output coupling electrode 40*b* was adapted to have the width of 0.3 mm and the length of 2.5 mm, and each of the auxiliary input coupling electrode 41*a* and the auxiliary output coupling electrode 41*b* was adapted to have the width of 0.3 mm and the length of 1.45 mm. Each of the auxiliary resonance electrodes 31*a*, 31*b*, 31*c*, and 31*d* was adapted to have a first rectangular portion and a second rectangular portion joined to each other, wherein the first rectangular portion is arranged 0.3 mm away from the other end of each of the resonance electrodes 30*a*, 30*b*, 30*c*, and 30*d* and has the width of 0.45 mm and the length of 0.8 mm, and the second rectangular portion is located from the first rectangular portion toward each of the resonance electrodes 30*a*, 30*b*, 30*c*, and 30*d* and has the width of 0.2 mm and the length of 0.4 mm. Each of the input terminal electrode 60*a* and the output terminal electrode 60*b* was adapted to have a square portion whose one edge is 0.3 mm and to be 0.2 mm away from the second ground electrode 22. In the external appearance, each of the first ground electrode 21, the second ground electrode 22, and the annular ground electrode 23 was adapted to have the width of 4 mm and the length of 6 mm, and the opening portion of the annular ground electrode 23 was adapted to have the width of 3 mm and the length of 3 mm. The bandpass filter was overall adapted to have the width of 3 mm, the length of 5 mm, and the thickness of 0.9 mm. The interval between the inter-layer portion B and the inter layer portion C was adapted to be 0.065 mm. The thickness of various electrodes was adapted to be 0.013 mm, and the diameter of various penetration conductors was adapted to be 0.1 mm.

Figure 28:
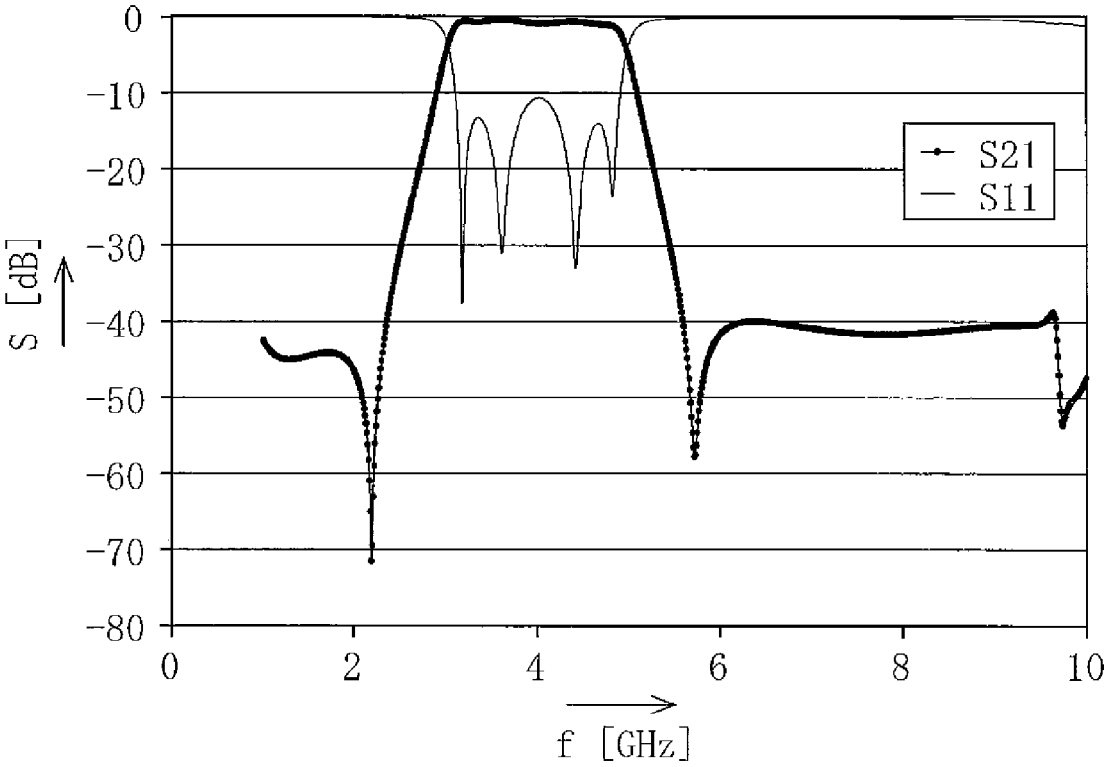
FIG. 28 is a view illustrating a result of simulation regarding a transmission characteristic of the bandpass filter shown in FIG. 17, in which the resonance electrode coupling conductor has been removed.

FIG. 28 is a graph illustrating a result of calculation, wherein horizontal axis refers to frequencies, vertical axis refers to losses, S21 refers to a transmission characteristic, and S11 refers to a reflection characteristic. It could be seen in FIG. 28 that attenuation is smooth at the bands other than the pass band and the attenuation is sufficiently not secured.

EXAMPLE 3

The transfer characteristics of the bandpass filter having the construction shown in FIG. 22 were calculated by electromagnetic simulation. The conditions for calculation were as follows: relative dielectric constant of the dielectric layer 11=9.4, dissipation factor=0.0005, and conductivity=$3.0\times10^7$ S/m. As the shape measurements of design values used for the trial production, the uppermost layer and the lowermost layer among the seven layers were adapted to have the thickness of 0.3 mm and the other layers were adapted to have the thickness of 0.075 mm as the thickness of the dielectric layer 11. Further, each of the first resonance electrodes 30*a*, 30*b*, 30*c*, and 30*d* was adapted to have the width of 0.4 mm, the length of 2.85 mm, the interval of 0.15 mm between the first resonance electrode 30*a* (resonance electrode of input stage) and the first resonance electrode 30*b* and between the first resonance electrode 30*c* and the first resonance electrode 30*d* (resonance electrode of output stage), and the interval of 0.14 mm between the resonance electrode 30*b* and the resonance electrode 30*c*. Each of the input coupling electrode 40*a* and the output coupling electrode 40*b* was adapted to have the width of 0.3 mm and the length of 2.5 mm and each of the auxiliary input coupling electrode 41*a* and the auxiliary output coupling electrode 41*b* was adapted to have the width of 0.3 mm and the length of 1.45 mm. Each of the auxiliary resonance electrodes 31*a*, 31*b*, 31*c*, and 31*d* was adapted to have a first rectangular portion and a second rectangular portion, wherein the first rectangular portion is arranged 0.3 mm away from the other end of each of the resonance electrodes 30*a*, 30*b*, 30*c*, and 30*d* and has the width of 0.45 mm and the length of 0.8 mm, and the second rectangular portion is located from the first rectangular portion toward each of the resonance electrodes 30*a*, 30*b*, and 30*c* and has the width of 0.2 mm and the length of 0.4 mm. Each of the input terminal electrode 60*a* and the output terminal electrode 60*b* was adapted to have a square portion whose one edge is 0.3 mm long, and to be 0.2 mm away from the second ground electrode 22. In the external appearance, each of the first ground electrode 21, the second ground electrode 22, and the annular ground electrode 23 was adapted to have the width of 3 mm and the length of 5 mm, and the opening portion of the annular ground electrode 23 was adapted to have the width of 2.4 mm and the length of 3 mm. The bandpass filter was overall adapted to have the width of 3 mm, the length of 5 mm, and the thickness of 0.975 mm. The interval between the inter-layer portion C on which the auxiliary input coupling electrode 41*a* and the auxiliary output coupling electrode 41*b* are arranged and the inter-layer portion B located over the inter-layer portion C and on which the auxiliary resonance electrodes 31*a*, 31*b*, 31*c*, and 31*d* are arranged was adapted to be 0.065 mm. The thickness of various electrodes was adapted to be 0.013 mm, and the diameter of various penetration conductors was adapted to be 0.1 mm. The resonance electrode coupling conductor for forming the attenuation pole was adapted to have the width of 0.3 mm at the input stage coupling region and the output stage coupling region, and the width of 0.1 mm at the connection region.

Further, each of the second resonance electrode 33*a* and 33*b*, which operate as a counteraction resonator, were shaped to have a strip-shaped region having the width of 0.1 mm and the length of 3.4 mm and a broad-width region (the width is 0.4 mm and the length is 0.36 mm) that is protruded from the other end of the strip-shaped region toward one side. The second resonance electrode 33*a* is positioned at a location spaced by 0.03 mm from a location of the second resonance electrode 33*a* when an edge of the second resonance electrode 33*a* overlaps an edge of the first resonance electrode 30*b*, which is located in the vicinity of the resonance electrode 30*a* of the input stage, as seen from the above, so that the second resonance electrode 33*a* is adjacent to the resonance electrode 30*a* of the input stage. Similarly, the second resonance electrode 33*b* is positioned at a location spaced by 0.03 mm from a location of the second resonance electrode 33*b* when an edge of the second resonance electrode 33*b* overlaps an edge of the first resonance electrode 30*c*, which is located in the vicinity of the resonance electrode 30*d* of the output stage, as seen from the above, so that the second resonance electrode 33*b* is adjacent to the resonance electrode 30*d* of the output stage.

FIG. 29 is a graph illustrating a result of calculation, wherein horizontal axis refers to frequencies, vertical axis refers to losses, S21 refers to a transmission characteristic, and S11 refers to a reflection characteristic. FIG. 29 shows that a loss of less than 1.5 dB occurs in the frequency range of 3.4 GHz to 4.6 GHz that corresponds to 30% by the relative bandwidth in the a transmission characteristic S21, and one attenuation pole is formed at 2.5 GHz and two attenuation poles are formed at 5.3 GHz. Further, abrupt increase between the attenuation poles at the high band is also suppressed. As such, it may be possible to obtain an excellent transmission characteristic of securing sufficient attenuation at the frequency bands other than the pass band as well as being flat and of low loss over the entire region of the broad pass band.

In the meanwhile, measurement was made with respect to the second resonance electrodes 33*a* and 33*b* having the same structure as above, but their locations have been changed. Here, the second resonance electrode 33*a* is positioned at a location spaced by 0.03 mm from a location of the second resonance electrode 33*a* when an edge of the second resonance electrode 33*a* overlaps an edge of the first resonance electrode 30*b*, which is located in the vicinity of the resonance electrode 30*a* of the input stage, as seen from the above, so that the second resonance electrode 33*a* is away from the resonance electrode 30*a* of the input stage. Similarly, the second resonance electrode 33*b* is positioned at a location spaced by 0.03 mm from a location of the second resonance electrode 33*b* when an edge of the second resonance electrode 33*b* overlaps an edge of the first resonance electrode 30*c*, which is located in the vicinity of the resonance electrode 30*d* of the output stage, as seen from the above, so that the second resonance electrode 33*b* is away from the resonance electrode 30*d* of the output stage.

FIG. 30 is a graph illustrating a result of measurement, wherein horizontal axis refers to frequencies, vertical axis refers to losses, S21 refers to a transmission characteristic, and S11 refers to a reflection characteristic. The graph illustrated in FIG. 30 shows that one attenuation pole is formed at 2.5 HGz and two attenuation poles are formed at 5.3 GHz other than the pass band in the transmission characteristic S21, an abrupt attenuation characteristic may be obtained near the cutoff frequency similarly to the characteristic shown in FIG. 29, but sharp increase appears between the attenuation poles at the higher band than near the cutoff frequency, and the characteristic is slightly poorer than the characteristic shown in FIG. 29. Accordingly, it can be seen that the second resonance electrode needs to be positioned to remove the sharp increase.

Figure 31:
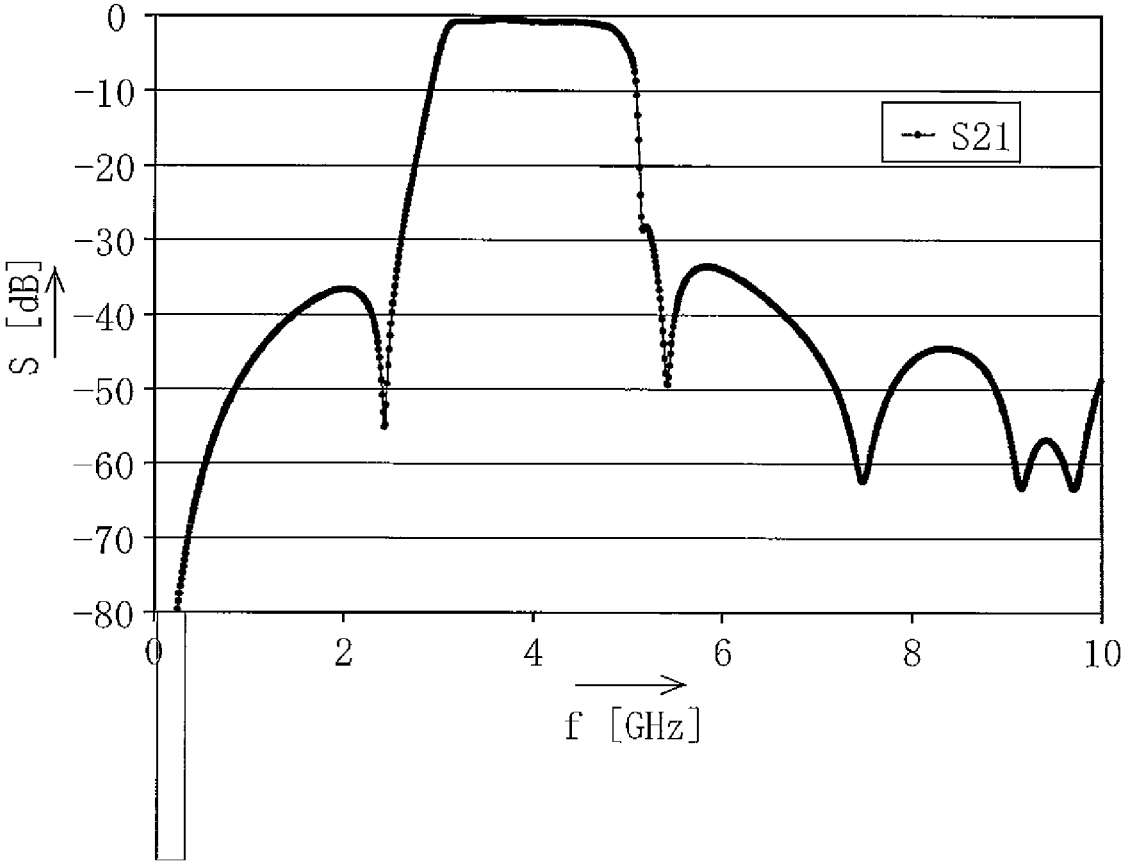
FIG. 31 is a view illustrating a result of simulation regarding a transmission characteristic of another example of the bandpass filter according to the present invention, which is shown in FIG. 19A and FIG. 19B.

Further, FIGS. 29 and 30 showed that the resonance peak appeared and the out-of-band properties were deteriorated near 9 GHz. It is preferable to improve this situation since this band is also included in the use frequency for UWB. Accordingly, the resonance electrode coupling conductor 32 was arranged so that the input stage coupling region 321 and the output stage coupling region 322 are located outside the central axis of the resonance electrode 30*a* of the input stage and the resonance electrode 30*d* of the output stage, respectively, as shown in FIGS. 19A and 19B. Other parameters such as dimensions regarding the fundamental structure were adapted to have the same parameters as in the structures according to the above examples. A result of calculation was shown in FIG. 31. As a consequence, out-of-band properties up to 10 GHz might be improved less than 30 dB.

Figure 32:
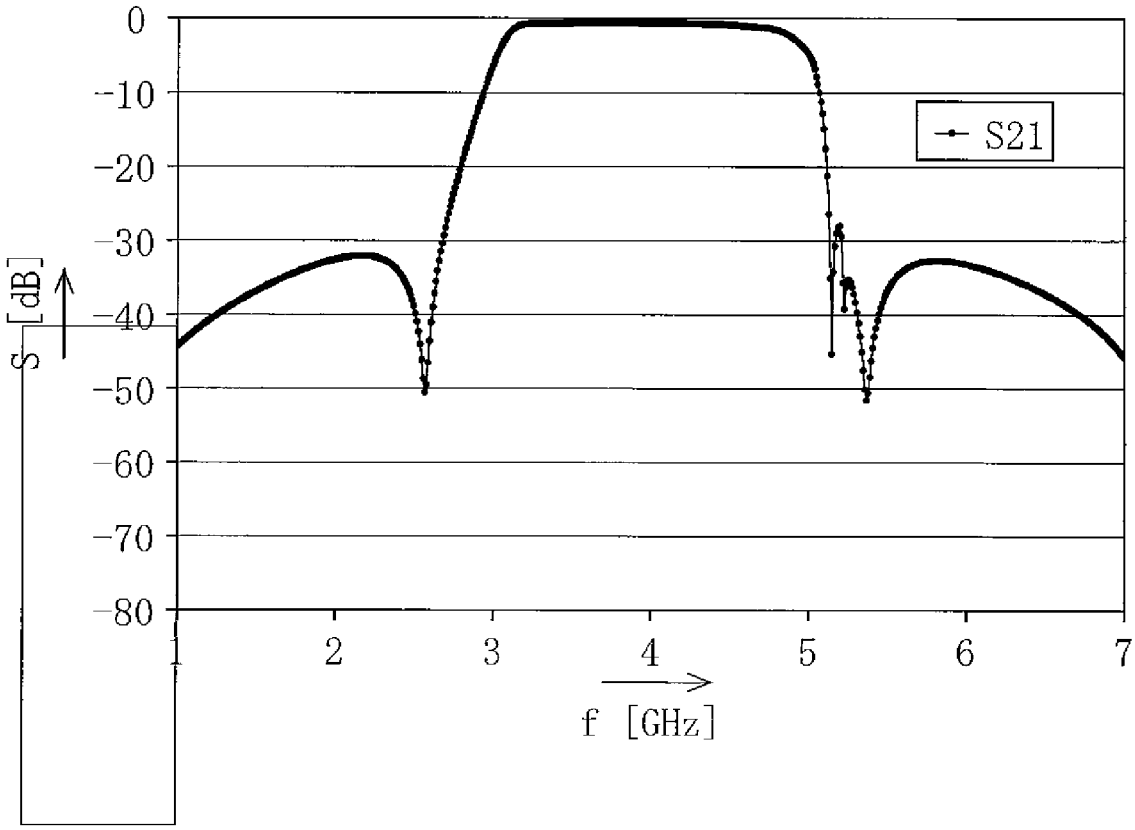
FIG. 32 is a view illustrating a result of simulation regarding a transmission characteristic of another example of the bandpass filter according to the present invention, which is shown in FIG. 20.

Further, FIG. 32 shows a result of calculation of the transfer properties S21 obtained by performing simulation on the structure shown in FIG. 20, wherein parameters such as dimensions regarding the fundamental structure were adapted to have the same parameters as in the structures according to the above examples. Further, in the structure shown in FIG. 20, the input coupling resonance electrode 34*a* is located over the input coupling electrode 40*a* and outside the region on which the first resonance electrodes 30*a*, 30*b*, 30*c*, and 30*d* are arranged, and the output coupling resonance electrode 34*b* is located over the output coupling electrode 40*b* and outside the region on which the first resonance electrodes 30*a*, 30*b*, 30*c*, and 30*d* are arranged. A new attenuation pole is created near 5 GHz, so that a further abrupt skirt characteristic may be obtained.

The transfer characteristic was calculated by electromagnetic simulation on the structure where the second resonance electrode has been removed from the structure shown in FIG. 22. The conditions of calculation were as follows: relative dielectric constant of the dielectric layer 11=9.4, dissipation factor=0.0005, and conductivity=$3.0\times10^{7}$ S/m. As the shape measurements of design values used for the trial production, each of the uppermost and lowermost layers among the six layers of the dielectric layer 11 were adapted to have the thickness of 0.3 mm and the other layers were adapted to have the thickness of 0.075 mm. Each of the first resonance electrodes 30*a*, 30*b*, 30*c*, and 30*d* was adapted to have the width of 0.4 mm, the length of 2.85 mm, and the interval of 0.15 mm between the first resonance electrode 30*a* (resonance electrode of input stage) and the first resonance electrode 30*b* and between the first resonance electrode 30*c* and the first resonance electrode 30*d* (resonance electrode of the output stage), and the interval of 0.15 mm between the first resonance electrode 30*b* and the first resonance electrode 30*c*. Each of the input coupling electrode 40*a* and the output coupling electrode 40*b* was adapted to have the width of 0.3 mm and the length of 2.5 mm, and each of the auxiliary input coupling electrode 41*a* and the auxiliary output coupling electrode 41*b* was adapted to have the width of 0.3 mm and the length of 1.45 mm. Each of the auxiliary resonance electrodes 31*a*, 31*b*, 31*c*, and 31*d* was adapted to have a first rectangular portion and a second rectangular portion joined to each other, wherein the first rectangular portion is arranged 0.3 mm away from the other end of each of the resonance electrodes 30*a*, 30*b*, 30*c*, and 30*d* and has the width of 0.45 mm and the length of 0.8 mm, and the second rectangular portion is located from the first rectangular portion toward each of the resonance electrodes 30*a*, 30*b*, 30*c*, and 30*d*, and has the width of 0.2 mm and the length of 0.4 mm. Each of the input terminal electrode 60*a* and the output terminal electrode 60*b* was adapted to have a square portion whose one edge is 0.3 mm long and to be 0.2 mm away from the second ground electrode 22. In the external appearance, each of the first ground electrode 21, the second ground electrode 22, and the annular ground electrode 23 was adapted to have the width of 4 mm and the length of 6 mm, and the opening portion of the annular ground electrode 23 was adapted to have the width of 2.4 mm and the length of 3 mm. The bandpass filter was overall adapted to have the width of 3 mm, the length of 5 mm, and the thickness of 0.9 mm. The interval between the inter-layer portion C on which the auxiliary input coupling electrode 41*a* and the auxiliary output coupling electrode 41*b* are arranged and the inter-layer portion B located above the inter-layer portion C and on which the auxiliary resonance electrodes 31*a*, 31*b*, 31*c*, and 31*d* are arranged was adapted to be 0.065 mm. The thickness of various electrodes was adapted to be 0.013 mm, and the diameter of various penetration conductors was adapted to be 0.1 mm. The resonance electrode coupling conductor for forming the attenuation poles was adapted to have the width of 0.2 mm at the input stage coupling region and the output stage coupling region and the width of 0.1 mm at the connection region.

Figure 33:
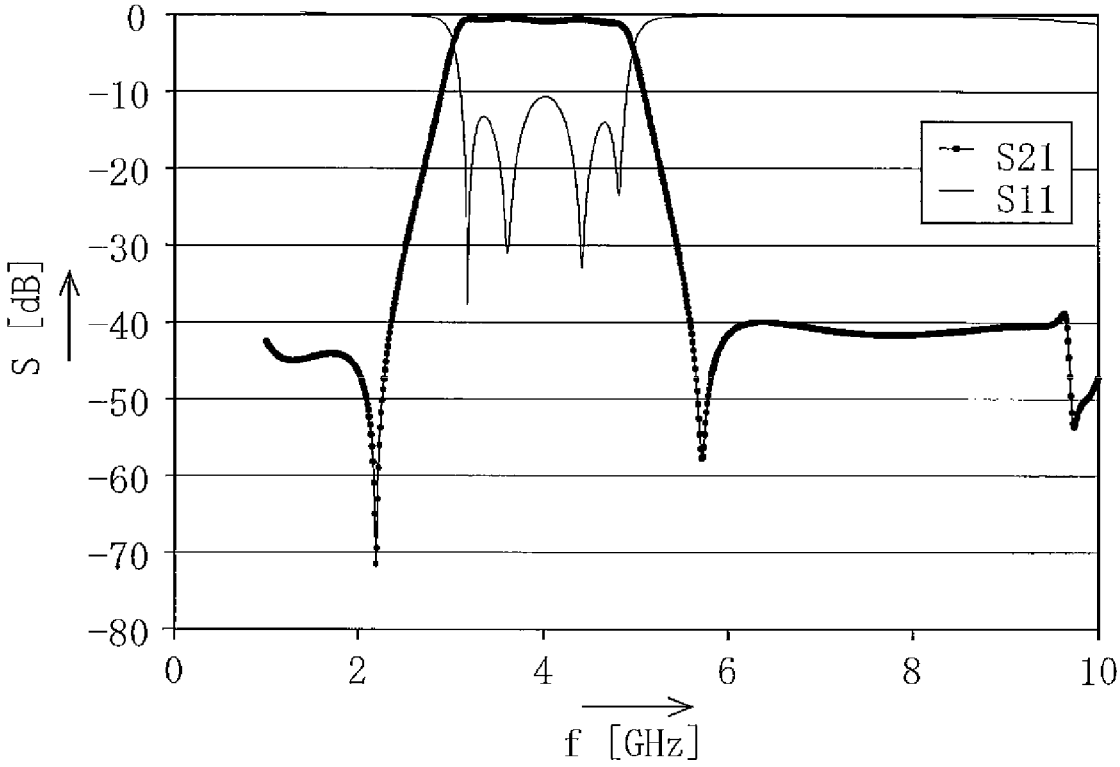
FIG. 33 is a view illustrating a result of simulation regarding a transmission characteristic of the bandpass filter shown in FIG. 22, in which a second resonance electrode coupling conductor has been removed.

FIG. 33 is a graph illustrating a result of calculation, wherein horizontal axis refers to frequencies, vertical axis refers to losses, S21 refers to a transmission characteristic, and S11 refers to a reflection characteristic. FIG. 33 shows that a loss of less than 1.5 dB occurs in the frequency range of 3.4 GHz to 4.6 GHz that corresponds to 30% by the relative bandwidth in the transmission characteristic S21, and an attenuation pole is formed at each of 2.5 GHz and 5.3 GHz other than the pass band. As such, it can be seen that it may be possible to obtain an excellent transmission characteristic of securing sufficient attenuation at the frequency band other than the pass band as well as being flat and of low loss over the entire region of the broad pass band, however, it fails to provide abrupt attenuation compared to the present invention.

Accordingly, the effectiveness of the present invention having the second resonance electrode might be verified.

The present invention can be carried out in other various forms without departing from the spirit or principal features thereof. Therefore, the above described embodiments are illustrative only in all respects and the scope of the present invention is described in the claims and is not limited by the body of the specification in the least. Furthermore, modifications and changes belonging to the claims are all within the scope of the present invention.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. A bandpass filter comprising:

a laminate formed by stacking a plurality of dielectric layers;

a first ground electrode arranged on a bottom surface of the laminate;

a second ground electrode arranged on a top surface of the laminate;

a plurality of strip-shaped first resonance electrodes arranged in parallel with each other on a first inter-layer portion of the laminate to be electromagnetically coupled with each other, each of the plurality of first resonance electrodes having a ground end and an open end, each of the ground ends being connected to a ground potential so that the plurality of first resonance electrodes function as a ¼ wavelength resonator;

a strip-shaped input coupling electrode arranged on a second inter-layer portion of the laminate, different from the first inter-layer portion of the laminate, and overlapping more than half of the length of one of the plurality of first resonance electrodes corresponding to an input stage;

a strip-shaped output coupling electrode arranged on a third inter-layer portion of the laminate, different from the first inter-layer portion of the laminate and overlapping more than half of the length of one of the plurality of first resonance electrodes corresponding to an output stage, wherein the input coupling electrode has a portion where an electrical signal inputted from an external circuit is supplied, the portion is located closer to the open end of the first resonance electrode corresponding to the input stage than the center of the input coupling electrode in the longitudinal direction, and the output coupling electrode has a portion where an electrical signal outputted to the external circuit is drawn, the portion is located closer to the open end of the first resonance electrode corresponding to the output stage than the center of the output coupling electrode in the longitudinal direction.

2. The bandpass filter according to claim 1, wherein the plurality of first resonance electrodes are arranged so that the ground ends of the first resonance electrodes alternate with the open ends of neighboring first resonance electrodes to form an inter-digital structure.

3. A bandpass filter comprising according to claim 2, wherein the plurality of strip-shaped first resonance electrodes comprises a resonance electrode group which includes four or more and even-numbered strip-shaped first resonance electrodes, the second inter-layer portion and the third inter-layer portion are located at the same side of the laminate with respect to the first inter-layer portion, a resonance electrode coupling conductor arranged on a fourth inter-layer portion which is located at an opposite side of both the second inter-layer portion and the third inter-layer portion with respect to the first inter-layer portion, one end of which is connected to the ground potential near the one end of a closest first resonance electrode of the resonance electrode group to the input stage , and the other end is connected to the ground potential near the one end of a farthest first resonance electrode of the resonance electrode group to the input stage, the resonance electrode coupling conductor having a region facing both the closest first resonance electrode and the farthest first resonance electrode to be electromagnetically coupled therewith respectively.

4. The bandpass filter according to claim 3, wherein the resonance electrode coupling conductor comprises, an input side coupling region facing the closest first resonance electrode, an output side coupling region facing the farthest first resonance electrode, and a connection region connecting the input side coupling region and the output side coupling region, wherein the input side coupling region is parallel to the output side coupling region, and the connection region is perpendicular to both the input and output side regions.

5. A bandpass filter comprising according to claim 3, further comprising:

one or more second resonance electrodes arranged on a fifth inter-layer portion which is located at an opposite side of both the second inter-layer portion and the third inter-layer portion with respect to the first inter-layer portion and different from the fourth inter-layer portion, the one or more second resonance electrodes being parallel with the four or more first resonance electrodes, one end of which is connected to the ground potential, the second resonance electrode being shaped as a strip to have a different length from that of the four or more first resonance electrodes, the second resonance electrode having a resonance frequency near a cutoff frequency outside a pass band.

6. The bandpass filter according to claim 5, wherein the plurality of first resonance electrodes include even-numbered first resonance electrodes, the one or more second resonance electrode includes even-numbered second resonance electrodes, the second resonance electrodes are in point symmetry with respect of an intersection point of a line connecting one end of the first resonance electrode corresponding to the input stage with one end of the first resonance electrode corresponding to the output stage and a line connecting the other end of the first resonance electrode corresponding to the input stage and the other end of the first resonance electrode corresponding to the output stage by viewing from top surface of the laminate.

7. The bandpass filter according to claim 1, further comprising:

a plurality of first penetration conductors penetrating at least one of the plurality of dielectric layers, wherein one of the plurality of first penetration conductors is connected to the strip-shaped input coupling electrode, for inputting the electrical signal from the external circuit, another one of the plurality of first penetration conductors is connected to the strip-shaped output coupling electrode, for outputting the electrical signal from the external circuit.

8. The bandpass filter according to claim 1, further comprising:

an annular ground electrode formed on the first inter-layer portion to surround the plurality of first resonance electrodes, wherein one end of each of the plurality of first resonance electrodes is connected to the annular ground electrode that is connected to the ground potential.

9. The bandpass filter according to claim 8, further comprising:

a plurality of auxiliary resonance electrodes, one for each of the plurality of first resonance electrodes, arranged on a sixth inter-layer portion which is different from the first inter-layer portion to have a region overlapping the annular ground electrode and a region overlapping a corresponding one of the plurality of first resonance electrodes, wherein the region overlapping the corresponding first resonance electrode is connected to the open end of the corresponding first resonance electrode through one of a plurality of fourth penetration conductors that are located between the auxiliary resonance electrodes and the corresponding first resonance electrodes to pass through the dielectric layer.

10. The bandpass filter according to claim 9, further comprising:

an auxiliary input coupling electrode arranged on a seventh inter-layer portion which is different from the sixth inter-layer portion and having a region overlapping the auxiliary resonance electrode connected to the first resonance electrode corresponding to the input stage among the plurality of auxiliary resonance electrodes and a region facing the input coupling electrode, wherein the region facing the input coupling electrode is connected to a portion of the input coupling electrode, which is nearer the open end of the first resonance electrode corresponding to the input stage than the center of the input coupling electrode in the longitudinal direction, through one of a plurality of second penetration conductors located between the auxiliary input coupling electrode and the input coupling electrode and passing through the dielectric layer; and an auxiliary output coupling electrode arranged on a eighth inter-layer portion which is different from the sixth inter-layer portion and having a region facing the auxiliary resonance electrode connected to the first resonance electrode corresponding to the output stage among the plurality of auxiliary resonance electrodes and a region facing the output coupling electrode, wherein the region facing the output coupling electrode is connected to a portion of the output coupling electrode, which is nearer the open end of the first resonance electrode corresponding to the output stage than the center of the output coupling electrode in the longitudinal direction through another one of the plurality of second penetration conductors located between the auxiliary output coupling electrodes and the output coupling electrode and passing through the dielectric layer.

11. A high frequency module comprising:

a bandpass filter according to claim 1;

a physical layer circuit connected to the bandpass filter; and a medium access control circuit connected to the physical layer circuit.

12. A radio communication device comprising:

a bandpass filter according to claim 1;

a physical layer circuit connected to the bandpass filter;

a medium access control circuit connected to the physical layer circuit; and an antenna connected to the bandpass filter.

* * * * *